US006585548B2

(12) United States Patent
McCarthy

(10) Patent No.: US 6,585,548 B2
(45) **Date of Patent: *Jul. 1, 2003**

(54) HIGH EFFICIENCY HYDROFOIL AND SWIM FIN DESIGNS

(76) Inventor: Peter T. McCarthy, 1628 W. Ocean Front Apt#2, Newport Beach, CA (US) 92663

( * ) Notice: Subject to any disclaimer, the term of this patent is extended or adjusted under 35 U.S.C. 154(b) by 0 days.

This patent is subject to a terminal disclaimer.

(21) Appl. No.: 10/039,001

(22) Filed: Jan. 4, 2002

(65) Prior Publication Data

US 2002/0155768 A1 Oct. 24, 2002

Related U.S. Application Data

(63) Continuation of application No. 09/776,495, filed on Feb. 1, 2001, which is a continuation of application No. 08/713,110, filed on Nov. 14, 2000, now Pat. No. 6,371,821, which is a continuation of application No. 09/313,673, filed on May 18, 1999, now Pat. No. 6,146,224, which is a continuation of application No. 09/021,105, filed on Feb. 10, 1998, now Pat. No. 6,050,868, which is a continuation of application No. 08/583,973, filed on Jan. 11, 1996, now Pat. No. 5,746,631.

(51) Int. Cl.[7] ..... A63B 31/08
(52) U.S. Cl. ..... 441/64
(58) Field of Search ..... 441/64

(56) References Cited

U.S. PATENT DOCUMENTS

| | | | |
|---|---|---|---|
| 5,384 | A | 12/1847 | Heathorn |
| 144,538 | A | 11/1873 | Harsen |

(List continued on next page.)

FOREIGN PATENT DOCUMENTS

| | | |
|---|---|---|
| DE | 1075 997 | 2/1960 |
| DE | 3438808 | 4/1986 |

(List continued on next page.)

OTHER PUBLICATIONS

Rossier, Robert N., entitled, "Moving Forward—Getting your best kick in the water can come from a combination of design, efficiency and hydrodynamics in fins". Alert Diver, Nov.–Dec. 1997, pp. 26–28.

(List continued on next page.)

*Primary Examiner*—Jesus D. Sotelo
(74) *Attorney, Agent, or Firm*—Knobbe Martens Olson & Bear, LLP

(57) ABSTRACT

Methods are disclosed for increasing lift and decreasing turbulence and drag on hydrofoils and swim fins. Fins are disclosed having at least one pivoting blade region connected to the swim fin with a flexible joint element made from reduced blade thickness, blade cutout regions, and injection molding of the flexible material of the foot pocket. Methods are also provided for limiting the deflections of at least one pivoting blade region with a movable blade limiting member connected to both the pivoting blade region and a blade limiting load bearing member with a chemical bond created during molding. Methods are disclosed for orienting at least one pivoting blade region at a reduced angle of attack sufficient for increased efficiency and reduced effort. Injection molding assembly methods with chemical bonds and mechanical bonds are provided. Fins having transverse flexible elements, transverse recesses, longitudinal recesses and venting systems are also disclosed.

164 Claims, 13 Drawing Sheets

U.S. PATENT DOCUMENTS

| | | | |
|---|---|---|---|
| 169,396 | A | 11/1875 | Ahlstrom |
| 234,305 | A | 5/1880 | Bovey |
| 476,092 | A | 12/1892 | Valente |
| 783,012 | A | 2/1905 | Biedermann et al. |
| 787,291 | A | 5/1905 | Michiels |
| 871,059 | A | 11/1907 | Douse |
| 998,146 | A | 7/1911 | Alfier et al. |
| 1,061,264 | A | 5/1913 | Bys |
| 1,324,722 | A | 12/1919 | Bergin |
| 1,607,857 | A | 5/1926 | Zukal |
| 1,684,714 | A | 8/1928 | Perry |
| 2,241,305 | A | 2/1941 | Hill, Jr. |
| 2,321,009 | A | 9/1943 | Churchill |
| 2,343,468 | A | 3/1944 | Messinger |
| 2,423,571 | A | 7/1947 | Wilen |
| 2,588,363 | A | 3/1952 | Corlieu |
| 2,850,487 | A | 9/1958 | D'Alello |
| 2,865,033 | A | 12/1958 | Jayet |
| 2,889,563 | A | 6/1959 | Lamb et al. |
| 2,903,719 | A | 9/1959 | Wozencraft |
| 2,950,487 | A | 8/1960 | Woods |
| 3,019,458 | A | 2/1962 | De Barbieri et al. |
| 3,055,025 | A | 9/1962 | Ferraro et al. |
| 3,082,442 | A | 3/1963 | Cousteau et al. |
| 3,084,355 | A | 4/1963 | Ciccotelli |
| 3,086,492 | A | 4/1963 | Holley |
| 3,109,495 | A | 11/1963 | Lang |
| 3,112,503 | A | 12/1963 | Girden |
| 3,171,142 | A | 3/1965 | Auzols |
| 3,239,857 | A | 3/1966 | Gwynne |
| 3,256,540 | A | 6/1966 | Novelli |
| 3,411,165 | A | 11/1968 | Murdoch |
| 3,422,470 | A | 1/1969 | Mares |
| 3,453,981 | A | 7/1969 | Gause |
| 3,491,997 | A | 1/1970 | Winters |
| 3,665,535 | A | 5/1972 | Picken |
| 3,773,011 | A | 11/1973 | Gronier |
| 3,810,269 | A | 5/1974 | Tabata et al. |
| 3,922,741 | A | 12/1975 | Semeia |
| 3,934,290 | A | 1/1976 | Le Vasseur |
| 3,952,351 | A | 4/1976 | Gisbert |
| 4,007,506 | A | 2/1977 | Rasmussen |
| 4,025,977 | A | 5/1977 | Cronin |
| 4,083,071 | A | 4/1978 | Forjot |
| 4,193,371 | A | 3/1980 | Baulard-Caugan |
| 4,197,869 | A | 4/1980 | Moncrieff-Yeates |
| 4,209,866 | A | 7/1980 | Loeffler |
| 4,342,558 | A | 8/1982 | Wilson |
| D278,165 | S | 3/1985 | Evans |
| 4,521,220 | A | 6/1985 | Schoofs |
| 4,541,810 | A | 9/1985 | Wenzel |
| 4,657,515 | A | 4/1987 | Ciccotelli |
| 4,689,029 | A | 8/1987 | Ciccotelli |
| 4,738,645 | A | 4/1988 | Garofalo |
| 4,752,259 | A | 6/1988 | Tackett et al. |
| 4,773,885 | A | 9/1988 | Ciccotelli |
| 4,775,343 | A | 10/1988 | Lamont et al. |
| 4,781,637 | A | 11/1988 | Caires |
| 4,820,218 | A | 4/1989 | Van de Pol |
| D302,999 | S | 8/1989 | McCredie |
| 4,857,024 | A | 8/1989 | Evans |
| 4,869,696 | A | 9/1989 | Ciccotelli |
| 4,895,537 | A | 1/1990 | Ciccotelli |
| 4,929,206 | A | 5/1990 | Evans |
| 4,934,971 | A | 6/1990 | Picken |
| 4,940,437 | A | 7/1990 | Piatt |
| 4,944,703 | A | 7/1990 | Mosier |
| 4,954,111 | A | 9/1990 | Cressi |
| 4,954,112 | A | 9/1990 | Negrini et al. |
| D327,933 | S | 7/1992 | Evans |
| D327,934 | S | 7/1992 | Evans |
| D327,935 | S | 7/1992 | Evans |
| D328,118 | S | 7/1992 | Evans |
| 5,163,859 | A | 11/1992 | Beltrani et al. |
| D340,272 | S | 10/1993 | Evans |
| 5,304,081 | A | 4/1994 | Takizawa |
| 5,324,219 | A | 6/1994 | Beltrani et al. |
| 5,356,323 | A | 10/1994 | Evans |
| 5,358,439 | A | 10/1994 | Paolo |
| D353,181 | S | 12/1994 | Evans |
| 5,374,210 | A | 12/1994 | Sardella et al. |
| 5,387,145 | A | 2/1995 | Wagner |
| 5,417,599 | A | 5/1995 | Evans |
| 5,429,536 | A | 7/1995 | Evans |
| 5,435,764 | A | 7/1995 | Testa et al. |
| 5,443,593 | A | 8/1995 | Garofalo |
| 5,522,748 | A | 6/1996 | Cressi |
| 5,527,197 | A | 6/1996 | Evans |
| 5,533,918 | A | 7/1996 | Sanders |
| 5,595,518 | A | 1/1997 | Ours |
| 5,597,336 | A | 1/1997 | Evans |
| D393,684 | S | 4/1998 | Lin |
| 5,746,631 | A | 5/1998 | McCarthy |
| D396,897 | S | 8/1998 | Evans |
| 5,810,629 | A | 9/1998 | Parr |
| D404,456 | S | 1/1999 | Evans |
| 6,050,868 | A | 4/2000 | McCarthy |
| 6,095,879 | A | 8/2000 | McCarthy |
| 6,126,503 | A | 10/2000 | Viale et al. |
| 6,146,224 | A | 11/2000 | McCarthy |

FOREIGN PATENT DOCUMENTS

| | | |
|---|---|---|
| DE | 259 353 A | 8/1988 |
| EP | 0 308 998 | 3/1989 |
| FR | 787291 | 7/1935 |
| FR | 1208636 | 9/1959 |
| FR | 1245395 | 9/1960 |
| FR | 1.245.395 | 9/1960 |
| FR | 1501208 | 11/1967 |
| FR | 2 058 941 | 5/1971 |
| FR | 2 213 072 | 8/1974 |
| FR | 2 490 498 | 3/1982 |
| FR | 2 543 841 | 4/1983 |
| FR | 2574 748 A | 6/1986 |
| GB | 17033 | 10/1890 |
| GB | 234305 | 7/1924 |
| GB | 1284765 | 8/1972 |
| IT | 553307 | 12/1956 |
| IT | 625377 | 9/1961 |
| JP | 61-6097 | 1/1986 |
| JP | 62 134395 | 6/1987 |
| SU | 1323 463 A | 3/1986 |

OTHER PUBLICATIONS

Triantafyllou, Michael S. and Triantafyllou George S., entitled, "An Efficient Swimming Machine". Scientific American, Mar. 1995, pp. 64–70.

"3302 of 1880" (Picture From Book–Found in US PTO).

"Test Dive" Article in Jan./Feb. 1996 issue of *Sport Diver Magazine*.

"Oceanic V–Drive Fins" May/Jun. 1996 Issue of *Sport Diver Magazine*.

Walton and Katz "Application of Leading–Edge Vortex Manipulations to Reduce Wing Rock Amplitudes" *Journal of Aircraft* vol. 30, No. 4, pp. 555–559.

Traub and Nurick "Effects of Wing–Tip Vortex Flaps" *Journal of Aircraft* vol. 30, No. 4, pp. 557–559.
Grantz and Marchmann III"Trailing Edge Flap Influence on Leading Edge Vortex Flap Aerodynamics", *Journal of Aircraft* vol. 20, No. 2, pp. 165–169.
Rao "An Exploratory Study of Area–Efficient Vortex Flap Concepts" *Journal of Aircraft*, vol. 20, No. 12, pp. 1062–1067.
Lamar and Campbell "Vortex Flaps–Advanced Control Devices for Supercruise Fighters" Jan. 1984, Aerospace America.
"BZ" bodysurfing fin (Picture), 1st production in 1990.
"Blade Pro" bodysurfing fin (Picture), 1st production 1991.
"Wave Rebel" bodysurfing fin (Picture), 1st production 1994.
Art. 1400 Pinna "Professional" Fin (1989).

HIGH EFFICIENCY HYDROFOIL AND SWIM FIN DESIGNS

RELATED APPLICATIONS

This application is a continuation of U.S. patent application Ser. No. 09/776,495, filed on Feb. 1, 2001, which is a continuation of U.S. patent application Ser. No. 09/713,110, filed on Nov. 14, 2000, now U.S. Pat. No. 6,371,821 which is a continuation of U.S. Patent Application Ser. No. 09/313,673 (now U.S. Pat. No. 6,146,224), filed on May 18, 1999, which is a continuation of U.S. patent application Ser. No. 09/021,105 (now U.S. Pat. No. 6,050,868), filed on Feb. 10, 1998, which is a continuation of U.S. patent application Ser. No. 08/583,973 (now U.S. Pat. No. 5,746,631), filed on Jan. 11, 1996.

BACKGROUND-FIELD OF INVENTION

This invention relates to hydrofoils, specifically to such devices which are used to create directional movement relative to a fluid medium, and this invention also relates to swimming aids, specifically to such devices which attach to the feet of a swimmer and create propulsion from a kicking motion.

BACKGROUND-DESCRIPTION OF PRIOR ART

One of the major disadvantages which plague prior fin designs is excessive drag. This causes painful muscle fatigue and cramps within the swimmer's feet, ankles, and legs. In the popular sports of snorkeling and SCUBA diving, this problem severely reduces stamina, potential swimming distances, and the ability to swim against strong currents. Leg cramps often occur suddenly and can become so painful that the swimmer is unable to kick, thereby rendering the swimmer immobile in the water. Even when leg cramps are not occurring, the energy used to combat high levels of drag accelerates air consumption and reduces overall dive time for SCUBA divers. In addition, higher levels of exertion have been shown to increase the risk of attaining decompression sickness for SCUBA divers. Excessive drag also increases the difficulty of kicking the swim fins in a fast manner to quickly accelerate away from a dangerous situation. Attempts to do so, place excessive levels of strain upon the ankles and legs, while only a small increase in speed is accomplished. This level of exertion is difficult to maintain for more than a short distance. For these reasons scuba divers use slow and long kicking stokes while using conventional scuba fins. This slow kicking motion combines with low levels of propulsion to create significantly slow forward progress.

Much of the drag created is due to the formation of turbulence around the blade portion of the fin. This turbulence occurs because prior fin designs do not adequately address the problem of flow separation and induced drag while lift attempting to generate lift. This destroys efficiency and severely reduces lift. On an airplane wing for instance, Bernoulli's principle explains that the air flowing over the convexly curved upper surface must travel over a greater distance than the air flowing underneath the lower surface of the wing. As a result, the air flowing over the upper surface must travel faster than the air flowing underneath the wing in order to make up for the increase in distance. Because of this, the air pressure along the upper surface of the wing decreases while the air pressure underneath the lower surface of the wing remains comparatively higher. This difference in pressure between the upper and lower surfaces of the wing causes "lift" to occur in the direction from the lower surface towards the upper surface. Because of this pressure difference, the lower surface on an airfoil is called the high pressure surface, while the upper surface is called the low pressure surface.

Another way of creating lift is to very the angle of attack. This is the relative angle that exists between the actual alignment of the oncoming flow and the lengthwise alignment of the foil (or chord line). When this angle is small, the foil is at a low angle of attack. When this angle is high, the foil is at a high angle of attack. As the angle of attack increases, the flow collides with the foil's high pressure surface (also called the attacking surface) at a greater angle. This increases fluid pressure against this surface. While this occurs, the fluid curves around the opposite surface, and therefore must flow over an increased distance. As a result, the fluid flows at an increased rate over this opposite surface in order to keep pace with the fluid flowing across the attacking surface. This lowers the fluid pressure over this opposite surface while the fluid pressure along the attacking surface is comparatively higher. Because of this pressure difference, the attacking surface is the high pressure surface and the opposite surface is called the low pressure surface or lee surface.

The increase in pressure along the high pressure surface combines with the decrease in pressure along the low pressure surface to create a lifting force upon the foil. This lifting force is substantially directed from the high pressure surface towards the low pressure surface. Varying the foil's angle of attack in this manner is important in swim fin designs because it enables lift to be generated on both the upstroke and the down stroke of the kicking cycle.

Although this method of generating lift is commonly used on prior swim fin designs, many problems occur that significantly reduce performance. One problem is that prior designs place the propulsion foil at excessively high angles of attack. In this situation, the flow begins to separate, or detach itself from the low pressure surface of the foil. When this occurs, the foil begins to stall. The separated flow forms an eddy which rotates around a substantially transverse axis above the low pressure surface. This eddy causes the fluid just above the low pressure surface to flow in a backward direction from the trailing edge towards the leading edge. This separation decreases lift since it reduces the amount of smooth flow occurring over the low pressure surface. This is a serious problem because smooth flow must exist in order for lift to be generated efficiently.

When the angle of attack becomes too high, the foil stalls completely and the flow along the low pressure surface separates into chaotic turbulence. This destroys lift by preventing a strong low pressure zone from forming over the low pressure surface, or lee surface. As a result, only a small difference in pressure exists between the opposing surfaces of the foil. Many prior fin designs suffer from this problem because they employ a horizontally aligned blade which is kicked vertically through the water. In this situation, the angle of attack is substantially close to 90 degrees, and therefore the blade is completely stalled out. This causes the blade to act more like an oar blade or paddle blade rather than a wing.

As well as destroying lift, stall conditions also cause high levels of drag. When areas of laminar flow (a flow condition where fluid passes over an object in a series of undisturbed layers) are abruptly converted into chaotic turbulent flow, a high drag condition known as transitional flow occurs. Because prior swim fin designs create stall conditions and chaotic turbulence along their low pressure surfaces, they generate high levels of drag from transitional flow.

Another problem that occurs at higher angles of attack is the formation of vortices along the outer side edges of the blade which cause induced drag. The difference in pressure existing between the attacking surface and the low pressure surface causes the fluid existing along the blade's attacking surface to flow outward toward the side edges of the blade, and then curl around the outer side edges toward the low pressure surface. As this happens, the swirling motion creates a streamwise tornado-like vortex along each side edge of the blade just above the blade's low pressure surface. As the water curls around the side edges of the blade, these vortices carry the water in an inward direction along the low pressure surface. After this happens, the vortices curl the water in a downward direction against the blade's low pressure surface. As this water is forced downward against the low pressure surface, it is moving in the opposite direction of desired lift thereby further reducing lift. This downward moving flow deflects the fluid leaving the trailing edge at an undesirable angle that is oppositely directed to the direction of desired lift. Because the direction of lift is perpendicular to the direction of flow, this downward deflected flow (called downwash) causes the direction of lift to tilt in a backward direction. Consequently, a significant component of this lifting force is pulling backward upon the blade in the opposite direction of blade's movement through the water. This backward force is called induced drag. Induced drag becomes greater as the blade's angle of attack is increased. Because prior designs typically use extremely high angles of attack, they experience high levels of induced drag.

In addition to increased drag, the downward deflected flow (downwash) behind the trailing edge significantly decreases the blade 's effective angle of attack which further reduces lift. As the flow behind the trailing edge is deflected downward (in the opposite direction of the lifting force) the angle of attack existing between the blade and this downward deflected flow (called the induced angle of attack) is less than the angle of attack existing between the blade and the oncoming flow (called the actual angle of attack). This reduces the blade's ability to create a significant difference in pressure between its opposing surfaces for a given angle of attack. This creates a significant decrease in lift on the blade.

The induced drag vortex also decreases performance by further decreasing the pressure difference between the opposing surfaces of the blade. As the water escapes sideways around the side edges of the blade, it expands in a spanwise direction along the blade's attacking surface. This decreases pressure along this surface, thereby decreasing lift. Also, because a substantial portion of the water flowing along the attacking surface is traveling in a more sideways direction and less of a lengthwise direction, this water is less able to assist in creating forward propulsion.

In addition, the high speed rotation of the vortex creates centrifugal force which evacuates fluid away from the center of each vortex (the vortex core). This creates a large decrease in pressure within the vortex core. The decreased pressure within this core is lower than the low pressure zone originally created along the low pressure surface by the foil's angle of attack. As a result, this new low pressure zone increases the rate at which water flows around the side edges away from the high pressure surface and toward the low pressure surface. This further decreases the pressure within the high pressure zone existing along the attacking surface. Because this reduces the overall pressure difference occurring across the blade, lift is significantly reduced.

As the vortex forces this outwardly escaping fluid down upon the blade's low pressure surface, fluid pressure is increased along this surface. This decreases lift by decreasing the difference in pressure occurring between the opposing surfaces of the blade. The swirling motion of each vortex also prevents water from flowing smoothly over a significant portion of the blade's low pressure surface. This decreases lift by preventing the blade from forming a strong low pressure center along a substantial portion of its low pressure surface. In addition, this disturbance within the flow over the low pressure surface (created by the induced drag vortex) can cause the blade to stall prematurely.

The problems associated with induced drag vortex formation increase as the blade's aspect ratio decreases. Aspect ratio can be described as the ratio of the blade's overall spanwise dimensions to its lengthwise dimensions. A blade that has an overall spanwise dimension that is relatively small in comparison to its overall lengthwise dimension, is considered to have a low aspect ratio. Low aspect ratio foils tend to produce stronger induced drag vortices, and are therefore highly inefficient.

Low aspect ratio blades are commonly found in prior swim fins which are used separately by each foot in a scissor-like kicking motion. The spanwise dimensions are limited in these designs in order to prevent the blade on one foot from colliding with the blade on the other foot during use. In this situation, the only way to increase the blade's surface area is to further increase the blade's lengthwise dimensions. This further reduces the blade's aspect ratio and increases induced drag.

Prior fin designs do not provide effective methods for reducing induced drag type vortices. Many designs use vertical ridge-like members which run substantially parallel to the lengthwise fin's center axis, and extend perpendicularly from at least one surface of the blade. The purpose is to encourage aftward flow, reduce spanwise flow, and stiffen the blade. However, these devices do not adequately reduce spanwise flow or induced drag type vortices. Moreover, these devices create additional drag of there own.

Another problem with prior fin designs is that they exhibit severe performance problems when they are used for swimming across the surface of the water. While kicking the fins at the water's surface, they break through the surface on the up stroke, and then on the down stroke they "catch" on the surface as they re-enter the water. Before the fin re-enters the water, it moves freely through the air and gains considerable speed. As the fin re-enters the water, a majority of the blade's attacking surface is oriented parallel to the water's surface. As a result, the blade slaps the surface of the water and its downward movement is abruptly stopped. This instantaneous deceleration creates high levels of strain for the user's ankles and lower leg muscles. Because downward movement ceases upon impact with the water, the strong downward momentum generated while the swim fin moves through the air (above the surface) is wasted and is not converted into forward propulsion after re-entering the water.

After this impact with the water's surface has occurred, the fin is slow to regain movement under water because of severe drag. This lag in time that occurs on the down stroke prevents the user from attaining fully productive kicking strokes. Before the downward moving fin is able to regain enough speed to begin effectively assisting with propulsion, it must be lifted out of the water again because the other fin (which is on its upstroke) has already broken the water's surface and is ready to begin its down stroke. Because it is difficult to kick both feet in an unsynchronized manner, this situation is awkward, strenuous, irritating, and highly inefficient. Over large distances, this problem can create substantial fatigue. This is particularly a problem for skin divers, body surfers, and body board surfers who spend most of their time kicking their fins along the water's surface. It is also a problem for SCUBA divers who swim along the surface to and from a dive site in an attempt to conserve their supply of compressed air. Fatigue and muscle strain to SCUBA divers during surface swims is particularly high because prior SCUBA type fins have significantly long lengthwise dimensions. This causes increased levels of torque to be applied to the diver's ankles and lower legs as the blade slaps the surface of the water. Because such longer fins create high levels of drag from a decreased aspect ratio, prior SCUBA type fins are significantly slow to re-gaining downward movement after catching on the water's surface. Even below the surface, such prior fins offer poor propulsion and high levels of drag which severely detract from overall diving pleasure.

Both U.S. Pat. Nos. 169,396 to Ahlstrom (1875), and 783,012 to Biedermann and Howald (1906) use two parallel propulsion blades which are mounted beneath the soul of the foot. The design is intended to be used with forward and backward kicking strokes along a horizontal plane. This stroke is awkward and extremely inefficient. Each of the parallel blades pivot along a lengthwise axis that extends parallel to the sole of the swimmers foot. The blades swing closed to a zero degree angle of attack on the forward stroke, and then swing open to about a 90 degree angle of attack on the backward, or propulsion stroke. This fin design attempts to gain propulsion from a pushing motion rather that a kicking motion. Both designs produce high levels of drag on the propulsion stroke and are not appropriate for use with contemporary vertical kicking strokes.

U.S. Pat. No. 2,950,487 to Woods (1954) uses a horizontal blade mounted on the upper surface of the foot which rotates around a transverse axis to achieve a reduced angle of attack on both the upstroke and the down stroke. The blade has a deep V-shaped cut down the center of the blade which divides the blade into a left half and a right half. These two sections are connected by a narrow strip of blade section running between them at the apex of the V-shaped cut out. Both left and right blade halves are fixed to each other within the same plane and no system is used to encourage any portion of these halves to flex, twist, or rotate in a way that can significantly reduce induced drag. The use of vertical ridges to encourage aftward flow does not significantly reduce outwardly directed spanwise flow and adds considerable drag.

U.S. Pat. No. 3,084,355 to Ciccotelli (1963) uses several narrow hydrofoils which rotate along a transverse axis and are mounted parallel to each other in a direction that is perpendicular to the direction of swimming. Although each hydrofoil has a substantially high aspect ratio, no system is used to adequately reduce induced drag.

U.S. Pat. No. 3,411,165 to Murdoch (1966) displays a fin which uses a narrow stiffening member that is located along each side of the blade, and a third stiffening member that is located along the central axis of the blade. Between the three members is a thin flexible web that is baggy so that when the blade is moved through the water, the web fills to form two belly shaped pockets along the length of the blade. These pockets increase in depth towards the trailing edge. Other ramifications include the use of a solitary pocket, as well as a plurality of such pockets.

A major problem with these designs is that the angle of attack is high and significant back pressure develops within each pocket. Although it is intended that the water is to be channeled towards the trailing edge, this does not efficiently occur. Because the water is striking the blade's webbing at a substantially high angle of attack (close to 90 degrees), the water resists making a sharp change in direction and is not efficiently accelerated toward the trailing edge. Consequently, the relatively large volume of water attempting to enter the pocket soon backs up and spills around the side edges of the pocket like an overfilled cup. This outwardly directed spanwise flow strengthens induced drag type vortices which further drain water from the pocket. Only a small amount of water is discharged aftward and propulsion is poor. No method is utilized to significantly decrease lee surface flow separation and induced drag.

French patent 1,501,208 to Barnoin (1967) employs two side by side blades which are oriented within a horizontal plane and extend from the toe of the foot compartment. The two blades are separated by a space between them. A vertically oriented blade is mounted to the front portion of the foot compartment and is located within the space existing between the two blades. This vertical blade is relatively thin and extends above and below the plane of the horizontal blades as well as a significant distance in front of the toe.

This vertical blade does not significantly contribute toward propulsion. It also adds drag and blocks water from flowing between the horizontal blades. Its extension below both the blades and the foot compartment make the fin difficult to walk on across land or stand up while in the water.

The most significant problem with this design is that the structure of each horizontally aligned blade prevents it from significantly twisting about an axis that is substantially parallel with its length. No structure is offered to encourage such twisting to occur in an efficient manner. In addition, no mention is given to suggest a need for such twisting. As a result, the blades stall through the water during use.

Although each blade is made of flexible material, its structure creates stresses within the blades' material which prevent the blades from achieving a substantially twisted shape along their lengths during kicking strokes. If any twisting forces are applied to the blades during use, significantly high levels of torsional stress forces occur in the form of tension and compression within the blades' material. These stress forces occur diagonally across the entire length of each blade. As a result, a large volume of each blade's material must succumb to these forces before any twisting can occur. A simple bending motion across each flexible blade places a much smaller volume of each blade's material under the influence of tension and compression forces than that would occur during a twisting motion. Consequently, the exertion of water pressure causes the blade to bend backwards around a substantially transverse axis under the exertion of water pressure created during use before it can begin to attain a twisted shape around a substantially lengthwise axis.

Although Barnoin's end view drawing shows that the blades taper in a sideways direction from the outer side edge toward the inner side edge, the blades remain highly resistant to twisting around a lengthwise axis. Barnoin does not state that the inner side edges of each blade should be more flexible than the outer side edge. However, even if it is assumed that the tapered inner side edge is more flexible, only a significantly small amount of flexing occurs because each blade tapers in a uniform manner from its outer side edge to its inner side edge. Such uniform tapering causes the resistive forces of tension and compression to be exerted over an increased volume of material within each blade. This is because the cross sectional thickness of the blade is significantly thick over most of its span. This substantially increases each blade's resistance to bending around a lengthwise axis. Also, as each blade bends back under water pressure around a transverse axis, each blade becomes arched across its length. This makes each blade even more resistant to bending around a lengthwise axis.

These torsional stress forces existing within each blade that inhibit twisting occupy a significantly large portion of each blade's material, and no adequate system or structure is used to control these stress forces in a manner that permits the blades to twist around a significantly lengthwise axis. In Barnoin's design, these stress forces are strongest on an area of each blade that exists behind (toward the foot pocket) an imaginary line which originates substantially from the root portion of each blade's inner side edge near the foot pocket and extends to a point on each blade's outer side edge that is about half way between the root and the trailing edge. The imaginary line actually originates at a position along the inner side edge that is approximately one third of the way between the foot pocket and the trailing edge. This is because the tapered spanwise cross sectional shape of each blade transfers anti-bending stress forces from the thicker outer side edge to the thinner inner side edge, thereby artificially stiffening the inner side edge of each blade. This imaginary line then extends approximately to the mid-way portion of each blade's outer side edge because the outer half of each blade is shown and described as tapering significantly along its length and becoming highly flexible about half way between the root and the trailing tip. Between this transversely directed imaginary line and the foot pocket, each blade is plagued with high levels of stress forces which prevent this area from twisting during kicks. This causes flow separation and stall conditions to occur along the low pressure surface of these blade portions.

The areas of each blade which are forward (toward the trailing edge and away form the foot pocket) of this imaginary line are much less effected by these stress forces. If each blade is made from a highly flexible material, then each blade bends around this transversely directed imaginary line. This causes the portions of each blade between this imaginary line and the trailing edge to deform to a reduced angle of attack by bending around a substantially transverse axis which is substantially parallel to the imaginary line. Because this axis is slightly swept back, the outer portions of each blade bend in a slightly anhedral manner. However, this anhedral angle is not sufficiently anhedral enough to create any significant reductions in lee surface flow separation, induced drag, or outward spanwise cross flow conditions. This is because the blades are bending around a highly transversely directed axis. In addition, when highly flexible materials are used in this design, the outer half of each blade collapses to a zero, or near zero angle of attack. This creates high levels of lost motion between strokes and does not permit significant levels of lift to be generated.

Another problem not anticipated by Barnoin is that if the two separate blades are permitted to deform in a slightly anhedral manner, a small amount of water can be deflected toward the space between the blades. This inwardly defected flow creates an equal and oppositely directed force against each blade which pushes outward on each blade in a spanwise direction. As a result, the portions of each blade existing between the imaginary line and the trailing edge spread apart a significantly large distance from each other and collapse to an excessively low angle of attack. Barnoin does not mention that he is aware of any such outward spanwise deformation of the blades and does not describe a method or structure that is capable of effectively controlling this undesirable occurrence.

As each blade pair spreads apart from each other on each of the users feet, the overall span of each swim fin increases substantially. This can cause the swim fin on one foot collide with the swim fin on the other foot as the swim fins pass each other during use in a scissor-like kicking stroke. In addition, much of the energy created by the kicking motion is wasted because it is used to spread the blades apart rather than propel the swimmer in a forward direction. Significantly high levels of lost motion also occur during the time that the blades are spreading apart at the beginning of each stroke, as well as when they are coming back together at the end of each stroke. This combines with the lost motion occurring as each blade bends backward around a transverse axis. The stress on each blade created by this spreading motion also causes each blade to collapse to an excessively low angle of attack that is incapable of producing significant levels of lift.

Because no structural solution to these problems are mentioned, the only way that this spreading motion can be controlled within the confines of Barnoin's design is to make the blades out of a more rigid material. This only further increases each blade's resistance to twisting or flexing around a lengthwise axis. Consequently, using a more rigid blade causes a larger portion of each blade's surface area to suffer from stall conditions, induced drag vortex formation, and inadequate lift generation just as making the blades out of a more flexible material causes a larger portion of each blade to bend backward around a transverse axis to an excessively low angle of attack which is incapable of generating significant levels of lift. Either way, serious problems result which destroy performance.

If Barnoin's design is made with sufficiently rigid enough blades to avoid excessive levels of lost motion and spanwise spreading, the spanwise tapering of the blades causes the anti-bending stress forces at the outer side edges of the blades to be transferred to the inner side edges of the blades. This stiffens the inner side edges of each blade and prevents them from deforming significantly under water pressure. As a result, a significant difference in rigidity does not exist between the outer side edges and inner side edges of the blades. This prevents the blades from bending around a significantly lengthwise axis.

If any flexing occurs during use on such rigid blades, it can occur only on an insignificantly small portion of each blade's inner side edge. Because the cross sectional shape of this design transfers anti-bending stress forces from the outer side edge to the inner side edge of each blade, the majority of each blade's spanwise alignment remains at excessively high angles of attack. This permits high levels of flow separation to occur as water spills around the outer side edges of each blade. This stalls the blades and produces high levels of drag from induced drag vortices and transitional flow. In addition, the transference of this stiffening effect to the inner side edge of each blade causes the inner side edge of each blade to also be at an excessively high angle of attack. This causes high levels of flow separation to occur at this location. As a result, significantly strong induced drag vortices form along the inner side edge and outer side edge of each blade's lee surface. This creates high levels of drag and inadequate levels of lift.

German patent 259,353 to Braunkohlen (1987) suffers from many of the same problems and structural inadequacies as Barnoin's fin discussed above. Braunkohlen uses a wedge like incision along the fin's center axis which leads from the trailing edge of the fin to a small circular recess near the toe area of the foot pocket. This incision divides the blade region into left and right blade halves. Each blade half decreases in thickness from its outer side edge to its inner side edge (the incision side of each blade half) to make the blade continuously weaker toward the incision. The tapering reaches a uniform thickness along the incision side of the blade.

Gradation markings in the drawing show that each blade also decreases in thickness and strength from the base of the blade (near the foot pocket) towards its trailing edge which is extreme end of each blade located in front of the foot pocket. These gradation markings show that a significantly large portion of each blade's trailing portion is as thin and structurally weak as the inner edge of each blade bordering the incision. This causes a significantly large portion of each blade's surface area to be highly vulnerable to excessive deformation around a transversely aligned axis. This type bending creates an arched contour around this a transverse axis which significantly increases each blade's resistance to twisting around a significantly lengthwise axis. No adequate structure is offered by Braunkohlen to compensate for this occurrence.

Because Braunkohlen's blades are highly vulnerable to bending around a transverse axis, a substantially large portion of each blade's surface area can bend to a zero or near zero angle of attack during use. At such low angles of attack, the blades are inefficient at generating significant levels of lift. High levels of lost motion occur as the blades "flop" loosely back and forth at the inversion point of each alternating stroke. As a result, much of the energy used to kick the blades through the water is used up deforming the blades to inefficient orientations rather than being converted into propulsion.

Because no adequate structure is shown to significantly reduce this problem, the only way to reduce lost motion is to make the blades out of a sufficiently rigid enough material to prevent excessive levels of bending around a transverse axis from occurring during strokes. By making the blades out of a stiffer material, high levels of stress forces are allowed to build up within each blade's material. Because the blades taper in a uniform manner from outer side edge to inner side edge, these stress are transferred to the weaker portions of the blade bordering the incision. This significantly stiffens the inner side edge of each blade and prevents a significant portion of each blade near the incision from flexing when water pressure is applied during strokes. This prevents each blade from bending or twisting about an axis that is substantially parallel to the lengthwise alignment of each blade. This stiffening effect causes a significantly large portion of each blade's outer side edges to remain at an excessively high angle of attack during use. This causes high levels of separation to occur as the water passes around each blade's outer side edge. In addition, the transference of this stiffening effect to the inner edge of each blade bordering the incision causes the inner side edge of each blade to also be at an excessively high angle of attack. This causes high levels of flow separation to occur at this location. As a result, significantly strong induced drag vortices form along the inner side edge and outer side edge of each blade's lee surface. This creates high levels of drag and inadequate levels of lift.

Also, Braunkohlen does not anticipate that any significant amount of deformation along the inner side edge of each blade half deflects water toward the incision and thus creates an outward spanwise force on each blade half. If the blades are flexible enough to permit significant deformation to occur near the incision, this outward force causes the blade halves to spread apart from each other during use. Braunkohlen does not mention a method for effectively countering this outward force and no adequate structural system is provided for controlling or reducing such spanwise spreading. As a result, this design is vulnerable to high levels of lost motion as the blade halves spread apart from each other at the beginning of each stroke and coming back together at the end of each stroke. Also, the energy expended in deforming the blades in a spanwise direction is wasted since it is not converted into propulsion.

Another problem with this design is that while the blades are spreading apart from each other, each blade buckles under stress and bends around a substantially transverse axis. This is largely because the trailing portions of each blade are much weaker and more flexible than the leading portions of each blade. This causes a significantly large portion of each blade to bend to an excessively low angle of attack which is inefficient at generating lift.

Because no structural features are used to efficiently overcome these problems and exert control over each blade's shape, any attempt to merely change each blade's flexibility cannot not significantly improve performance. While an increase in rigidity causes more of the fin's surface area to remain at an excessively high angle of attack, an increase in flexibility only increases the tendency for each blade to bend backward around a transverse axis and spread apart from each other in a spanwise direction. In either situation, flow separation is high and lift is low.

The circular recess at the base of the incision is shown to be relatively small and only slightly larger than the narrow incision. Braunkohlen states that it's purpose is to prevent the base of the incision from tearing during use. Also, the span of the circular recess is proportionally too small for it to have any other benefit to performance. The elevated section behind the recess is also used only to reinforce the base of the incision so that the fin is less likely to tear along the center axis.

French patent 1,501,208 to Barnoin (1967) also displays a differently configured alternate embodiment which uses four blades attached to one foot compartment. An end view drawing from the tips of the blades illustrates that the four blades are arranged in a cross sectional configuration that is substantially X-shaped. This orientation places the four blades within two diagonal planes which cross each other at the fin's center axis. The blades are spaced apart from each other to form a gap at the middle of the X-configuration. The drawing reveals that each blade tapers in thickness towards this gap to form a sharp inner side edge and a thicker outer side edge.

The X-configuration of the blades is highly inefficient and causes excessive drag while kicking because the trailing blades on each stroke prevent the leading blades from efficiently generating lift. When the fin is kicked upward, the upper pair of blades are the leading blades and the lower pair of blades are the trailing blades. When the fin is kicked down, the opposite occurs. Although in both situations the leading blades are angled in anhedral manner to offer a reduced angle of attack, the trailing blades are always angled in a dihedral manner that prevents the leading blades from generating lift. Because the trailing blades are positioned at an extremely high angle of attack relative to the water curving around the outboard edges of the leading blades, the path of water traveling along the low pressure surfaces of the leading blades becomes blocked by the orientation of the trailing blades. This prevents the water curving around the lee surface of the leading blades from efficiently joining the water that is leaving the attacking side of the leading blades at the inner side edge of the leading blades. This prevents the formation of a significantly strong a low pressure zone along the lee pressure surface of the leading blades, and therefore prevents significant levels of lift from being generated.

The high angle of attack of the trailing blades also increases induced drag vortex formation around the outer side edges of the leading blades by creating a pocket on each side of the fin between the leading and trailing blades. The induced drag vortex becomes trapped, protected, and amplified within this pocket. The separation created by this vortex completely stalls each leading blade. This creates high levels of drag and destroys lift. In addition, the swirling eddy-like motion of this trapped induced drag vortex causes the water flowing along the lee surface of the attacking blades to flow backward from the inner side edge toward the outer side edge. This backward directed flow created by this eddy-like swirling motion is highly undesirable since it occurs in the opposite direction of what is needed to generate lift on the leading blades.

This undesirable eddy also reverses the direction of expected flow along the attacking surface of the trailing blades so that water along these surfaces flow from the outer side edge toward the inner side edge on each blade. This prevents lift from being generated by the trailing blades as well.

Other problems of this design occur as the flexible blades deform in an uneven manner during kicking strokes. When water pressure is exerted against the leading pair of blades, the flexibility of these blades enable them to bend backward around a transverse axis and press against the trailing blades. Because the trailing pair of blades are not exposed to the oncoming flow, they remain relatively straight while the leading blades push against them. As the inner side edges of the leading blades contact the inner side edges of the trailing blades, the path of water traveling along the low pressure surfaces of the leading blades becomes completely blocked so that it cannot merge with the water leaving the attacking side of the leading blades at the inner side edge of the leading blades. This prevents a low pressure zone from forming along the low pressure surface of the leading blades, and therefore prevents lift from being generated.

Although the leading pair of blades are anhedrally oriented in a manner that can encourage water to flow toward the void existing between the two leading blades, no method or structure is discussed for countering the spanwise directed outward forces exerted upon each blade by such inward flowing water. Because the blades are flexible and vulnerable to this outward force, they spread apart from each other in a transverse direction. This wastes energy, creates lost motion, and produces awkward blade orientations that inhibit performance.

In addition to offering poor levels of performance, this arrangement of four blades increases production costs through increased materials, parts, and steps of assembly. Also, both the added weight and bulk increase the cost of packaging, shipping, and storage. Such added weight and bulk inconveniences the user as well.

U.S. Pat. No. 3,934,290 to Le Vasseur (1976) uses a single fin which receives both feet of the user for use in dolphin style kicking strokes. Because no system is used to reduce outwardly directed spanwise flow along the attacking surface of the blade near the tips, this design is subject to high levels of induced drag.

Le Vasseur uses a series of vents which are aligned in a spanwise direction. The passage ways of these vents extend from above the toe of the foot pockets diagonally through the blade to a line near the trailing edge on the underside of the blade. This orientation only permits the vents to be used on the down stroke. These vents do not significantly reduce the creation of induced drag.

U.S. Pat. No. 4,007,506 to Rasmussen (1977) uses a series of rib-like stiffeners arranged in a lengthwise manner along the blade of a swim fin. The ribs are intended to cause the blade to deform around a transverse axis so that the trailing portions of the blade curl in the direction of the kicking stroke. The blade employs no method for adequately decreasing induced drag. The blade's high angle of attack stalls the blade and prevents smooth flow from occurring along its low pressure surface.

The ribs are not intended to encourage the blade to twist or bend in a manner that decreases separation along the low pressure surface of the blade. Instead, the ribs prevent the blade from bending to a lower angle of attack. Rasmussen's uses ribs in an attempt to increase the angle of attack existing at the outer portions of the blade.

U.S. Pat. No. 4,025,977 to Cronin (1977) shows a fin in which the blade is aligned with the swimmers lower leg. This design is highly inefficient on the upstroke. No system is used to reduce the presence of induced drag.

U.S. Pat. No. 4,521,220 to Schoofs (1985) uses a fin designed for use by breast stroke swimmers. It employs a horizontal blade with a transversely directed asymmetric hydrofoil shape. The design is stated to be stiff enough to hold its shape during swimming. This prevents the fin from being effective when used in a conventional up and down scissor-like kicking stroke. This is because the hydrofoil shape is perpendicular to the direction of such strokes. This causes the blade to stall. Even during breaststroke kicking styles, no system is employed to significantly reduce induced drag.

U.S. Pat. No. 4,541,810 to Wenzel (1985) employs a single fin designed to be used by both feet in a dolphin style kicking motion. The design uses a stiff, load bearing Y-shaped frame member, and a highly resilient webbing secured between the forks of the frame The web is intended to cup the flowing water by arching its surface as the forks flex inward in response to the water pressure placed on the web during strokes.

This method of creating a cup to channel water toward the center of the fin and out the trailing edge is highly inefficient since it quickly builds up excessive back pressure within the webbing's pocket. This back pressure reverts flow back over the outboard side edges of the fin like an over filled cup. This increases the formation of induced drag vortices along the low pressure surface along these side edges. These vortices create drag, decrease lift and quickly drain the high pressure center occurring in the arched pocket. Because a significantly large portion of the water flowing along the attacking surface spills sideways around the outer side edges of the hydrofoil, forward propulsion is poor and drag is high.

Another problem is that as the webbing bows under water pressure, it forms a parabolic shape in which the outer side edges of the webbing experiences the least amount of curvature and the center regions of the webbing experience the greatest amount of curvature. This type of parabolic shape occurs whenever an evenly distributed load is applied to a material that is suspended across a surrounding frame. This parabolic shape cause the outer edges of the webbing near the frame member to remain at an excessively high angle of attack relative to the oncoming water. The high angles of attack exhibited by the leading and side edges of the blade also create separation and stall conditions along the low pressure surface of the blade which further reduce lift and increase drag.

Although some of Wensel's embodiments show a deep V-shaped cut-out section along the trailing edge, no system is used to control the shape of these trailing portions as they deform. The cut-out along the trailing edge consists of two concavely curved outer portions existing near the tips, as well as two convexly curved inner portions which meet at the center of the webbing to form a small and narrow V-cut which ends in a sharp point. An imaginary straight line extending from a tangent of each concave outer portion to the sharp point of the V-cut at the center of the trailing edge, is the rearward limit (toward the trailing edge) of the spanwise tension forces which occur across the resilient webbing. The region of the webbing existing between this imaginary line and the forked frame are highly resistant to twisting around a lengthwise axis. This is because this region is plagued with anti-twisting stress forces of compression and expansion. On the other hand, the portions of the webbing which exist between this imaginary line and the trailing edge are structurally weaker than the rest of the webbing because this area is significantly less affected by the tension forces occurring across the resilient webbing which are created while bowing under water pressure. As a result, the convex portions of the trailing edge region tend to fold substantially along this imaginary line to a significantly lower angle of attack than the rest of the webbing during use. This creates an abrupt change in the webbing's contour and causes significant drag and loss of lift. Wenzel uses no system to support this zone. Because his webbing is highly resilient and easily deformable, it is especially vulnerable to this problem. The use of a more rigid material for the webbing only further inhibits the webbing's ability to bow under water pressure.

Another problem with his design is that the forked ends of the stiff load bearing frame member will not adequately flex inward enough to create significant results. If the forked portions of the frame member are made strong enough to substantially maintain its lengthwise alignment during strokes and not bend excessively backward around a transverse axis under the exertion of water pressure, it will not be flexible enough to permit significant flexing to occur in an inward spanwise direction. This is primarily because the spanwise tension across the webbing, which is responsible for causing the forked ends of the frame to flex inward, is significantly less than the force created by drag which pushes backward against the forks in a direction that is opposite to the direction in which the fin is kicked through the water. This problem is further increased because the forks have a spanwise hydrofoil shape that causes each fork act like a sideways I-beam which is significantly more resistant to horizontal flexing (spanwise flexing) than to vertical flexing (backward bending around a transverse axis). If the forks are flexible enough to bend sufficiently inward to form a pocket in the webbing, they will not be rigid enough to avoid excessive backward bending (opposite to the fin's direction of stroke) around a transverse axis to an excessively low angle of attack during use.

The structure of the forks also prevents them from experiencing significant levels of twisting during use. When twisting forces are applied to the forks, high levels of torsional stress forces build up within the fork's material. In order for twisting to occur, the material must succumb to these stress forces and undergo significantly large amounts of expansion and compression across a majority of its length and volume. Since a significantly large portion of the fork's material is forced to experience relatively high levels of compression and expansion, resistance to such twisting is significantly high. In comparison, a simple bending motion around a transverse axis permits significantly reduced levels of compression and expansion to occur over a significantly smaller portion of the fork's material. As a result, solid objects many times less resistance to bending along the length than to twisting about their length. Because of this, the forks will not adequately twist during use in an amount sufficient to significantly reduce stall conditions and flow separation along the edges of the hydrofoil. This causes the hydrofoil shaped forks to remain at an excessively high angle of attack during use, thus creating further drag and loss of lift.

If the forks are made from a sufficiently resilient material to permit a significant amount of twisting to occur, it will bend backward and collapse around a transverse axis because the comparative resistance to such deformation is many times lower than that created during a twisting motion. In addition, the forces which attempt to twist the forks along their length (created from tension across the webbing), are significantly weaker than the forces created by drag on the hydrofoil which attempt to bend the forks backward in the opposite direction of the blade's motion through the water.

If the forks are rigid enough to withstand the force of drag on the fin without excessive deformation, than they are not flexible enough to twist significantly along their length. Because of this, the spanwise hydrofoil shape of each fork remains at a high angle of attack during use. This creates high levels of flow separation along the lee surface of the fork during use. This increases induced drag vortex formation, stall conditions, and transitional flow. Because the leading edge portions of the fork also remain at an excessively high angle of attack, the leading edge of the hydrofoil stalls as well. As a result, drag is high and lift is poor.

U.S. Pat. No. 4,738,645 to Garofalo (1988) employs a single blade which deforms under water pressure to form a concave channel for directing water toward the trailing edge. The blade uses two narrow and lengthwise directed strips of flexible membrane located near the stiffening rails on each side edge of the blade. Between the two narrow strips of flexible membrane is a stiff and centrally located blade portion which is attached to the inner side edges of the two membrane strips. When the fin is kicked, water pressure pushes against the stiff central blade portion which applies tension to the flexible strips. As this occurs, a loose fold within each flexible strip elongates, thereby enabling the central blade portion to drop so that fin forms a scoop like channel.

Although this shape is intended to reduce flow around the sides of the blade and increase aftward flow, it does not do so efficiently and suffers from high levels of drag. Because the blade's central portion is at a significantly high angle of attack, the water's inertia resists a quick change in flow direction as it strikes the blade's central portion. This creates a significant amount of back pressure within the channel. Because this design lacks a method for reducing such back pressure, the water backs up within the channel and spills sideways around the side edges of the blade like an overflowing cup. As this happens, the flow separates from the blade's low pressure surface. This increases induced drag and destroys lift. The vertical ridges along the side edges of the blade do not efficiently reduce this problem and only add extra drag of their own.

Another problem is that the portion of the blade that lies between the side rails and the flexible strip is relatively wide and has significant torsional stress forces within it which prevent it from twisting significantly along its length during strokes. As a result, this portion always remains at a high angle of attack which increases the strength of induced drag vortices. Both the central and side portions of the blade remain at a high angle of attack which stalls the fin. This depletes lift and further increases drag.

U.S. Pat. No. 4,781,637 to Caires (1988) shows a single fin designed to be used by both feet in a dolphin style kicking motion. It uses a transversely aligned hydrofoil that extends from both sides of a centrally located foot pocket. The hydrofoil is made of a flexible material which has a stiffening rod located within it that runs parallel with the hydrofoil's leading edge. The flexible material is loosely disposed around the stiffening rod to permit rotation. A plate-like member is located within the central portion of the hydrofoil to prevent the blade from rotating around the stiffening rod at this location.

Although the tips are intended to twist about the rod to a reduced angle of attack while the center region remains at a high angle of attack, the centrally located plate-like member introduces stress forces within the hydrofoil's flexible material that strongly oppose such twisting. When water pressure applies a twisting force against the hydrofoil, torsional stresses of compression and tension build up within the flexible material in directions that are diagonal to the axis of rotation. While compression forces exist along one diagonal direction, tension forces exist along another direction that is substantially perpendicular to the direction of compression. This creates a complex network of stress forces within the flexible material between the plate-like member and the outer tips of the stiffening rod. Resistance to twisting is high because these forces are exerted across significant distances, and therefore large volumes of the flexible material must experience significant amounts of expansion and compression before twisting can occur. Because no adequate method is used to reduce these stress forces within the blade's material, the blade demonstrates high levels of resistance to any twisting forces created by water pressure.

This is a major problem since the twisting force created by water pressure during strokes is significantly small. If the hydrofoil cannot twist quickly and substantially under conditions of significantly light pressure, the blade remains at an excessively high angle of attack which causes flow separation to occur along the lee surface thereby stalling the hydrofoil. When the flow quickly separates from the low pressure surface in this manner, the twisting force created by the water pressure drops off dramatically. Because the resistance to twisting is at a high, and the twisting force provided by water pressure is significantly low, the blade remains at a high angle of attack. This destroys lift and creates high levels of drag. Caires does not mention that he recognizes these problems created by torsional stress forces and offers no solution for controlling them.

Another problem with this design is that a much of the hydrofoil's flexible material is poorly supported by the stiffening system. This makes the foil vulnerable to bending forces which can adversely deform the foil's shape during use. The areas that are most vulnerable to such bending forces are located aft (towards the trailing edge) of an imaginary line which extends from each outboard tip of the stiffening rod, to the trailing portion of the centrally located stiffening plate. The areas between this imaginary line and the trailing edge bend abruptly to a reduced angle of attack. This bending occurs along an axis that is substantially parallel to this imaginary line.

This abrupt change in contour creates an undesirable cross sectional hydrofoil shape that causes the low pressure surface to become concavely curved, and causes the attacking surface to become convexly curved. According to Bernoulli's principle, this shape reduces lift because it decreases the distance that the water must travel along the low pressure surface, while it simultaneously increases the distance that the water must travel along the high pressure surface (attacking surface). This reduces the overall difference in pressure existing between the low pressure surface and the attacking surface. In addition, the concavely curved low pressure surface formed during strokes also encourages the flow to separate from this surface. This further decreases lift and increases drag. While the trailing portions of the foil bend in this manner during use, the leading portions of the foil existing between the imaginary line and the leading edge remain at a high angle of attack because of the anti-twisting stress forces which exist in this region. This is highly inefficient because it stalls the leading portion of the blade.

Because of the structural inadequacies of this design, any attempts to merely change the resiliency of the blade can not significantly improve performance. If highly flexible materials are used to make the hydrofoil blade, the portions of the blade existing aft of the imaginary line collapse completely to a zero, or near zero angle of attack. This dramatically reduces leverage on the hydrofoil, and therefore reduces the twisting force created by the water pressure. Thus, even with highly flexible materials, the entire leading edge remains in a stall position during strokes. This destroys lift and creates drag.

Although the use of stiffer materials can reduce the abruptness and degree of this bending tendency, it also causes a larger portion of the blade to remain at an excessively high angle of attack. This is because less flexible materials permit the stiffening effect of the anti-twisting stress forces (present in the leading portions of the foil) to extend farther out towards the trailing edge. A major dilemma thus results: if the flexible material within the hydrofoil is resilient enough to twist under extremely light pressure its trailing portions collapse to an excessively low angle of attack during use; however, if the flexible material is sturdy enough to prevent the inadequately supported trailing portions from bending excessively, the material is no longer resilient enough to twist sufficiently under significantly light pressure. As a result, this design is highly inefficient.

Another problem displayed by the drawings is that the stiffening system within the leading edge of the hydrofoil does not extend far enough toward the outer tips of the hydrofoil. This permits the highly resilient material at the tips to flex in an uncontrolled and undesirable manner when the fin is kicked through the water. Significantly large areas of improperly supported resilient material are able to bend to an orientation that produces significant turbulence and drag. This is especially a problem at the outer side edges because the outboard flow conditions produced by induced drag vortices force the unsupported tips to bend dihedrally, along a chordwise axis. This encourages outwardly directed flow and therefore increases the strength of induced drag vortices. No method is employed to adequately reduce the formation of induced drag vortices.

The same problem is seen in the design which places the blades in a slightly swept back configuration. Lack of adequate support along the outer edges of the tips, permit the flexible material, which extends aft of the ends of the stiffening rod, to bend along a transverse axis. At the same time, dihedral bending occurs at the outboard ends of the flexible material because the span of the stiffening rod is significantly smaller than the span of the hydrofoil.

In the swept back version of his design, the blade-halves are not swept back enough to encourage a significant inward directed flow from occurring along the attacking surface of each blade-half. Although the extreme outer edges of the blade are significantly swept, these highly swept portions of the blade are not properly supported and therefore encourage outward spanwise directed flow to occur along the attacking surface near the tips of each blade-half.

Another problem with this design is that the significantly high aspect ratios that Caires uses causes the spanwise dimensions to be significantly wide. This greatly reduces the ability of the swimmer to use this design in confined areas such as narrow passageways, arches, ravines, caves, kelp forests, and ship wrecks. Such wide spanwise dimensions also prevent this design from being used on separate fins for each foot for use in a scissor-like kicking stroke since the fin on one foot can collide with the fin on the other foot during use.

An alternate embodiment shows a cross sectional view of a hydrofoil having a chordwise linkage member suspended within a hollow hydrofoil made from a resilient plastic skin. The leading portion of this member is pivotally linked to a transverse stiffening member located within the leading edge of the hydrofoil. The trailing portion of the linkage member extends rearward and attaches to the inside of the trailing edge of the hollow hydrofoil. The only connection between the linkage member and the hollow skin is at the trailing edge. All other portions of the skin are free from the linkage member.

The sole purpose of this linkage member is to create a variance in skin tension between the upper and lower surfaces of the hollow hydrofoil so that an asymmetrical shape is created during use. The chordwise linkage members are not used, or intended to be used in a manner that can relieve or control anti-twisting stress forces that are created within the blade's material during use. This prevents the hydrofoil from achieving a smooth and efficient contour when twisting forces are applied to the blade.

Because of the structure of this design, the loosely disposed skin tends to buckle and wrinkle when anti-twisting stress forces of compression and tension build up within it during use. Because these stress forces are created diagonally across the span of the skin, diagonally directed wrinkles form across the upper and lower slices of the hydrofoil. These wrinkles can be observed forming when one end of a hollow object such as a water bottle (semi-filled with either water or air) is twisted while the opposite end is held stationary. Because the skin on the upper and lower surfaces is loosely disposed above and below each linkage member within the hydrofoil, this buckling tendency cannot be controlled by the linkage members. The greater the degree of spanwise twisting, the greater the degree of buckling and wrinkling within the skin. The resulting wrinkles create turbulence and separation. This destroys lift and creates high levels of drag. Also, because two separate skins are used (upper surface and lower surface) twice as much resistance to twisting (from tension forces) results than if only a single membrane is used.

U.S. Pat. No. 4,857,024 to Evans (1989) shows a fin which has a flexible blade with a V-shaped cut along the trailing edge. The blade does not form an anhedrally oriented channel along the attacking surface of the blade during strokes. The V-shaped cut along the trailing edge only extends a relatively small distance in from the trailing tips and does not cover a significant length of the blade. Because of this, the V-shaped cut is not in a position for significantly preventing excessive back pressure within the fluid existing along the center regions of the blade.

The blade is thickest and most rigid along its center axis. The blade decreases in thickness on either side of this center axis toward its side edges for increased flexibility near these edges. The center axis of the blade lies in the same horizontal plane as the foot pocket, while the portions on either side of the center axis angle upward toward the outer side edges. These angled portions form a convex up V-shaped valley. When this upper surface is kicked forward the outer portions start out in an anhedral orientation relative to the direction of movement. However, as soon as water pressure is applied against these upwardly angled outer portions, these portions flex back into alignment with the horizontal plane of the center axis, and then continue to flex beyond this point to assume a dihedral orientation during this upwardly directed kicking stroke. At this point, the stiffer central portion of the blade arches back around a transverse axis to an excessively reduced angle of attack where the blade then slashes back at the end of the stroke in a snapping motion to propel the swimmer forward.

This snapping motion acts more like a paddle than a wing, rather than creating lift like a wing, this design snaps backward at such a high angle of attack that no smooth flow can occur along the lee surface of the blade. Consequently, this snapping motion attempts to push the swimmer forward by applying the stored energy within the backward bent blade against the drag that the blade creates within the water. This design creates significantly high levels of drag during use and causes significant levels of ankle fatigue. Also, the excessive backward deformation of the blade creates significant levels of lost motion during strokes.

On the opposite stroke where the lower surface of blade is the attacking surface, the angled outer ends are oriented at a dihedral angle relative to the direction of travel. The water pressure created during this stroke only increases this dihedral angle. This orientation directs water away from the center of the blade and toward the outer side edges. This increases induced drag and decreases lift. No system is used to create smooth flow conditions along the low pressure surface of the blade.

This design is especially difficult to use while swimming along the surface. Since the swimmer is usually face down in the water, the anhedrally oriented upper surface is also face down in the water. Because no system is used to reduce back pressure along the attacking surface of the blade, the anhedral blade acts like a parachute when re-entering the water. This brings the fin to an immediate stop as the blade strikes the surface. This transfers significant levels of strain to the user's ankles and lower legs. The energy initially built up on the doffs stroke is wasted and new energy must be applied in order to regain movement.

U.S. Pat. No. 4,934,971 to Picken (1990) shows a fin which uses a blade that pivots around a transverse axis in order to achieve a decreased angle of attack on each stroke. Because the distance between the pivoting axis and the trailing edge is significantly large, the trailing edge sweeps up and down over a considerable distance between strokes until it switches over to its new position. During this movement, lost motion occurs since little of the swimmer's kicking motion is permitted to assist with propulsion. The greater the reduction in the angle of attack occurring on each stroke, the greater this problem becomes. If the blade is allowed to pivot to a low enough angle of attack to prevent the blade from stalling, high levels of last motion render the blade highly inefficient.

Picken uses an elliptical shaped blade design in an effort to decrease induced drag. Because of its low aspect ratio and the significantly high angles of attack used during strokes, this design does not effectively reduce induced drag. In addition, no adequate method is offered for effectively discouraging outward flow along the side edges of the blade.

U.S. Pat. No. 4,940,437 to Piatt (1990) uses a swim fin blade that has a stiffening rod within the blade which runs along its center axis. This stiffening rod is not used in a manner that effectively reduces induced drag. No twisting motion is encouraged within the blade along a lengthwise axis.

Many of the same problems that exist with prior swim fin designs also exist in prior flexible propulsion blade designs that oscillate back and forth to generate propulsion. All such designs lack an efficient method for reducing induced drag and stall conditions. Designs that are intended to flex do not include an effective method for controlling or reducing undesirable stress forces within the blade that cause the blade to deform in an undesirable manner.

U.S. Pat. No. 144,538 to Harsen (1873) uses a series of pendulous arms driven by a rotating worm shaft to produce a wriggling or worm-like action. The system is dependent on a rotating worm shaft to provide shape. No system is used to reduce induced drag vortex formation along the submerged bottom edge of the blade system.

A book reference found in the United States Patent and Trademark Office in class 115/subclass 28 labeled "3302 of 1880" shows a horizontally aligned reciprocating propulsion blade. The planar blade has a narrow void existing along the center axis of the blade which divides the blade into two side-by-side blade halves. This void originates at the trailing edge of the blade and ends near the base of the blade. No system is used to encourage the blades to twist along a substantially lengthwise axis, and no system is used to encourage water to flow away from the outer side edges of each blade half. The blades only flex backward around a transverse axis in response to water pressure. Consequently, the blade stalls through the water and produces high levels of drag and poor propulsion.

Spanish patent 17,033 to Gibert (1890) shows a vertically aligned flexible oscillating propeller blade that has a triangular shaped void along its center axis that divides the blade into two blade-halves. The void is widest at the trailing edge and converges to a point at the base of the blade. No system is used to encourage the blade to twist or bend around a lengthwise axis. The blade-halves stall through the water and produce high levels of drag and poor levels of lift.

U.S. Pat. No. 787,291 to Michiels shows a vertically aligned oscillating propulsion system which has two blades with a space existing between them. Both blades lie within the same vertical plane. No system is used to permit the blades to twist along a lengthwise (chordwise) axis, and no system is used to reduce stalling or induced drag.

U.S. Pat. No. 871,059 to Douse (1907) shows a vertically aligned oscillating propeller which has a caudal shaped frame with a flexible membrane stretched between it. No adequate system is offered for reducing back pressure within the flexible membrane. As a result, outward spanwise cross flow conditions are created which decrease propulsion and increase induced drag. No system is used to reduce the membrane's tendency to form a parabolic pocket when water pressure is applied. This parabolic shape causes the leading and side edges of the membrane to remain at a high angle of attack while the center region of the pocket becomes bowed. Consequently, the blade stalls and produces high levels of induced drag. In addition, the wide structure of the rigid frame member causes additional flow separation and drag.

U.S. Pat. No. 1,324,722 to Bergin shows a flexible oscillating propeller that has a narrow void along its center axis that divides the blade into two blade-halves. The void originates at the trailing edge and ends at a point near the base of the blade. The blade is made of a resilient material and is reinforced with a series of chordwise stiffening members which are joined to a transversely aligned stiffener a significant distance from the base of the blade. Because a significantly large portion of flexible blade material is unsupported along the outer side edges of the blade, these side portions deform in a dihedral manner under the exertion of water pressure. This increases outward spanwise flow conditions along the attacking surface of the blade. The stiffening members are not arranged in a manner that encourage the blade to deform in a manner that reduces such stall conditions and induced drag.

British patent 234,305 to Bovey (1924) uses propeller blades that have a fixed leading portion and a hinged trailing portion that swings freely along a substantially transverse axis. Because the trailing portion swings freely its inclination is uncontrollable. This allows this portion of the blade to bend backward under water pressure to an excessively low angle of attack. Consequently, sharp changes in contour can destroy efficiency and create drag. No system is used to effectively reduce induced drag.

U.S. Pat. No. 2,241,305 to Hill (1941) shows a vertically aligned propelling blade that uses a rigid frame which is shaped like the lower half of a caudal fin. A resilient membrane is stretched between the frame members. No system is used to reduce the membrane's tendency to bow in a parabolic manner. Consequently, the edges of the membrane bordering the frame members remain at an excessively high angle of attack during use. This causes the blade to stall and produce high levels of induced drag.

U.S. Pat. No. 3,086,492 to Holley shows a vertically aligned oscillating propulsion blade that is made of a flexible material. The blade's center axis has a V-shaped recess which divides the trailing portion of the blade into upper and lower halves. Paired stiffening ribs extend from both sides of the vertical blade in three locations. These blade pairs do not extend fully from the trailing edge to the base of the blade. Instead, a significantly large area of the blade's flexible material exists between the leading ends of the ribs and the base of the blade. This lack of support renders the blade vulnerable to collapse around a spanwise axis.

The positioning of the rib pairs are also poorly organized. Although two of the rib pairs run parallel to the outer side edges of the blade, a significant distance exists between these rib pairs and the outer side edges of the blade. Consequently, a substantially large portion of the blade's side edges are unsupported. This causes these edges to deform in a dihedral manner during use. This increases stall conditions as well as induced drag. The rib pair existing along the blade's center axis only adds extra leverage to the bending forces which allow the blade to bend around a spanwise axis. This spanwise axis exists substantially along an imaginary line connecting the leading ends of each rib pair. The ribs are not arranged in a manner that encourages the blade to bend or twist around a substantially lengthwise axis. As a result, the blade stalls through the water and delivers poor performance.

U.S. Pat. No. 3,453,981 to Gause (1969) uses a series of horizontally aligned propulsion blades that are intended to convert wave energy into forward motion on a boat. Each blade has a space along its center axis that divides it into a left and right blade half. The most significant problem with this blade design is that it has no system for controlling the undesirable stress forces created within the blade's flexible material during use. As a result, these stress forces prevent the blade from deforming in a desirable manner, and performance is poor.

Each blade has a rigid leading edge portion that is rounded and tapers gradually to a relatively resilient trailing portion. Although a dotted line in the diagram at first appears to represent a junction between these two areas of the blade, the description states that these two portions "merge smoothly into one another without any abrupt change in characteristic." Such a smooth transition and gradual tapering transfers anti-flexing stress forces aft on the blade (toward the trailing edge). Thus, the rigidity of the leading edge portion is extended a significant distance toward the more resilient portions of the blade. This prevents the more resilient blade portions from flexing significantly near the leading and side edges of the blade. Consequently, these leading and side edges remain at an excessively high angle of attack during use which causes the blade to stall. Strong induced drag vortices are permitted to form along the outer side edges and performance is poor.

Another problem with the structure of this design is that stress forces of compression and tension are permitted to build-up within the blade's material during use. This prevents each blade half from adequately twisting along its length. These stress forces are strongest forward (toward the leading edge) of an imaginary line on each blade half that extends from the outer side edge of the extreme tip of the blade half to the most forward point of the trailing edge existing at the blade's center axis. The strength of the anti-twisting stress forces prevent this portion of the blade from twisting along its length. This is because these stress forces are significantly strong in comparison to the water pressure applied during use. As a result, the leading portions of the blade to remain at an excessively high angle of attack which stalls the blade and increases induced drag.

The portion of each blade half that exists between this imaginary line and the trailing edge are less affected by these stress forces. Consequently, this portion of each blade half bends around an axis that is substantially parallel to this imaginary line. However, because the blade tapers gradually from the rigid leading portion to the more flexible trailing portion, the stress forces existing forward of this imaginary line are extended aft of the imaginary line. As a result, the blade deforms around an axis that is significantly aft (toward the trailing edge) of this imaginary line. Thus, only a small portion of the blade bends under water pressure. If the blade's trailing portions are made from a significantly flexible material, the portions aft of the imaginary line collapse sharply under water pressure. In any case, the areas forward of this line remain in a stall condition which severely reduces lift.

Another problem occurs when the portions aft of the imaginary line bend back-ward from water pressure during use. As this happens, the swept alignment of each blade half causes some of the water traveling aft of this imaginary line along the attacking surface to be deflected toward the blade's center axis. This inward deflection of water creates an outward spanwise force against each blade half. This causes the blade halves to spread apart from one another in a spanwise direction during each stroke. This destroys efficiency by creating high levels of lost motion and lost energy.

Gause does not anticipate this problem of spanwise spreading and offers no solution for avoiding it. Although he states that the leading portions of the foil are to be significantly rigid, he does not mention that it should be rigid enough to prevent this problem. If his design is made rigid enough to avoid this problem, the gradual tapering in the blade's cross section extends this rigidity significantly toward the blade's trailing portions. This causes the entire blade to be much too rigid to flex in a significant manner. Because no method is employed to control these problems, this design is highly inefficient.

U.S. Pat. No. 3,773,011 to Gronier (1973) shows a horizontally aligned propulsion blade having a forked frame and a flexible membrane stretched between the forks. The most significant problem with this design is that no system is used to reduce the occurrence of back pressure within the membrane's attacking surface. As a result, back pressure causes the water along the attacking surface to spill in an outward spanwise direction around the side edges of the hydrofoil. This increases induced drag and severely inhibits propulsion.

Also, no method is used to control the membrane's natural tendency to attain a parabolic shape as it bows out under water pressure. As a result, the greatest degree of bowing occurs near the center of the membrane near the trailing edge, while the leading and side portions of the membrane located near the forks experience only a minimal defection from the horizontal plane. This causes the water flowing around the leading and side edges of the hydrofoil to separate from the low pressure surface of the membrane. This stalls the blade, creates drag, and destroys lift.

Although Gronier shows a spanwise cross sectional drawing that depicts his membrane as being capable bowing in a substantially elliptical manner, this is not what actually occurs. It is well known that when an evenly distributed load is placed on a flexible material that is suspended across a frame, a parabolic shape results across the material. Even if the membrane is able to bow out a significantly large degree during use, the parabolic shape still causes the greatest amount of bulging to occur along the membrane's center axis. This takes curvature away from the leading and side portions of the membrane and places them in a stall condition. Increased bowing also creates increased lost motion since a greater portion of each stroke is use to merely deform the membrane.

U.S. Pat. No. 4,193,371 to Baulard-Caugan (1980) shows a swimming apparatus that uses a vertically aligned caudal-shaped propulsion blade together with a caudal-shaped hydrofoil for reducing drift during use. Both the Propulsion blade and the "anti-drift member" are rigid and lack a system for reducing stall conditions and induced drag.

Japanese patents 61-6097 (A) to Fujita (1986) and 62-134395 (A), also to Fujita (1987) show a caudal-shaped propulsion blade which has a thin flexible membrane stretched across a forked frame. No system is used to relieve back pressure within the attacking side of the membrane and no system is used to reduce the membrane's tendency to form a parabolic shape as it bows out during use. As a result, this design produces high levels of drag and low levels of lift.

My own U.S. patent application Ser. No. 08276407 to McCarthy filed Jul. 18, 1994 describes several methods for reducing induced drag on foil type devices. However, the designs shown which are capable of being used in reciprocating motion situations (where the angle of attack reverses itself) require the use of complex control devices to invert the foil's shape. No system is shown that permits this inversion process to occur automatically and repeatedly in resilient swim fin applications and resilient propulsion blade applications.

OBJECTS AND ADVANTAGES

Accordingly, several objects and advantages of the present invention are:

(a) to provide hydrofoil designs that significantly reduce the occurrence of flow separation their low pressure surfaces (or lee surfaces) during use;

(b) to provide swim fin designs which significantly reduce the occurrence of ankle and leg fatigue;

(c) to provide swim fin designs which offer increased safety and enjoyment by significantly reducing a swimmer's chances of becoming inconvenienced or temporarily immobilized by leg, ankle, or foot cramps during use;

(d) to provide swim fin designs which are as easy to use for beginners as they are for advanced swimmers;

(e) to provide swim fin designs which do not require significant strength or athletic ability to use;

(f) to provide swim fin designs which can be kicked across the water's surface without catching or stopping abruptly on the water's surface as they re-enter the water after having been raised above the surface;

(g) to provide swim fin designs which provide high levels of propulsion and low levels of drag when used at the surface as well as below the surface;

(h) to provide swim fin designs which provide high levels of propulsion and low levels of drag even when significantly short and gentle kicking strokes are used;

(i) to provide resilient hydrofoil designs which offer significantly less resistance to twisting about their length than to bending across their length;

(j) to provide methods for substantially reducing the formation of induced drag type vortices along the side edges of hydrofoils;

(k) to provide hydrofoil designs which significantly reduce outward directed spanwise flow conditions along their attacking surface;

(l) to provide hydrofoil designs which efficiently encourage the fluid medium along their attacking surface to flow away from their outer side edges and toward their center axis so that fluid pressure is increased along their attacking surface;

(m) to provide methods for significantly reducing back pressure along the attacking surface a hydrofoil in a manner that significantly reduces the occurrence of outward directed spanwise cross flow conditions near the outer side edge portions of the hydrofoil;

(n) to provide methods for significantly reducing separation along the lee surface of reciprocating motion foils which are used at significantly high angles of attack, and (o) to provide methods for controlling the torsional stress forces of tension and compression within the material of a flexible hydrofoil so that the material exhibits significantly reduced levels of resistance to twisting along its length.

Still further objects and objectives will become apparent from a consideration of the ensuing description and drawings.

DRAWING FIGURES

Figure 20:
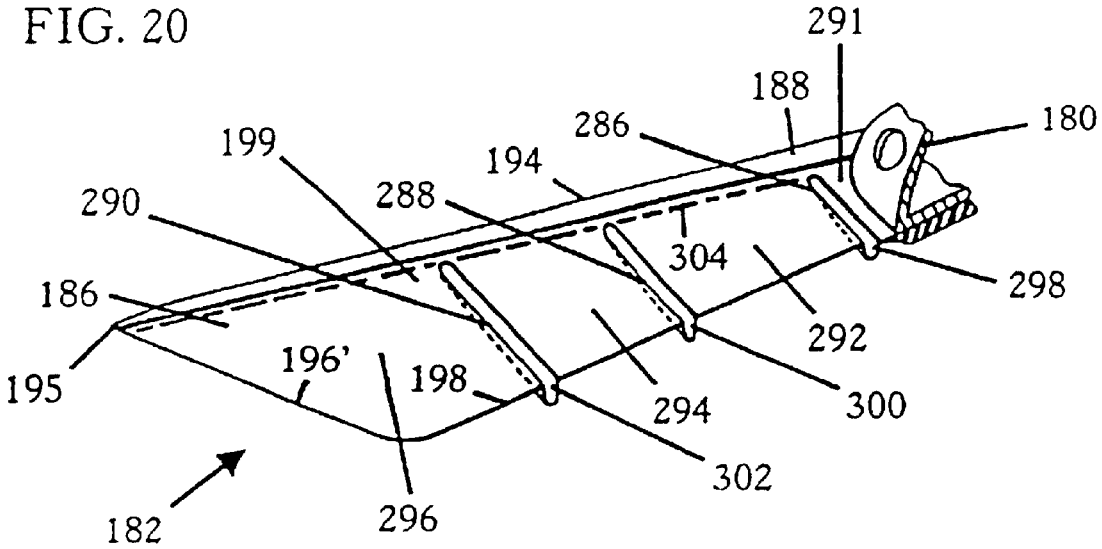
FIG. 20 shows a cut-away perspective view displaying the right half of the same swim fin shown in FIGS. 18 and 19 except that in FIG. 20, the transverse recesses extend further toward the swim fin's outside edge, and a series of flexible membranes are added to bridge the spaces created by the transverse recesses.
Figure 21:
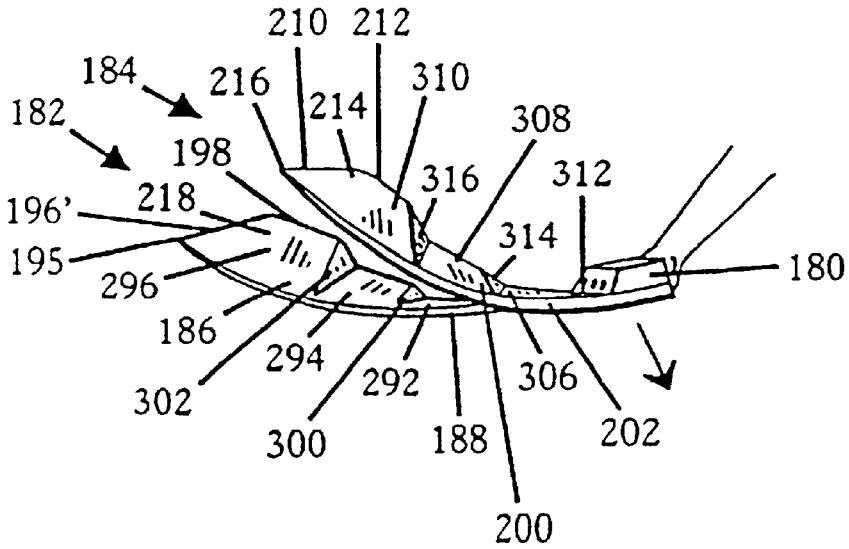
FIG. 21 shows a perspective side view of the embodiment shown in FIG. 20 while it is being kicked through the water.
Figure 22:
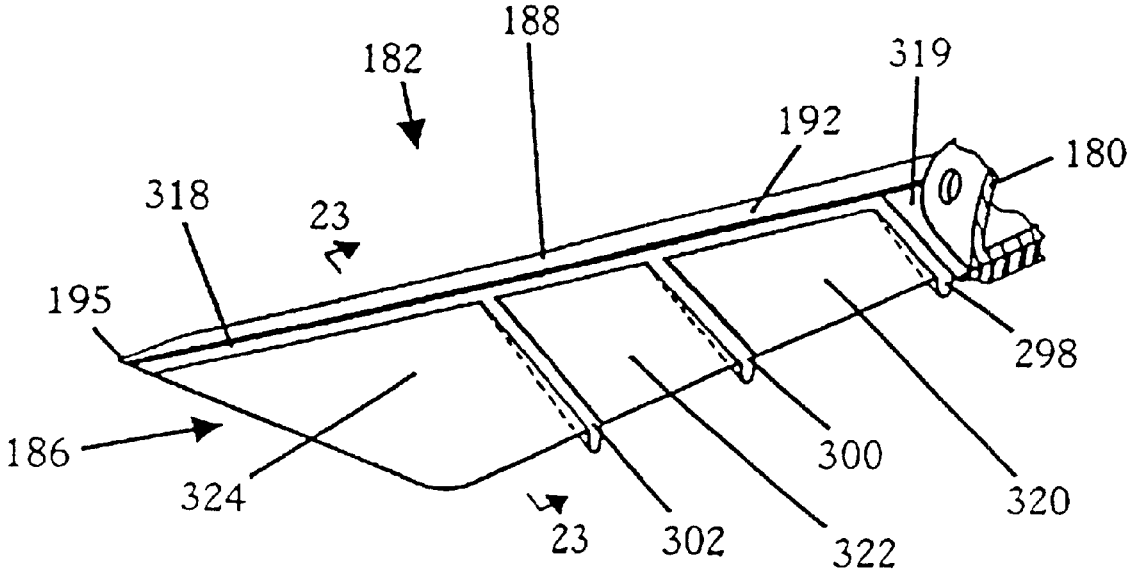

FIG. 22 shows a cut-away perspective view displaying the right half of the same swim fin shown in FIGS. 20 and 21 except that in FIG. 22, a longitudinal recess is added to the outer edge of the right blade half to separate the leading panel, intermediate panel, and trailing panel from the stiffening member, and a narrow strip of flexible membrane is added to fill in the longitudinal recess and connect the leading panel, intermediate panel, and trailing panel to the stiffening member.

Figure 23:
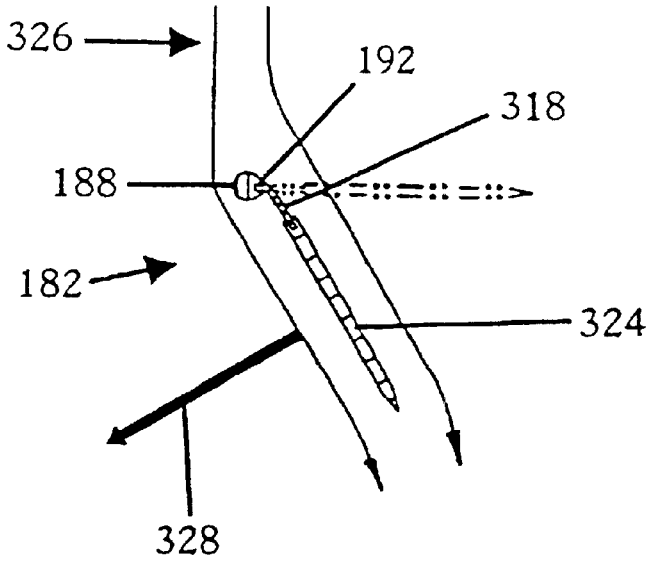

FIG. 23 shows a cross sectional view taken along the line 23—23 from FIG. 22.

Figure 24:
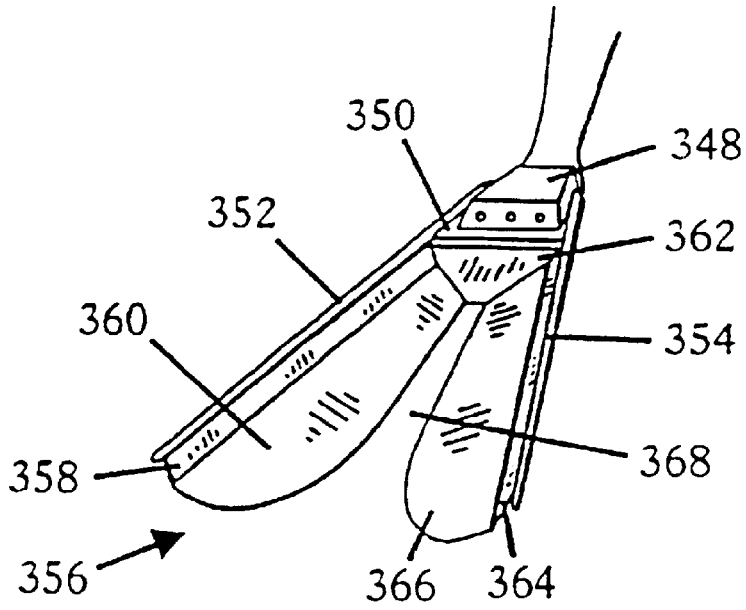

FIG. 24 shows a front perspective view of another embodiment of a swim fin which has a pre-formed lengthwise channel with a recess existing along the center axis of the swim fin.

Figure 25:
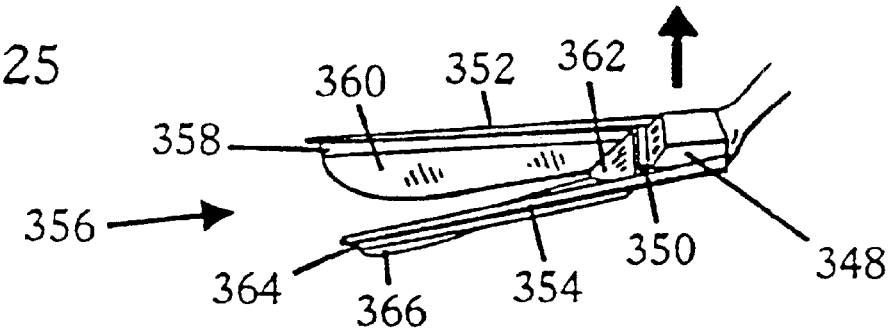

FIG. 25 shows a side perspective view of the same swim fin while it is kicked upward.

Figure 26:
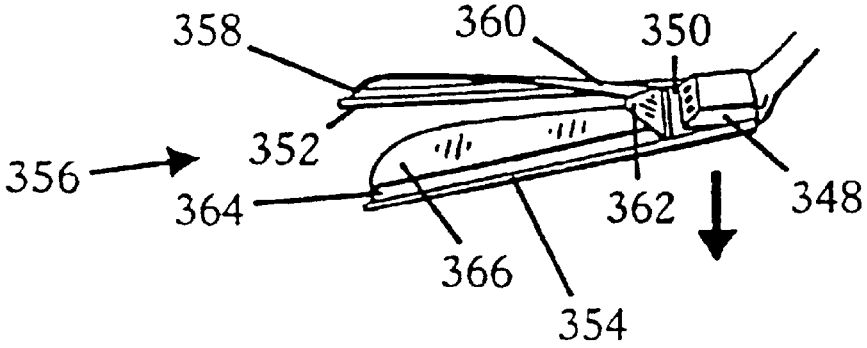

FIG. 26 shows a side perspective view of the same swim fin while its channel-like blade portions invert themselves during a downward kicking motion.

Figure 27:
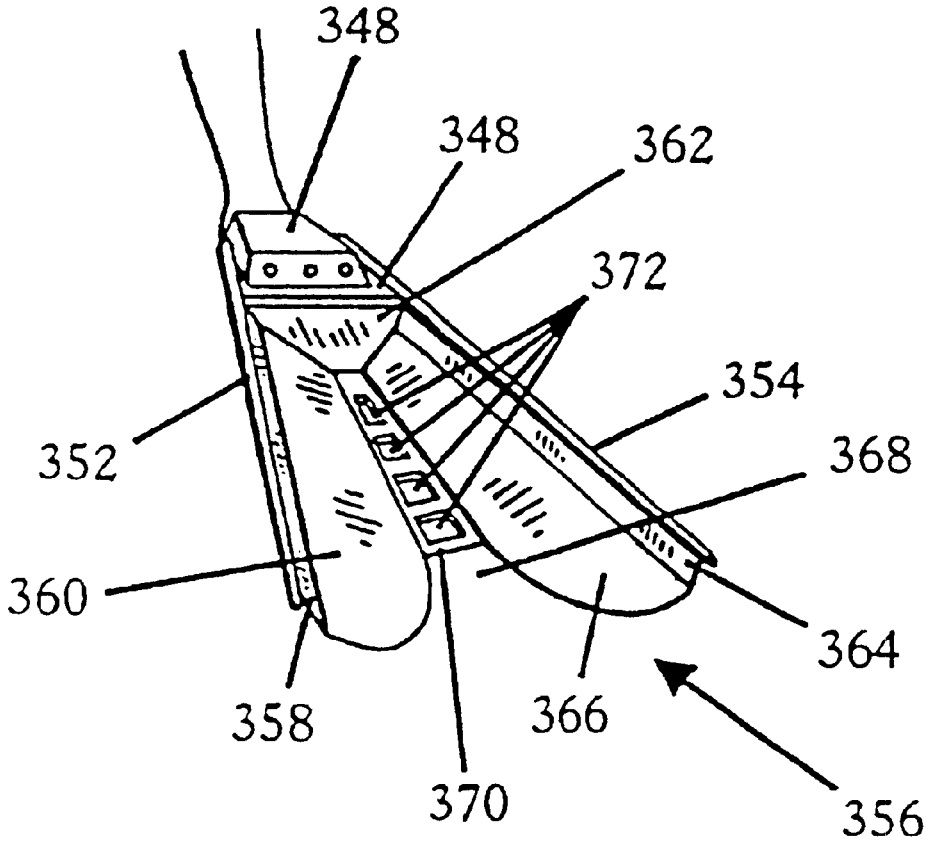

FIG. 27 shows the same swim fin except that it has a vented central membrane stretched across the center recess.

Figure 28:
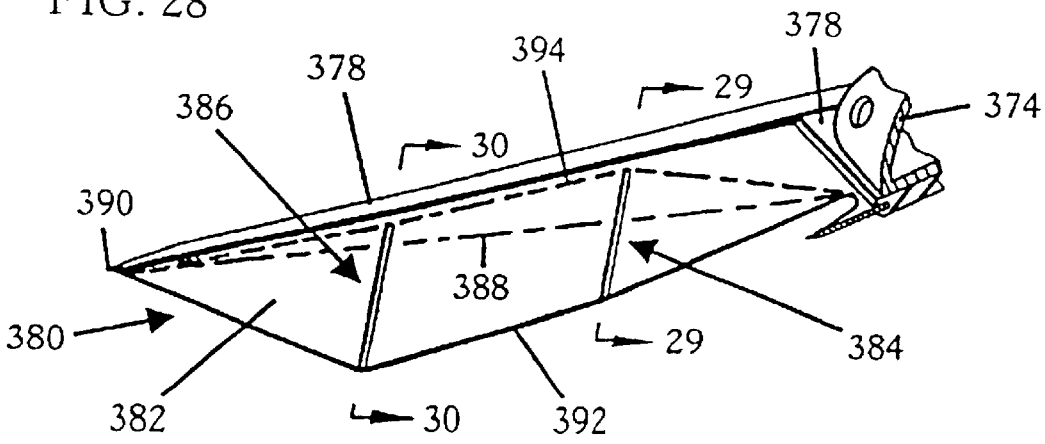

FIG. 28 shows a cut-away perspective view displaying the right half of a symmetrical swim fin having a flexible membrane that is structurally supported by an outer stiffening member and two separately positioned rib pairs.

Figure 29:
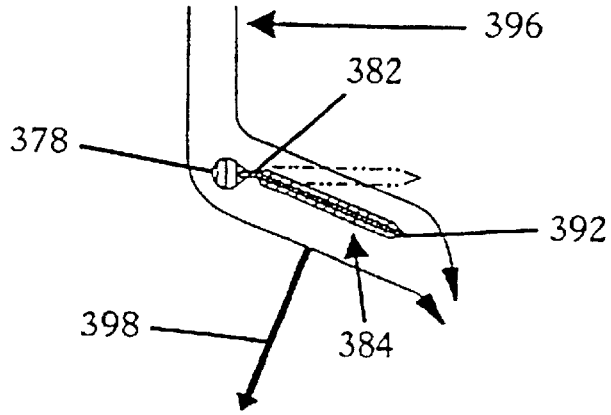

FIG. 29 shows a cross sectional view taken along the line 29—29 from FIG. 28 as the swim fin deforms during use.

Figure 30:
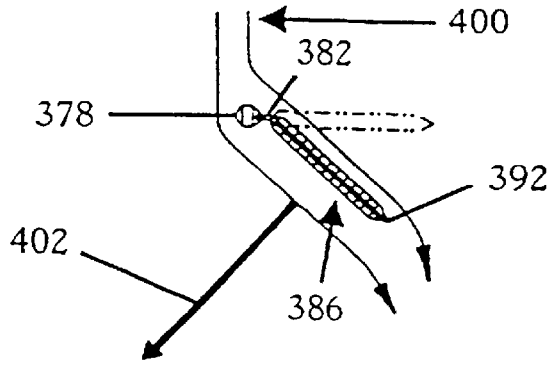

FIG. 30 shows a cross sectional view taken along the line 30—30 from FIG. 28 as the swim fin deforms during use.

REFERENCE NUMERALS IN DRAWINGS

70 foot pocket
72 blade
74 trailing tip
76 right edge
78 left edge
80 upper surface
82 oncoming flow
84 lower surface
85 oncoming flow
86 lift vector
88 vertical component
90 horizontal component
92 oncoming flow
94 lift vector
96 vertical component
98 horizontal component
100 foot pocket
102 platform member
104 right blade
106 left blade
108 outer edge
110 inner edge
112 upper surface
114 trailing tip
116 outer edge
118 inner edge
120 upper surface
122 trailing tip
124 root
126 root
128 reinforcement member
130 oncoming flow
132 lower surface
134 lower surface
136 lift vector
138 vertical component
140 horizontal component
142 lift vector
144 vertical component
146 horizontal component
148 oncoming flow
150 lift vector
152 vertical component
154 horizontal component
156 lift vector
158 vertical component
160 horizontal component
162 foot pocket
164 oncoming flow
166 right upper blade
168 right lower blade
170 left upper blade
172 left lower blade
174 vertical blade
180 foot pocket
182 right blade half
184 left blade half
186 flexible blade portion
188 right stiffening member
190 outer edge
192 inner edge
194 outer edge
195 trailing tip
196 trailing edge
196' trailing edge
198 inner edge
199 upper surface
200 flexible blade portion
202 left stiffening member
204 outer edge
206 inner edge
208 outer edge
210 trailing edge
212 inner edge
214 upper surface
216 trailing tip
218 lower surface
220 lower surface
222 oncoming flow
224 lift vector
226 lift vector
228 vertical component
230 horizontal component
232 vertical component
234 horizontal component
236 oncoming flow
238 bending zone
240 oncoming flow
242 neutral position
244 semi-flexed position
246 highly-flexed position
248 zone of separation
249 oncoming flow
250 zone of separation
251 lift vector
252 transverse recess
254 bending zone
256 forward transverse recess
258 intermediate transverse recess
260 trailing transverse recess
262 outer bending zone
264 intermediate bending zone
266 inner bending zone
267 root portion

268 forward panel
270 intermediate panel
272 trailing panel
274 forward transverse recess
276 intermediate transverse recess
278 trailing transverse recess
280 forward panel
282 intermediate panel
284 trailing panel
286 forward transverse recess
288 intermediate transverse recess
290 trailing transverse recess
291 root portion
292 forward panel
294 intermediate panel
296 trailing panel
298 forward transverse flexible membrane
300 intermediate transverse flexible membrane
302 trailing transverse flexible membrane
304 bending zone
306 forward panel
308 intermediate panel
310 trailing panel
312 forward transverse flexible membrane
314 intermediate transverse flexible membrane
316 trailing transverse flexible membrane
318 lengthwise flexible membrane
319 root portion
320 leading panel
322 intermediate panel
324 trailing panel
326 oncoming flow
328 lift vector
348 foot pocket
350 foot platform
352 right stiffening member
354 left stiffening member
356 channeled blade portion
358 right flexible membrane
360 right blade member
362 intermediate flexible membrane
364 left flexible membrane
366 left blade member
368 center recess
370 vented central membrane
372 venting system
374 foot pocket
376 foot platform
378 right stiffening member
380 flexible blade portion
382 flexible membrane
384 forward rib pair
386 trailing rib pair
388 initial bending zone
390 trailing tip
392 inner edge
394 modified bending zone
396 oncoming flow
398 lift vector
400 oncoming flow
402 lift vector Description—FIGS. 1 to 4

Figure 1:
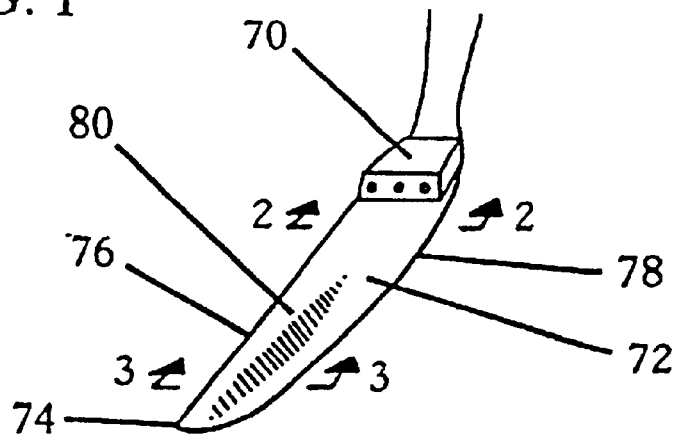
FIG. 1 shows a perspective view of a simplified version an improved swim fin.

In FIG. 1, a perspective view shows a simplified swim fin. At the leading portion of the swim fin is a foot pocket 70 for holding the user's foot. Foot pocket 70 is preferably molded out of a substantially resilient thermoplastic to comfortably adapt to the characteristics of the user's foot. However, foot pocket 70 can occur in any desirable form of a foot attachment mechanism such as a single strap (thick, thin, wide, narrow, adjustable, or padded), a network or series of straps, a harness, a partial boot, a full boot, a shoe member, a single foot cavity, a dual foot cavity for enclosing both feet of the user for kicking in a porpoise-like swimming stroke, or any other suitable method for attaching to a foot or the feet of a user. Extending from foot pocket 70 is a blade 72 which extends toward a trailing tip 74. It is preferred that blade 72 is made of a significantly rigid thermoplastic, and that blade 72 is attached to foot pocket 70 in any suitable manner that is able to provide an adequately strong connection. A right edge 76 of blade 72 is located on right side of the user. A left edge 78 of blade 72 is located on the left side of the user. An upper surface 80 is seen between right edge 76 and left edge 78. Blade 72 twists along its length from a substantially horizontal spanwise alignment near foot pocket 70, to an angled alignment near trailing tip 74. Preferably, this transition in alignment occurs in a smooth manner, however, it can also occur in a series of steps or in an abrupt manner.

Figure 2:
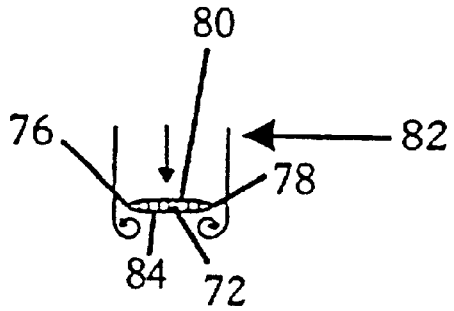
FIG. 2 shows a cross sectional view taken along the line 2—2 of FIG. 1 while is water flowing around the swim fin.

FIG. 2 shows a cross sectional view taken at the line 2—2 from FIG. 1. An oncoming flow 82 is created as the fin is kicked forward so that upper surface 80 is the attacking surface. Oncoming flow 82 is illustrated by a series of streamlines which display the direction of flow around this portion of blade 72 when blade 72 is kicked upward. A lower surface 84 is visible from this view.

Figure 3:
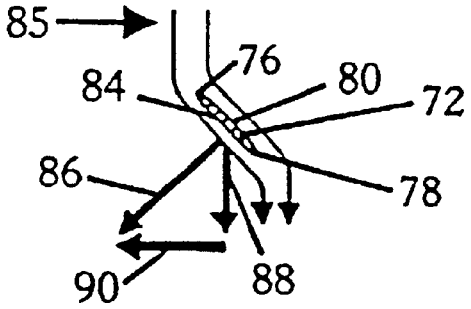
FIG. 3 shows a cross sectional view taken along the line 3—3 of FIG. 1 while water is flowing around the swim fin.

FIG. 3 shows a cross sectional view taken at the line 3—3 from FIG. 1. This view shows the angled orientation of blade 72 near trailing tip 74. An oncoming flow 85 is seen approaching and flowing around blade 72 in an angled manner. Oncoming flow 85 is created by the same kicking stroke that produces oncoming flow 82 shown in FIG. 2. In FIG. 3, the flow conditions displayed by the streamlines of oncoming flow 85 create a lift vector 86 which is illustrated by an arrow that points away from lower surface 84. Lift vector 86 is perpendicular to the direction of the streamline flowing along lower surface 84. A vertical component 88 of lift vector 86 is displayed by a vertical arrow aiming downward. A horizontal component 90 of lift vector 86 is displayed by a horizontal arrow aiming sideways and away from lower surface 84.

Figure 4:
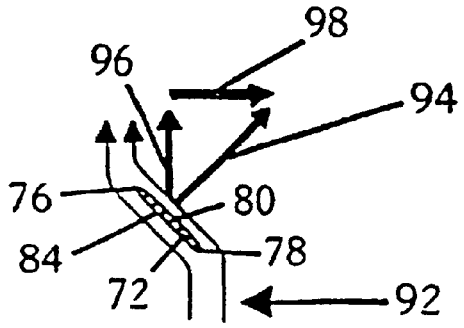
FIG. 4 shows the same view shown in FIG. 3 except that the water is flowing in the opposite direction around the swim fin.

FIG. 4 shows the same cross sectional view as seen in FIG. 3, however, the fin is now being kicked in the opposite direction so that lower surface 84 is now the attacking surface. An oncoming flow 92 is displayed by two streamlines flowing smoothly around blade 72. Oncoming flow 92 is illustrated by an arrow that points away from upper surface 80. A lift vector 94 is perpendicular to the streamline flowing along upper surface 80. A vertical component 96 of lift vector 94 is displayed by a vertical arrow pointing away from upper surface 80. A horizontal component 98 of lift vector 94 is displayed by a horizontal arrow point sideways and away from upper surface 80.

Operation—FIGS. 1 to 4

FIG. 1 shows a simplified version of an improved swim fin. Blade 72 twists along its length so that a significant portion of blade 72 is inclined at a reduced angle of attack during use. By giving blade 72 this twisted form, separation is greatly reduced along the low pressure surface of a given stroke. This reduces drag and increases lift on blade 72.

In FIG. 2, blade 72 is being kicked forward so that upper surface 80 is the attacking surface and lower surface 84 is the low pressure surface on this stroke. Because this portion of blade 72 is at a high angle of attack relative to oncoming flow 82, the streamlines separate from lower surface 84 after passing around right edge 76 and left edge 78. Many prior art designs have these flow conditions along the entire length of their working surface areas.

On the opposite stroke of that shown in FIG. 2, the same flow patterns exist except that they are inverted. In this situation, the water approaches from the other side of blade 72 so that lower surface 84 is the attacking surface and upper surface 80 is the low pressure surface.

FIG. 3 shows the angled orientation of 72 taken at line 3—3 of FIG. 1. Relative to the direction of oncoming flow 85, right edge 76 is seen to be the leading edge from this view while left edge 78 is the trailing edge. The cross sectional shape of this embodiment is shown to be symmetrically tapered at right edge 76 and left edge 78. This enables this embodiment to generate efficient levels of lift when the direction of flow reverses around blade 72 on reciprocating strokes. However, this embodiment can also employ an asymmetrical hydrofoil shape that works most effectively during one particular stroke. For example, a symmetrical or asymmetrical tear drop cross sectional shape can be used.

From the view shown in FIG. 3, it can be seen that this segment of blade 72 is at a significantly reduced angle of attack relative to oncoming flow 85. The streamline next to lower surface 84 is flowing smoothly in an attached manner. This attached flow condition shows that separation is greatly reduced along the low pressure surface of blade 72. This significantly reduces drag and increases lift. It is preferred that blade 72 is twisted over a substantial portion of its length so that a significant portion of blade 72 is oriented at a significantly reduced angle of attack.

Because this reduced angle of attack increases attached flow along the low pressure surface, a strong low pressure field is forms along lower surface 84 as water curves around this surface. Efficiency is high because the flow of water around the lower surface 84 (the low pressure surface or lee surface) is not blocked or restricted. While this low pressure field forms, a high pressure field forms along upper surface 80 as water pushes against this surface. The pressure difference existing between these two pressure fields creates lift vector 86, which is perpendicular to the direction of the streamline flowing along lower surface 84. Because the streamlines of oncoming flow 85 are able to meet each other in a constructive manner at left edge 78, lift is efficiently generated.

Because lift vector 86 is at an angle, it is composed of vertical component 88 and horizontal component 90. Vertical component 88 of lift vector 86 pushes against blade 72 in the opposite direction of the swim fin's movement through the water. This force offers forward propulsion for the user. Horizontal component 90 of lift vector 86 pushes sideways on blade 72 toward the user's right side (toward right edge 76). It is preferred that blade 72 be made from a sufficiently rigid enough material to substantially maintain its shape during use while horizontal component 90 of lift vector 86 pushes sideways against it. Examples of rigid materials can include fiber reinforced thermoplastics.

To increase such resistance to sideways deformation in alternate embodiments, a stiffening member, beam, strut, or network of such members can be used to reinforce blade 72 and provide added rigidity. Such stiffeners can be connected internally or externally to blade 72 in any suitable manner. An alternate embodiment can also use a horizontally aligned planar shaped stiffener within blade 72 to resist sideways forces while still permitting blade 72 to bend around a horizontally aligned transverse axis. Blade 72 can also be made significantly thicker to increase its rigidity. The use of a more rounded upper surface 80 and lower surface 84 can also further improve attached flow conditions and lift generation along the lee surface of blade 72.

FIG. 4 shows the same view as seen in FIG. 3 except that blade 72 is being kicked in the opposite direction as that shown in FIG. 3. In FIG. 4, oncoming flow 92 approaches lower surface 84, and therefore lower surface 84 is the attacking surface while upper surface 80 is the low pressure surface. Relative to oncoming flow 92, left edge 78 is seen to be the leading edge and right edge 76 is seen to be the trailing edge. Because the streamline next to upper surface 80 is flowing smoothly, a strong low pressure field forms as the water flowing along the low pressure surface is forced to travel over a greater distance than the water flowing along the attacking surface. This combines with the formation of a high pressure field along lower surface 84 to create lift vector 94 which is perpendicular to the streamline flowing next to upper surface 80. Lift vector 94 is composed of vertical component 96 and horizontal component 98. Vertical component 96 offers propulsion by providing a force to push off of during strokes. Horizontal component 98 pushes sideways against blade 72 toward the user's left side. Again, it is preferred that blade 72 is sufficiently rigid enough to avoid substantial sideways deformation during use.

This design offers improved performance near the surface of the water in comparison to prior designs. If blade 72 breaks the surface of the water during strokes and then attempts to reenter the water, it does not slap the water and stop abruptly on impact. Because a significant portion of blade 72 is oriented at a reduced angle of attack, the blade slices easily through the surface like a knife and therefore maintains its downward momentum. As a result, this momentum is easily converted into forward propulsion. Because a majority of blade 72 has significantly reduced levels of separation and induced drag vortex formation, blade 72 continues to slice through the water with low substantially reduced levels of drag. This makes the swim fin easy to use and greatly improves stamina.

Another benefit to this design is that the twisted form of blade 72 encourages water to flow aftward. Because blade 72 is twisted along its length, the angle of attack of blade 72 decreases along its length. This causes the high pressure field along the length of a particular attacking surface to decrease in intensity from the leading portions of blade 72 toward trailing tip 74. This lengthwise decrease in the intensity of the high pressure field causes water to flow in a substantially lengthwise manner across the attacking surface of blade 72 toward trailing tip 74. This increases forward propulsion.

Other embodiments can place the trailing portions of blade 72 at a higher or lower angle of attack than is shown in FIGS. 3 and 4. Also, blade 72 can be angled along its entire length. In this situation, it can maintain a constant angle or twist from a relatively higher angle of attack to a relatively lower angle of attack. Blade 72 can also begin near foot pocket 70 with an angled orientation in one direction and then reverse its angle of attack farther toward tip 74. This can create two opposing sideways components of lift on blade 72 which neutralize each other so that a net zero horizontal force results. These sideways forces can be arranged to either partially or completely neutralize each other.

Description—FIGS. 5 to 8

Figure 5:
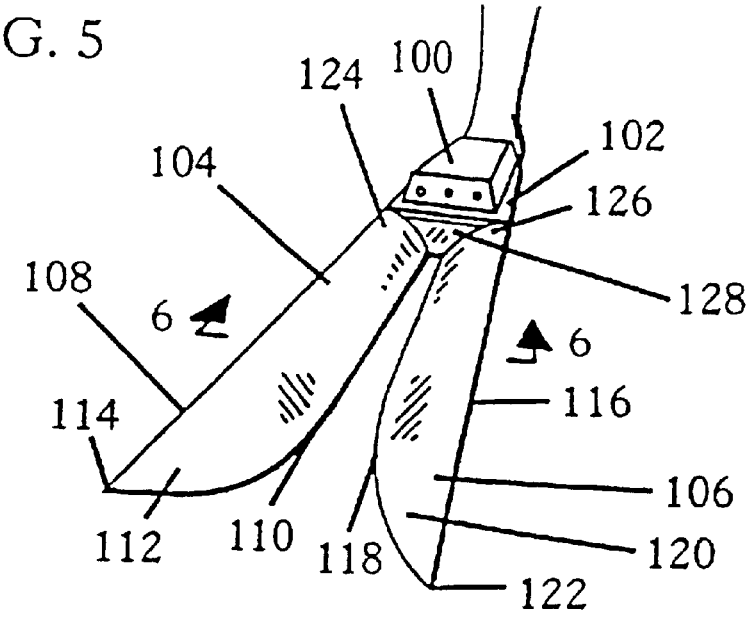
FIG. 5 shows a perspective view of a swim fin which has two highly swept blades that are spaced apart and mounted at an angled orientation to each other.

FIG. 5 shows a perspective view of an improved swim fin. A foot pocket 100 receives the user's foot and is preferably made from a substantially resilient thermoplastic to provide comfort to the user. Foot pocket 100 is attached in any suitable manner to a platform member 102. Platform 102 is preferably made of a significantly rigid material such as a fiber reinforced thermoplastic. Platform 102 is attached in any suitable manner to a right blade 104 located to the right of the user, and to a left blade 106 located to the left of the user. Right blade 104 has an outer edge 108 and an inner edge 110. An upper surface 112 is seen located between outer edge 108 and inner edge 110. Outer edge 108 and inner edge 110 converge at trailing tip 114. Left blade 106 has an outer edge 116 and an inner edge 118. An upper surface 120 is seen located between outer edge 116 and inner edge 118. Outer edge 116 and inner edge 118 converge at a trailing tip 122. At the leading portion of right blade 104 is a root 124. At the leading portion of left blade 106 is a root 126. Between root 124, root 126, and platform 102 is a reinforcement member 128 which is attached to root 124, root 126, and platform 102 in any suitable manner. Member 128 is used to maintain the set inclination of each blade. In this embodiment, member 128 is shaped like a panel in order to reduce turbulence around root 124 and root 126 during use. This design may also be used without member 128.

It is preferred that platform 102, member 128, right blade 104, and left blade 106 are all molded from a significantly rigid material such as a fiber reinforced thermoplastic. However, any suitably rigid material may be used.

Figure 6:
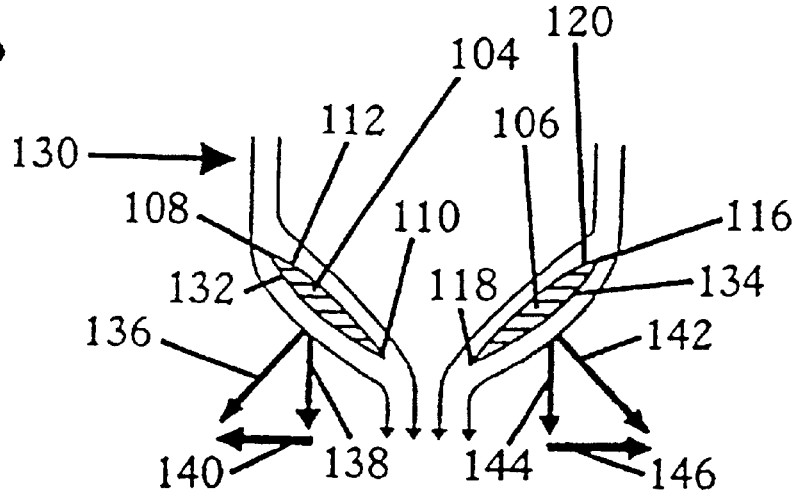
FIG. 6 shows a cross sectional view taken along the line 6—6 from FIG. 5 as streamlines are flowing by the blades during use.

FIG. 6 shows a cross sectional view taken along the line 6—6 in FIG. 5. An oncoming flow 130 is illustrated by a series of streamlines flowing over right blade 104 and left blade 106. A lower surface 132 of right blade 104 and a lower surface 134 of left blade 106 are both visible from this view. These flow conditions result when right blade 104 and left blade 106 are kicked upward so that upper surface 112 and upper surface 120 are both the attacking surfaces. Next to right blade 104, a lift vector 136 is displayed by an arrow extending away from lower surface 132. Lift vector 136 is composed of a vertical component 138 and a horizontal component 140. Next to left blade 106, a lift vector 142 is displayed by an arrow extending way from lower surface 134. Lift vector 142 is composed of a vertical component 144 and a horizontal component 146.

Figure 7:
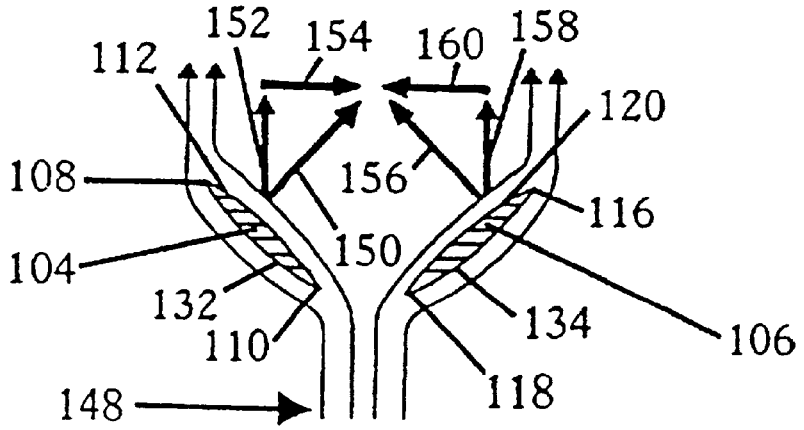
FIG. 7 shows the same view shown in FIG. 6 except that the blades are being kicked in the opposite direction.

FIG. 7 shows the same cross sectional view shown in FIG. 6 except that the swim fin is being kicked in the opposite direction. This causes an oncoming flow 148 to approach right blade 104 and left blade 106 from the opposite direction as oncoming flow 130 shown in FIG. 6. In FIG. 7, oncoming flow 148 is displayed by a series of streamlines flowing around right blade 104 and left blade 106. lower surface 132 and lower surface 134 are seen to be the attacking surfaces on this stroke. Next to right blade 104, a lift vector 150 extends away from upper surface 112. Lift vector 150 is composed of a vertical component 152 and a horizontal component 154. Next to left blade 106, a lift vector 156 extends away from upper surface 120. Lift vector 156 is composed of a vertical component 158 and a horizontal component 160.

Figure 8:
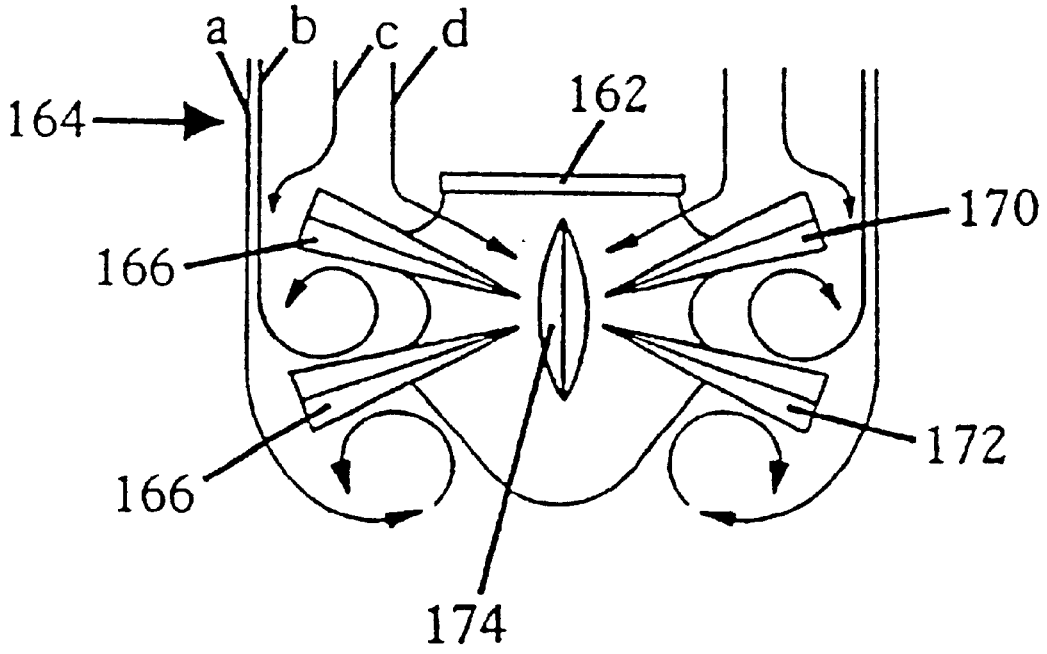
FIG. 8 PRIOR ART
FIG. 8 shows an end view of a prior art swim fin with streamlines displaying the undesirable flow conditions it creates.

FIG. 8 shows a prior art comparison to the embodiments shown in FIGS. 5 to 7. FIG. 8 shows an end view of a swim fin design having four blades which is displayed in French patent 1,501,208 to Barnoin (1967). Although the many problems of this prior art reference are already discussed in the prior art section of this specification, the illustration shown in FIG. 8 enables the highly undesirable flow conditions it creates during use to be visualized.

In FIG. 8, the trailing portions of the swim fin (located in front of the toe region of the foot pocket) are facing the viewer. At the top of the swim fin is the upper portion of a foot pocket 162. An oncoming flow 164 is illustrated by a series of streamlines flowing toward the upper portion of the swim fin. These streamlines then flow around the swim fin to illustrate the areas where flow separation and induced drag vortex formation occurs. The swim fin has a right upper blade 166 and a right lower blade 168 on the right side of the swim fin. A left upper blade 170 and a left lower blade 172 is on the left side of the swim fin. Each blade tapers in thickness toward the fin's center axis. At this center axis is a vertical blade 174. The streamlines flowing toward the swim fin's right side are labeled a, b, c, and d. Because the swim fin is symmetrical, the streamlines flowing toward the swim fin's left hand side behave similarly, and therefore they are not labeled and described. The streamlines show the flow conditions created when the swim fin is kicked upward through the water. Because the blade configuration is symmetrical, the same type of flow conditions occur when the fin is kicked in the opposite direction, except that the flow conditions are inverted.

Operation—FIGS. 5 to 8

In FIG. 5, both upper surface 112 and upper surface 120 are seen to slope down toward the space between right blade 104 and left blade 106. When the swim fin is kicked upward so that upper surface 112 and upper surface 120 are the attacking surfaces, the sloped orientation of upper surface 112 and upper surface 120 creates a valley shaped channel along the length of the swim fin that encourages water to flow away from outer edge 108 and toward inner edge 110 on right blade half 104, as well as flow away from and outer edge 106 and toward inner edge 118 on left blade half 106. This significantly increases performance during this stroke by significantly reducing outward spanwise cross flow conditions along the attacking surfaces as well as reducing induced drag vortex formation around the outside of outer edge 108 and outer edge 106. Because a space exists between inner edge 110 and inner edge 118, excess pressure can escape though this space in the bottom of the channel when upper surface 112 and upper surface 120 are the attacking surfaces. By significantly reducing back pressure within this channel during such a stroke, this design prevents water from backing up and flowing in an outward direction along upper surface 112 and upper surface 120 toward outer edge 108 and outer edge 116, respectively.

In FIG. 6, the streamlines from oncoming flow 130 display that when the swim fin is kicked upward, water is able to flow through the space between inner edge 110 and inner edge 118. As the water converges toward this space, a strong high pressure field is created within the water between upper surface 112 and upper surface 120. At the same time, the streamlines traveling along lower surface 132 of right blade 104, and lower surface 134 of left blade 106 are seen to flow smoothly in an attached manner. This permits a strong low pressure field to form along lower surface 132 of right blade 104 as well as lower surface 134 of left blade 106.

The creation of a strong high pressure field along upper surface 112 and upper surface 120 combines with the creation of a strong low pressure field along lower surface 132 and lower surface 134 to enable the swim fin to efficiently generate high levels of lift. Next to right blade 104 is lift vector 136 which is perpendicular to the streamline flowing along lower surface 132. Vertical component 138 of lift vector 136 provides forward propulsion for the swimmer while horizontal component 140 of lift vector 136 applies a sideways force to right blade 104. Next to left blade 106 is lift vector 142 which is perpendicular to the streamline flowing around lower surface 134. Vertical component 144 of lift vector 142 provides forward propulsion while horizontal component 146 of lift vector 142 applies a sideways force against left blade 106. In this embodiment, it is intended that both right blade 104 and left blade 106 are made of a sufficiently rigid enough material to substantially maintain their lengthwise alignment during use and avoid excessive sideways deformation from horizontal component 140 and horizontal component 146, respectively. Because horizontal components 140 and 146 are oppositely directed, they counteract each other and no net horizontal force is applied to the user's foot.

Because both separation and induced drag vortex formation are greatly reduced, the swim fins create less drag and are easier to use than prior designs. The attached flow conditions created along the low pressure surfaces permit high levels of lift to be generated during use which are efficiently converted into forward propulsion. Because most swimmers who use swim fins tend to swim face down in the water, the benefits of the forward kicking stroke shown in FIG. 6 are highly beneficial in the swimmers down stroke (upper surface 112 and upper surface 120 are the attacking surfaces and are facing down in the water). This is the more powerful of the two possible stroke directions.

If this fin is used while swimming along the water's surface, it works exceptionally well when it breaks the water's surface during kicks. As the fin re-enters the water and strikes the surface, the angled orientation of right blade 104 and left blade 106 permit them to easily slice through the surface like two knives and the swim fin does not "catch" like prior swim fins. As the swim fin is undergoing re-entry, water immediately begins flowing in a smooth manner around lower surface 132 and lower surface 124 to quickly form lift generating low pressure fields which efficiently propel the swimmer forward. Because separation and induced drag vortices are reduced, the swim fin does not suddenly decelerate from high levels of drag. Instead, the momentum of the down stroke is maintained re-entering the water. As a result, the energy possessed by this momentum is efficiently converted into forward propulsion.

FIG. 7 shows the same cross sectional view shown in FIG. 6 except that FIG. 7 illustrates what the flow conditions are like when the swim fin is kicked downward through the water relative to the orientation shown in FIG. 5. In FIG. 7, oncoming flow 148 flows toward lower surface 132 and lower surface 134. As oncoming flow 148 collides with lower surface 132 and lower surface 134, a high pressure field is formed along these two surfaces. The streamlines shown flowing through the space between inner edge 110 and inner edge 118 spread apart and flow smoothly along upper surface 112 and upper surface 120 in an attached manner. As this happens, a low pressure field forms along upper surface 112 and upper surface 120.

Because both high pressure fields and low pressure fields are formed, these pressure fields combine to create significantly strong lifting forces on right blade 104 and left blade 106. Vertical component 152 and vertical component 158 provide propulsion for the user. Horizontal component 154 and horizontal component 160 apply a sideways force on right blade 104 and left blade 106, respectively. It is preferred that right blade 104 and left blade 106 are rigid enough to prevent them from flexing substantially toward each other under the forces of horizontal component 154 and horizontal component 160. Because horizontal component 154 and horizontal component 160 are oppositely directed, they counteract each other so that no net horizontal force is applied to the user's foot.

In FIG. 7, the space between inner edge 110 and inner edge 118 permits water to flow around the "lee" portion of each blade in an attached manner. Because the streamlines which split apart at the leading edge of each blade are able to meet again at the trailing edge of each blade, the water traveling a greater distance around the lee surface of each blade must travel farther, and therefore faster than the water flowing around the attacking surface of each blade. Because this design significantly decreases separation along the lee surface of each blade, drag is reduced and lift is increased.

Many variations of this design are possible. For instance, the angled inclination of each blade can be reversed so that upper surface 112 and upper surface 120 are at a dihedral orientation to each other when the swim fin is kicked upward (relative to the view in FIG. 5), and lower surface 132 and lower surface 134 are at an anhedral orientation when the swim fin is kicked downward.

Other embodiments can include using one single swim fin for both feet in a dolphin style kicking stroke. In such cases, the spanwise dimensions (as well as overall dimensions) can be increased significantly. In one of many such embodiments, blades 104 and 106 can be further separated from one another and mounted to either end of a transversely mounted wing-like hydrofoil. The angled inclination of blades 104 and 106 can significantly reduce induced drag vortex formation at the outer ends of the transverse hydrofoil. In addition, the lift vectors produced by blades 104 and 106 can significantly increase the total lift produced by the swim fin. If desired, blades 104 and 106 can be molded onto the transverse hydrofoil so that a smoothly contoured streamlined shape results. The lengthwise dimensions of blades 104 and 106 can also be decreased if desired.

Alternate embodiments of the design shown in FIGS. 5 through 7 can also include having right blade 104 and left blade 106 pivotally attached to foot pocket 100. In this embodiment, blades 104 and 106 are pivotally attached so that they may pivot around a substantially lengthwise axis in order to vary their angle of attack. Any suitable manner of pivotally attaching blades 104 and 106 to foot pocket 100 may be used. In this situation, reinforcement member 128 is either not needed at all, or it may be made of a highly resilient material which permits right blade 104 and left blade 106 to rotate and invert their orientations on reciprocating strokes. In such cases, member 128 can serve to stop rotation once a predetermined reduced angle of attack has been reached on each stroke.

One such way of pivotally attaching blades 104 and 106 to foot pocket 100 is to have two rod-like members extending from either side of foot pocket 100 and, or platform 102 in a direction that is substantially parallel to outer edge 108 and outer edge 116. These rod-like members can then be inserted into a corresponding longitudinal cavity located substantially within outer side edge of each blade. This permits each blade to pivot around a lengthwise axis located near its outer side edge. Consequently, outer edges 108 and 116 are leading edges on both reciprocating strokes. As a result, outer edges 108 and 116 may be made rounded while inner edges 110 and 118 may be made relatively sharp so that each blade tapers in an inward direction to form a tear dropped cross sectional shape. This creates an improved hydrofoil shape which further increases lift and decreases drag.

Such a longitudinal cavity within each blade may be secured to each rod-like member in any suitable manner that permits both secured attachment and rotation. For instance, a flange or protrusion within each rod-like member can extend into a groove within each longitudinal cavity, or vice versa. Such a mating arrangement between flange and groove can be designed to permit relative movement in the direction of desired pivoting while preventing the blade from sliding off the rod-like member in a lengthwise direction.

For embodiments not using any type of member 128, the range of pivotal motion within each blade can be limited in any suitable manner. For instance, a flange-like structure may extend from a portion of each rod-like member into a recess located within the corresponding cavity of each blade. This recess may be made larger than the size of the flange to permit the flange to pivot back and forth within the recess over a predetermined range. When the flange pivots into contact with the boundaries of this recess, pivoting stops and the blade reaches a maximum reduced angle of attack.

Pivotal range can also be limited by securing a flexible or semi-flexible strip, cord, flange, or member between inner edge 110 and inner edge 118 which has a predetermined degree of slack or looseness within it. This member expands as the blades rotate to a reduced angle of attack. When the member becomes fully expanded, pivoting is brought to a stop. The looseness built into such a member can also be made adjustable to suit the user's tastes. Other methods can include securing such a member between the inner edge portion of each blade's root to foot pocket 100 and, or platform 102. Any suitable method of limiting the range of motion in a permanent or variable manner may be used.

Another way of pivotally connecting the blades to foot pocket 100 is to have a rod-like member extend out from the root of each blade which is inserted into a corresponding cavity within foot pocket 100 and, or platform 102. The rod-like member can be secured in any suitable manner that permits rotation while preventing it from sliding out of its corresponding cavity during use. Such a rod-like member and its corresponding blade may be molded in one piece from any desirable material that is preferably rigid and durable such as a fiber reinforced thermoplastic, or composite material. A removability feature can permit damaged blades to be replaced as well as different shaped blades to be substituted for one another.

Still other embodiments can employ any desirable number of such rotating blades arranged in any desirable manner. For instance, a plurality of narrow and highly swept rotating blades may be used instead of two wider swept rotating blades. A plurality of fixed blades may be used as well.

FIG. 8 shows an end view of a prior art swim fin which is displayed in French patent 1,501,208 to Barnoin (1967). This drawing permits the undesirable flow conditions of a prior art example to be compared with the highly efficient flow conditions of the present invention displayed in FIGS. 1 to 7. In the illustration shown in FIG. 8, the prior art swim fin is kicked forward so that oncoming flow 164 is approaching the upper portion of the swim fin. The streamlines a, b, c, and d of oncoming flow 164 display the undesirable flow conditions existing in this design.

As the outer streamline a begins to curve around the outer edge of lower blade 168, it separates from the lower surface of lower blade 168. This is because lower blade 168 is oriented at an undesirable angle of attack relative to oncoming flow 164. The resultant separation stalls lower blade 168 and prevents a low pressure field from forming along the lower surface (low pressure surface on this stroke) of lower blade 168. This prevents lift from being created and creates high levels of drag from transitional flow. After streamline a separates from the lower surface of 168, it forms a large induced drag type vortex below the lower surface of 168. This further destroys lift and creates significantly large levels of induced drag.

As streamline b tries to curve around the outer end of upper blade 166, it is blocked by the upper surface (attacking surface) of lower blade 168. This causes streamline b to curl back around toward the lower surface (lee pressure surface) of upper blade 166 and form a rotating eddy in the space between upper blade 166 and lower blade 168. Because the dihedral orientation of lower blade 168 blocks water flowing around the outer end of blade 166, this water cannot merge in a constructive manner with the water exiting the attacking surface of blade 166 at its inner side edge (near vertical blade 174). In addition, the eddy formed between blade 166 and blade 168 causes the water to flow backward along the lower surface (lee surface) of upper blade 166. This flow is oriented in the opposite direction needed to generate lift. Consequently, The dihedral orientation of lower blade 168 prevents attached flow conditions from occurring along the lower surface of upper blade 166. Furthermore, the dihedral orientation of lower blade 168 creates highly undesirable turbulence patterns which stalls upper blade 166 and prevents it from generating lift.

Just as a stalled airplane wing can prevent an airplane from generating the needed lift to get off the ground, the severely stalled blades in this swim fin prevent them from generating adequate levels of lift. As a result, propulsion is poor and drag is exceedingly high. When considering that the presence of one or two stalled blades on other prior art swim fins create excessive levels of drag which often cause painful muscle cramps, the drag created by the four completely stalled blades in Barnoin's swim fin can be unbearable. The combination of this swim fin's propensity to generate high levels of induced drag and transitional flow on all four blades, places drag generation at unusable levels.

The eddy created between upper blade 166 and lower blade 168 forms into a powerful induced drag vortex that further destroys lift and increases drag. This induced drag vortex creates an outward flow condition along the upper surface of upper blade 166 near the outer edge of upper blade 166. As a result, streamline c is deflected outward and drawn toward the vortex existing between upper blade 166 and lower blade 168. Although streamline d is able to flow inward along the upper surface of upper blade 166, the lower surface of upper blade 166 is completely stalled out. This prevents upper blade 166 from generating a substantial pressure difference between its opposing surfaces.

Description—FIGS. 9 to 13

Figure 9:
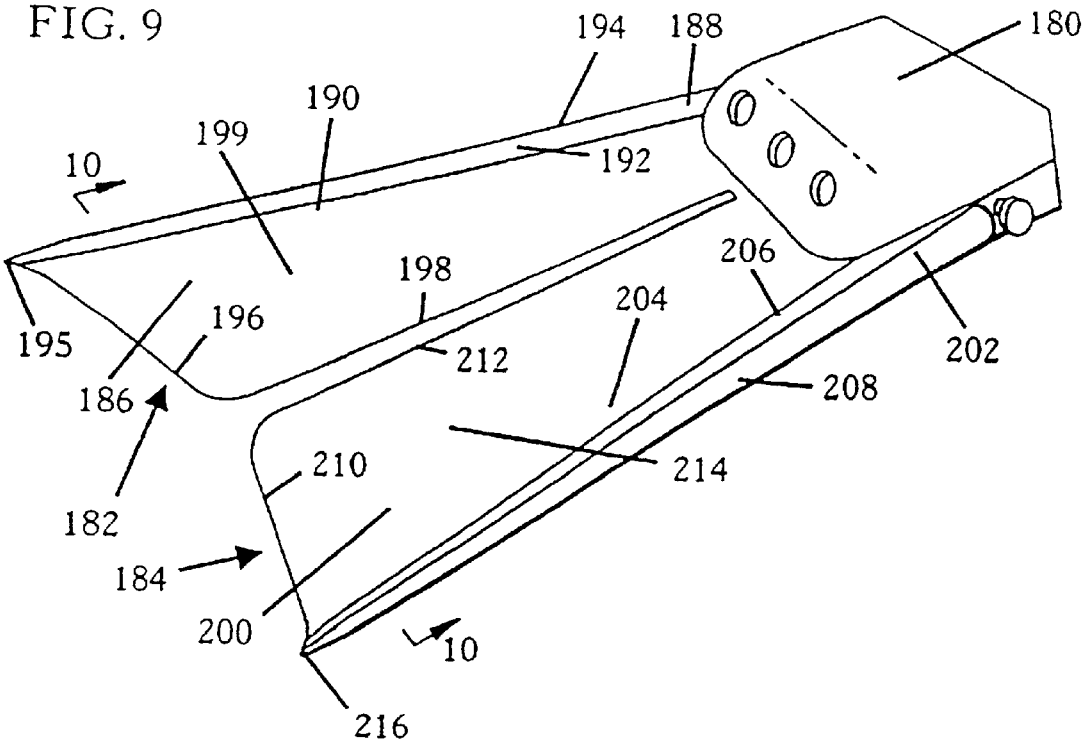
FIG. 9 shows a perspective view of an improved swim fin having two side by side flexible blade halves.

FIG. 9 shows a perspective view of an improved swim fin which has a recess along the swim fin's center axis. This recess extends from the trailing portion of the swim fin to a predetermined distance (in this case a significantly short distance) from the toe portion of a foot pocket 180. However, any desirable distance may be used. The recess divides the swim fin into a right blade half 182 and a left blade half 184. Right blade half 182 is made up of a flexible blade portion 186 and a right stiffening member 188. An outer edge 190 of flexible portion 186 is connected to an inner edge 192 of stiffening member 188 in any suitable manner. For instance, flexible portion 186 and stiffening member may be molded as one piece out of the same material. An outer edge 194 of stiffening member 188 is located opposite from inner edge 192. Stiffening member 188 tapers in thickness toward a trailing tip 195. Flexible portion 186 is seen to have a trailing edge 196, an inner edge 198, and an upper surface 199.

Left blade half 184 is constructed in the same manner as right blade half 182. Left blade half 184 has a flexible blade portion 200 and a left stiffening member 202. An outer edge 204 of flexible portion 200 is attached to an inner edge 206 of stiffening member 202 in any suitable manner. Opposite from inner edge 206 is and outer edge 208 of stiffening member 202. Flexible portion 200 is seen to have a trailing edge 210, an inner edge 212, and an upper surface 214. Stiffening member 202 tapers in thickness toward a trailing tip 216.

Between the forward portion of the recess and foot pocket 180, flexible portion 186 and flexible portion 200 merge together. Foot pocket 180 is connected to this portion of flexible portion 186 and flexible portion 200 in any suitable manner. It is preferred that this area of flexible portion 186 and flexible portion 200 extend below foot pocket 180 to form a sole that is thick enough to prevent excessive wear while walking across land. To achieve this, it is preferred that the thickness of this portion of flexible portion 186 and flexible portion 200 become substantially thicker beneath foot pocket 180. It is also preferred that the sole of foot pocket 180 is made sufficiently rigid enough to provide rigid support for stiffening member 188 and stiffening member 202. Other embodiments can use a separate, more rigid material beneath foot pocket 180 if desired.

Figure 10:
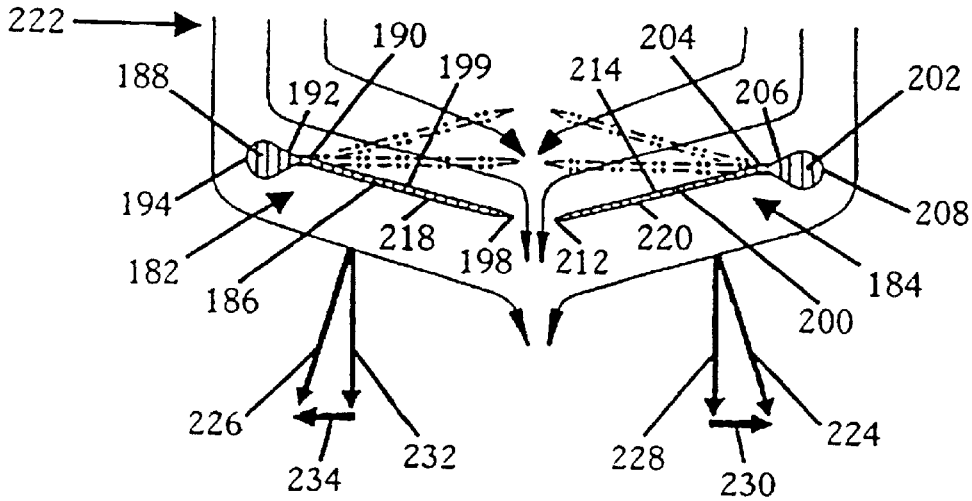
FIG. 10 shows a cross sectional view taken along the line 9—9 from FIG. 9.

FIG. 10 shows a cross sectional view taken along the line 10—10 of FIG. 9. In FIG. 10, stiffening member 188 and stiffening member 202 are both seen to have a hydrofoil shape. Both outer edge 194 and outer edge 208 are rounded while both inner edge 192 and inner edge 206 are tapered and relatively narrow. Flexible portion 186 and flexible portion 200 are seen to be generally planar in form and are significantly thinner than stiffening member 188 or stiffening member 202. Inner edge 198 and inner edge 212 are relatively sharpened. The majority of tapering across right blade half 182 and left blade half 184 is seen to occur along stiffening member 188 and stiffening member 202, respectively. On flexible portion 186, a lower surface 218 is seen opposite from upper surface 199. On flexible potion 200, a lower surface 220 is opposite from upper surface 214.

This view shows how right blade half 182 and left blade half 184 deform during use. An oncoming flow 222 is displayed by a series of streamlines flowing around right blade half 182 and left blade half 184. Flexible portion 186 and flexible portion 200 are deflected downward because the swim fin is being kicked upward so that upper surface 199 and upper surface 214 are the attacking surfaces. The horizontal broken lines indicate the positions of flexible portion 186 and flexible portion 200 while they are at rest. The upwardly deflected broken lines indicate the position of flexible portion 186 and flexible portion 200 when the stroke is reversed and the swim fin is kicked downward so that lower surface 218 and lower surface 220 are the attacking surfaces.

The streamlines traveling next to lower surface 218 and lower surface 220 are flowing in a smooth and attached manner. This generates a lift vector 224 on left blade half 184, and generates a lift vector a 226 on right blade half 182. Lift vector 224 has a vertical component 228 and a horizontal component 230. Lift vector 226 has a vertical component 232 and a horizontal component 234.

Figure 11:
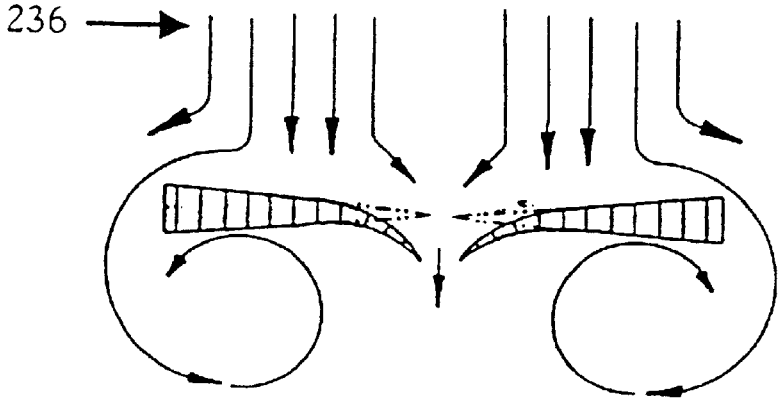
FIG. 11 PRIOR ART
FIG. 11 shows a comparative cross sectional view of a prior art swim fin having side by side blades that taper evenly toward each other.

FIG. 11 shows a comparative cross sectional view of the tapered prior art blade-halves used in both German patent 259,353 to Braunkohlen (1987) and French patent 1,501,208 to Barnoin (1967). Although the many problems of these designs are discussed previously in the Background—Description of Prior Art section of this specification, FIG. 11 offers the ability to visualize the undesirable flow conditions which they create. Because the blades of these prior art designs have similar cross sectional shape, FIG. 11 is able to show the problems inherent to both designs. For comparative purposes, the prior art sectional view in FIG. 11 is taken from a similar orientation as the sectional view shown in FIG. 10 which is taken along the line 10—10 from FIG. 9.

In FIG. 11, the prior art blades are seen to flex differently than those shown in FIG. 10. In FIG. 11, an oncoming flow 236 is displayed by a series of streamlines which identify undesirable flow conditions around the flow the prior art blade halves.

Figure 12:
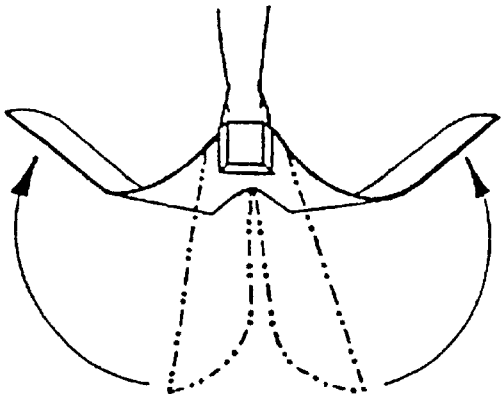
FIG. 12 PRIOR ART
FIG. 12 shows a top perspective view of the spreading apart effect exhibited during use by prior art fin designs that have the cross sectional shape displayed in FIG. 11.
Figure 13:
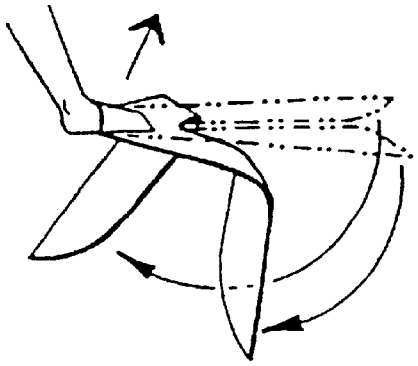
PRIOR ART FIG. 13
FIG. 13 shows a perspective side view of the prior art swim fin shown in FIG. 12 as it collapses around a substantially transverse axis.

FIGS. 12 and 13 show perspective views of the deformation problems encountered by a swim fin having the structural inadequacies of the prior art blade halves shown in FIG. 11 when such blade halves are highly flexible. Although Braunkohlen's prior art design is intended to be used by both feet in one fin with a dolphin type kicking stroke, the main problems with his design lie within the structural inadequacies existing within his blade designs, and not with the foot attachment apparatus. Such structural inadequacies in blade designs are shared by both Braunkohlen's and Barnoin's blade designs. For this reason, the same severe structural inadequacies shared by both designs are displayed in FIGS. 12 and 13 as one simplified embodiment. FIG. 12 shows a top perspective view of such a prior art swim fin spreading apart in a spanwise manner during use. FIG. 13 shows a side perspective view of the same swim fin shown in FIG. 12 except that its blades are seen to bend backward around a substantially transverse axis during use. Just as FIG. 11 shows the problems created when the prior art blades are made of a significantly rigid material, FIGS. 12 and 13 show the problems the same prior art design creates when the blades are made out a highly flexible material.

Operation—FIGS. 9 to 13

The embodiment shown in FIGS. 9 and 10 is designed to permit right blade half 182 and left blade half 184 to twist along a substantially lengthwise axis. This embodiment uses the same fundamental methods for generating lift that are described in FIGS. 5 to 7 except that in FIGS. 9 and 10, the blades are able to twist so that they can achieve an anhedral orientation during each reciprocating stroke.

The structure of this embodiment permits right blade half 182 and left blade half 184 to bend efficiently around a substantially lengthwise axis during use so that they can attain a twisted form. Right blade half 182 and left blade half 184 are preferably made of a material that can be relatively rigid when it is substantially thick, and relatively flexible when it substantially thin. This allows stiffening members 188 and 202 to be substantially rigid while portions 186 and 200 are substantially flexible. For instance, a fiber reinforced thermoplastic having an appropriate variance in thickness may be used. Any suitable material or combinations of materials may be used as well in any suitable arrangement to produce such desired results. The rapid decrease in thickness near the outer side edges of each blade half enables flexible portion 186 and flexible portion 200 to deform significantly near these outer side edges. This is because such rapid tapering substantially reduces anti-bending stress forces along outer edge 190 of flexible portion 186, as well as along outer edge 204 of flexible portion 200. Since deformation can occur substantially close to the outer side edges of each blade half, separation is significantly reduced along the low pressure surface of each blade. This significantly increases lift and decreases drag. Preferably, flexible portion 186 and flexible portion 200 are made sufficiently flexible to bend to a significantly lowered angle of attack during relatively gentle kicking strokes. Experiments show that such high levels of flexibility are necessary to reduce stall conditions and generate lift.

The rapid change in thickness near the outer side edges of each blade half also permits stiffening members 188 and 202 to remain substantially thick and rigid while flexible portions 186 and 200 are made significantly thin and highly resilient. In alternate embodiments, outer edges 190 and 204 can be thinner that the rest of flexible portions 186 and 200, respectively. This can further increase flexibility by further reducing the volume of material that must succumb to bending stresses near stiffening members 188 and 202.

In FIG. 9, stiffening members 188 and 202 are seen to taper in thickness along their lengths toward trailing tips 195 and 216, respectively. This permits the trailing portions of each blade half to experience increased flexibility so that a whip-like action is created during use. As the trailing portions of each blade arch backward, lift vectors 224 and 226 can become tilted slightly forward toward the swimmer's intended direction of travel. The flexibility of these trailing portions should not be so great as to significantly reduce the lengthwise twisting moment within each blade, nor should it create undesirable levels of lost motion or spanwise spreading. Sufficient levels of rigidity should be maintained along the entire length of stiffening members 188 and 202 to prevent excessive levels of deformation from occurring. The tapered shape of stiffening members 188 and 202 also reduces separation near the trailing portions of each blade half by providing a more streamlined hydrofoil shape near these trailing portions.

Many variations of this embodiment are possible. Stiffening members 188 and 202 can maintain constant thickness and, or rigidity along their lengths. If any tapering or change in rigidity is used, it may occur in a series of steps along the length of each blade. A small zone of decreased thickness may be created near foot pocket 180 to permit the base of stiffening members 188 and 202 to achieve some degree of backward bending capability around a transverse axis near foot pocket 180.

Other alternate embodiments can include the use of multiple materials within each blade half. Flexible portion 186 and stiffening member 188 can be made of two different materials joined together with a mechanical and, or chemical bond. The same situation can apply for flexible portion 200 and stiffening member 202. By using more rigid materials for stiffening members 188 and 202, their thickness can be reduced to improve the efficiency of the hydrofoil shape. This allows the change in each blade's cross sectional shape to be reduced without decreasing the change in flexibility between stiffening member 188 and flexible portion 186, as well as between stiffening member 202 and flexible portion 200. Also, stiffening members 188 and 202 may be made of a group of materials. This can include the use of reinforcement members, beams, struts, wires, rods, tubes, ribs, and fibers.

In FIG. 9, stiffening members 188 and 202 are seen to be highly swept and diverge away from each other along their length. The degree of sweep used in the alignments of stiffening members 188 and 202 may be varied according to desire. If less sweep is desired, members 188 and 202 may diverge away from each other at an increased rate. If each fin is intended to be used independently by each of the user's feet and members 188 and 202 are intended to be highly divergent, the length of each blade half can be reduced to decrease the span of each swim fin so that the fins do not collide with one another during use. In this situation, it is preferred (but not required) that the outer portions of stiffening members 188 and 202 become highly swept. It is also preferred that at least the outer portions of stiffening members 188 and 202 are sufficiently swept back enough for the blade halves to twist anhedrally in an amount effective to significantly reduce the occurrence of outward directed spanwise cross flow conditions along the attacking surface of the blade halves.

Other alternate embodiments can include using both of the user's feet within one swim fin for use in a porpoise-like kicking motion. This type of use enables the span (and overall dimensions) to be significantly increased if desired. This is because collisions with another fin is avoided by using a solitary fin. In such a situation, right blade half 182 and left blade half 184 can be located on the outer ends of a substantially transversely aligned wing-like hydrofoil. This would form two highly swept trailing tips on each end of the transverse hydrofoil. The streamwise length of the blade halves can be varied according desire on different embodiments. The anhedral orientations achieved by blade halves 182 and 184 as they twist around a lengthwise axis during use can significantly reduce induced drag vortex formation on either side of such a transverse hydrofoil. The lift vectors produce by the reduced angle of attack achieved by blade halves 182 and 184 can also significantly increase the lift generated by the transverse hydrofoil. The transverse hydrofoil can also be swept back to any desired degree. Any desired spanwise dimensions or aspect ratios can be used.

FIG. 10 shows a sectional view taken along the line 10—10 from FIG. 9. The view show in FIG. 10 illustrates that the blades are able to twist around a substantially lengthwise axis to a significantly reduced angle of attack while the positions of stiffening members 188 and 202 remain significantly stable during a kicking stroke. Such twisting is seen to occur significantly close to the outer side edge of blade halves 182 and 184. This is possible because a significantly large change in thickness on blade halves 182 and 184 occurs significantly close to outer edges 194 and 208. This rapid change in thickness permits a rapid change in flexibility to also occur near these locations. As a result, a significantly high degree of flexibility occurs at the junction of flexible blade portion 186 and stiffening member 188, as well as at the junction of flexible blade portion 200 and stiffening member 202. Because the spanwise dimensions of blade portions 186 and 200 are significantly large in comparison to the spanwise dimensions of blade halves 182 and 184, respectively, blade portions 186 and 200 are able to exert a significantly large amount of leverage upon their junction to stiffening members 188 and 202, respectively.

Similarly, the rapid increase in thickness occurring between inner edge 192 and outer edge 194 of stiffening member 188, as well as between inner edge 206 and outer edge 208 of stiffening member 202, permits a large increase in rigidity to occur within stiffening members 188 and 202. Some flexibility may be permitted to exist within stiffening members 188 and 292 so long as such flexibility does not cause substantially large levels of lost motion to occur which significantly reduce performance. It is preferred that stiffening members 188 and 202 are sufficiently rigid enough to prevent blade halves 182 and 188 from deforming excessively during use. It is also intended that any deformation exhibited during use along the lengths of stiffening members 188 and 202 does not occur in an amount or manner which may significantly inhibit flexible blade portions 186 and 200 from efficiently deforming in an anhedral manner.

Preferably, the degree of rigidity should be selected to significantly reduce the tendency for blade half 182 and 184 to bend backward around a substantially transverse axis during use under the exertion of vertical component 232 of lift vector 226, and under the exertion of vertical component 228 of lift vector 224, respectively. It is also preferred that the degree of rigidity should be selected to significantly reduce the tendency for blade half 182 and 184 to spread apart from each other in a substantially sideways manner during use under the exertion of horizontal component 234 of lift vector 226 and horizontal component 230 of lift vector 224, respectively. This significantly reduces the degree of lost motion existing between strokes. It also enables each blade half to substantially maintain orientations that efficiently generate significantly high levels of lift.

Furthermore, such rigidity enables the lift generated by blade half 182 and blade half 184 to be efficiently transferred onto foot pocket 180 which in turn pushes forward upon the swimmer's foot for propulsion.

In FIG. 10, oncoming flow 222 is illustrated by a series of streamlines flowing around blade halves 182 and 184. The streamlines curving around stiffening members 188 and 202 toward lower surfaces 218 and 220, flow in a smooth and attached manner. This permits high levels of lift to be efficiently generated on blade halves 182 and 184. Also, the streamlines flowing along upper surfaces 199 and 214 flow in an inward direction toward the recess between the blades. This illustrates that outward directed spanwise cross flow conditions have been significantly reduced. Because the streamlines above and below blade halves 182 and 184 are able to merge in a constructive manner, lift is efficiently generated. This is because such a merging causes the water flowing a greater distance around the lee surface of each blade half to flow at a faster rate in order to keep up with the water flowing a shorter distance across the attacking surfaces of the blades. This increase in flow speed along the lee surfaces causes the water flowing across these surfaces to experience a decrease in pressure. It is this decrease in pressure which creates lift on the blades.

The presence of inward flowing streamlines above upper surfaces 199 and 214 demonstrate that fluid pressure is increasing above these surfaces. This combines with the low pressure field generated below lower surfaces 218 and 220 to further increase lift by increasing the overall difference in pressure existing between the attacking surfaces and the lee surfaces of the blades. Some of the streamlines are seen to pass through the recess existing between inner edges 198 and 212. Such movement through this recess permits flow exiting the attacking surfaces to merge with the flow exiting the lee surfaces, thereby making lift generation possible according to Bernoulli's principle. In addition, this passage of water through the recess also permits excess back pressure along the attacking surfaces to be vented through this recess. This prevents such back pressure from building up to levels which cause the flow along the attacking surfaces to back up and expand in an outward spanwise direction.

Because outward spanwise cross flow conditions are significantly reduced, or even eliminated along the attacking surfaces, the water flowing across these surfaces is efficiently jettisoned in a focused manner toward the trailing edges of the blades. This significantly increases forward propulsion when combined with lift generating attached flow conditions along the lee surfaces of the blades. The streamlines shown in FIG. 10 which are flowing in an inward direction along upper surfaces 199 and 214, are also flowing at a significantly fast rate toward the trailing edges of the blades (out of the plane of the paper toward the viewer). The ratio of inward spanwise directed flow to aftward directed flow can be varied according to desire.

Wind tunnel tests of smoke trails flowing around blade designs using the flow control methods of the present invention demonstrate significantly reduced levels of outward spanwise cross flow conditions along the attacking surfaces of the blades. In addition, these tests demonstrate that substantially high levels of attached flow conditions occur along the lee surfaces of the blades. Comparative smoke trail tests of many prior art blade designs show that significantly high levels of outward spanwise flow conditions occur along their attacking surfaces. Such comparative tests of prior art designs also show that significantly high amounts of flow separation and induced drag vortex formation along their lee surfaces.

Wind tunnel tests of models employing the flow controlling methods of the present invention show that many variations can be created within both the spanwise cross flow conditions and the aftward directed flow conditions that exist along the attacking surfaces of the blades. By manipulating various variables each of these flow conditions and their ratio to each other can be varied. For instance, a controlled reduction in the size of the recess that exists during use can cause the streamlines flowing along the attacking surfaces to flow straight in an aftward direction toward the trailing edges of the blades without experiencing either inward cross flow conditions toward the recess, or outward cross flow conditions toward the outer side edges of the blades. In this situation, the orientation of the blades and the size of the recess are trimmed to permit high levels of aftward flow to occur across the attacking surfaces without the presence of noticeable cross flow conditions. The size of recess is trimmed to drain back pressure out of the center region between the blades in an amount effective to prevent outward directed spanwise cross flow conditions from occurring. By increasing the size of the recess that exists during use (this can be achieved by allowing the blades to twist to a more anhedral orientation), the streamlines can be made to converge toward the recess with inward directed spanwise cross flow conditions. This can increase the potential speed with which the blades can be moved through the water since an increase in the recess's flow capacity permits the maximum back pressure the recess can handle is also increased. This is beneficial because an increase in flow speed creates a corresponding increase in lift generated along the low pressure surfaces of the blades.

Many variables contribute to a particular ratio of spanwise cross flow conditions to aftward directed flow conditions. These include the lengthwise angle of attack of the blades (controlled by the lengthwise alignment of stiffening members 188 and 202), the transverse angle of attack of the blades (substantially controlled by the ease of pivoting around a transverse axis as well as by the overall range of motion that is achievable during use), the overall shape, contour, width, and length of the recess existing both at rest and during use, the speed and direction of the blade moving through the water (substantially controlled by the strength and direction of the blade through the water), and the strength of the lifting force generated by the blades (substantially controlled by the quality and orientation of attached flow conditions along the lee surfaces of the blades, as well as the shape, contour, texture, degree of sweep, and size of the blades).

In alternate embodiments, many of these variables and their controlling factors can be manipulated and changed according to desire and combined in any manner. If desired, some or all of these variables can be made continuously adjustable to enable the user to make fine tune adjustments or dramatic changes according to their individual preferences. The lengthwise angle of attack exhibited by the blades is substantially controlled by the lengthwise alignment of stiffening members 188 and 202. Alternate embodiments can have stiffening members 188 and 202 pivotally attached to foot pocket 180 in a manner that permits them to pivot around a transverse axis relative to foot pocket 180 through a predetermined range of motion. This would enable stiffening members 188 and 202 to pivot along their length to create a lengthwise reduced angle of attack during use. This pivotal action is often observed in marine mammals and fish. In order to minimize lost motion during this pivoting, the range of motion can be limited to significantly small levels. For instance, the amount of time used during each stoke to vary the lengthwise angle of attack can be arranged to coincide with the time the blades take to pivot to a transverse reduced angle of attack around a lengthwise axis (anhedral pivoting). Once stiffening members 188 and 202 have pivoted to their desired range limit, a suitable stopping device may be used to halt all other movement (either gradually or immediately). It is intended that such a stopping device have sufficient strength and rigidity to permit the blades to maintain orientations effective in generating lift while efficiently transferring such lift from the blades to foot pocket 180 so that propulsion is maximized. Also some degree of resistance or spring-like tension can occur within a given range of motion as stiffening members 188 and 202 experience lengthwise pivoting. This allows advantageous flow conditions to occur while stiffening members 188 and 202 are pivoting through their limited range of motion. Such spring-like tension can also serve to snap stiffening members 188 and 202 back to a neutral orientation at the end of a stroke.

Wind tunnel tests of blade designs employing the methods of the present invention which show significant reductions in outward spanwise flow conditions also show that flow conditions beyond the fin's trailing edges are also significantly improved over the prior art. In tests with prior art designs, any streamlines that are able to flow past the trailing edge are quickly redirected with the direction of the surrounding flow.

However, in tests with designs using the flow control methods of the present invention, almost all of the smoke trails flowing above the attacking surface are deflected in a direction that is substantially parallel to the lengthwise alignment of the blades. These smoke trails are then projected a significantly farther distance into the free stream than that achieved by prior art designs before becoming re-aligned with the-downstream movement of the surrounding flow. This shows a substantial increase in flow velocity and momentum within the fluid ejected from the trailing edges of blade designs of the present invention in comparison to the prior art.

Because the methods of the present invention permit advantageous cross flow conditions to be created along the attacking surfaces of the blades while attached flow conditions are permitted to form along the lee surfaces of the blades, significantly high levels of propulsion can be attained. While advantageous flow conditions along the attacking surfaces can improve performance, test models of working swim fins show that the main factor affecting overall propulsion is the degree of flow separation along the lee surfaces. As lee surface separation and induced drag vortex formation is replaced by attached flow conditions, propulsion is significantly increased. Test models with swim fins having blades that exhibit stall conditions offer little or no propulsion, while test models of the present invention having blades with attached flow conditions along their lee surfaces offer significantly high levels of propulsion. The methods of the present invention succeeds in achieving significant reductions in lee surface flow separation and induced drag formation while where prior designs fail to do so.

FIGS. 11 to 13 show several problems of prior art dual blade designs which are solved by the present invention. FIG. 11 shows the substantially limited anhedral bending capabilities exhibited by evenly tapered blade halves. The evenly tapered blades made from a single type of material permit only a gradual change in flexibility to occur. Because this change in flexibility occurs over a significantly large distance, bending tends to occur a significantly long distance from the outer side edge of each blade half. The significantly large volume of material used within a gradually tapering cross sectional shape substantially increases the material's resistance to bending. This is because it increases the amount of material that must succumb to the stress forces of compression and tension before any such bending can occur.

Because of these disadvantages, the evenly tapered cross sectional shape of each blade half shown in FIG. 11 is highly inefficient at bending around a significantly lengthwise axis. If the blade halves are made rigid enough to avoid excessive backward bending around a transverse axis under the pressure of oncoming flow 236 during use, the blades are too rigid to experience significant bending around a lengthwise axis. As a result, only a small portion of each blade half is seen to deform in an anhedral manner around a lengthwise axis under water pressure generated during use. The broken lines show the resting position of each blade half. Because a majority of each blade half remains at an excessively high angle of attack relative to oncoming flow 236, the blades stall during use. This prevents lift from being generated.

The streamlines of oncoming flow 236 shown in FIG. 11 display the undesirable flow conditions existing around the prior art blade halves. Although a small amount of water is channeled toward the space between the blade halves, the high angle of attack existing across a majority of the each blade's span prevents water from being efficiently focused away from the outer side edge of each blade half. This causes water pressure to quickly back up along the attacking surfaces (the upper surfaces in this view) and spill sideways around the outer side edges of the blades. As the streamlines curve around these outer side edges, the flow is seen to separate from the lee surfaces (the lower surfaces in this view) of the blades. This forms a significantly large induced drag vortex below the lee surface of each blade half. The induced drag vortices draw water away from the attacking surface at an increased rate. The separation destroys lift and creates high levels of drag. In addition, the induced drag vortices are seen to curl the water so that it flows back toward the lee surfaces of each blade half. This curling water pushes against the lee surfaces of the blade halves in the opposite direction of desired lift. Experiments with test models show that substantially rigid blades having the structural inadequacies shown in FIG. 11 suffer from significantly high levels of drag and do not offer significant levels of propulsion.

FIG. 12 shows a top view of a swim fin during use which suffers from the same structural problems of the prior art discussed in FIG. 11, except that the blades shown in FIG. 12 are made from a more flexible material than the blades shown in FIG. 11. When the blade halves shown in FIG. 11 are made more flexible so that they are more able to deform in an anhedral manner around a lengthwise axis, the blade halves become highly vulnerable to the type of deformation illustrated in FIG. 12.

In FIG. 12, the broken lines show the position of the prior art type blades while they are at rest. The solid lines show that the blades deform significantly in a spanwise manner during use. From this top view, the swim fin is being kicked toward the viewer. The curved arrows show each blade's direction of movement as the swim fin is kicked after being at rest.

The spread apart orientation illustrated in FIG. 12 results because increasing the flexibility of each blade half reduces the ability for each blade to resist the outward force created by the inward flowing water near the space between the blades. Also, Because such an increase in flexibility permits the blades to experience more anhedral deformation during use, more water is deflected in an inward direction toward the space between the blades. This in turn significantly increases the force with which this inward moving water pushes in an outward spanwise direction upon the blade halves. As a result, the greater the degree of anhedral deformation, the greater the degree to which the blade halves spread apart from each other during use. If each blade is made flexible enough to permit significant levels of anhedral bending around a lengthwise axis, it is not rigid enough to avoid destructive spanwise deformation. As discussed in the Background—Description of Prior Art section of this specification, such spanwise spreading destroys the efficiency of the swim fin.

FIG. 13 shows a perspective side view of the same swim fin shown in FIG. 12 as it is kicked upward during use. While FIG. 12 shows the blades spreading outward, the view in FIG. 13 shows that the blades also tend to simultaneously bend backward around a transverse axis during use. The broken lines show the position of the blades at rest. The arrow above the user's foot shows the direction of the kicking stroke. The curved arrows show each blade's direction of movement as the swim fin is kicked forward after being at rest. Such backward bending occurs because the structure of each blade is highly vulnerable to bending around a transverse axis when it is made flexible enough to experience significant anhedral deformation along its length.

Experiments with test models having the structural inadequacies shown in FIGS. 12 and 13 demonstrate that such dramatic levels of undesirable deformation occur commonly when highly resilient materials are used. Such experiments show that propulsion is poor for blades having these deformation problems. Experiments also show that merely increasing the rigidity of the material used for each blade, only causes a larger portion of each blade to remain at an excessively high angle of attack which causes stall conditions that destroy lift and generate high levels of drag. These problems render such prior art designs unusable.

Looking back to the embodiment of the present invention shown in FIGS. 9 and 10, it can be seen that the combination of significantly rigid stiffening members 188 and 202 with highly resilient flexible blade portions 186 and 200, respectively, efficiently solve the performance debilitating structural problems inherent to the prior art. Unlike the prior art, the methods of the present invention provide the blades with sufficient flexibility to twist in an anhedral manner around a significantly lengthwise axis while providing sufficient rigidity to permit the blades to substantially maintain their orientations during use. This permits drag producing stall conditions to be replaced by lift generating attached flow conditions on each blade. In addition, the blades have enough structural integrity to efficiently transfer their newly derived lift to foot pocket 180 so that the swimmer is propelled forward. By significantly reducing the occurrence of spanwise spreading and backward bending during use, the methods of the present invention permit lost motion to be significantly reduced as well.

Not only did Barnoin and Braunkohlen not offer methods for establishing lift generating attached flow conditions along the lee surfaces of their blade designs, they did not mention that they were aware that this is necessary, nor did they mention that they were aware that their blades create high levels of drag from high levels of stall conditions and induced drag vortex formation. Not only did Barnoin and Braunkohlen not offer any methods for preventing their blades from spreading apart in a spanwise direction, neither of them mentioned that they were aware that such a problem existed with their designs. They also did not mention that they were aware that the use of highly resilient and deformable materials renders their blades highly vulnerable to excessive levels of lost motion due to backward bending around a transverse axis.

Description—FIGS. 14 to 23

Figure 14:
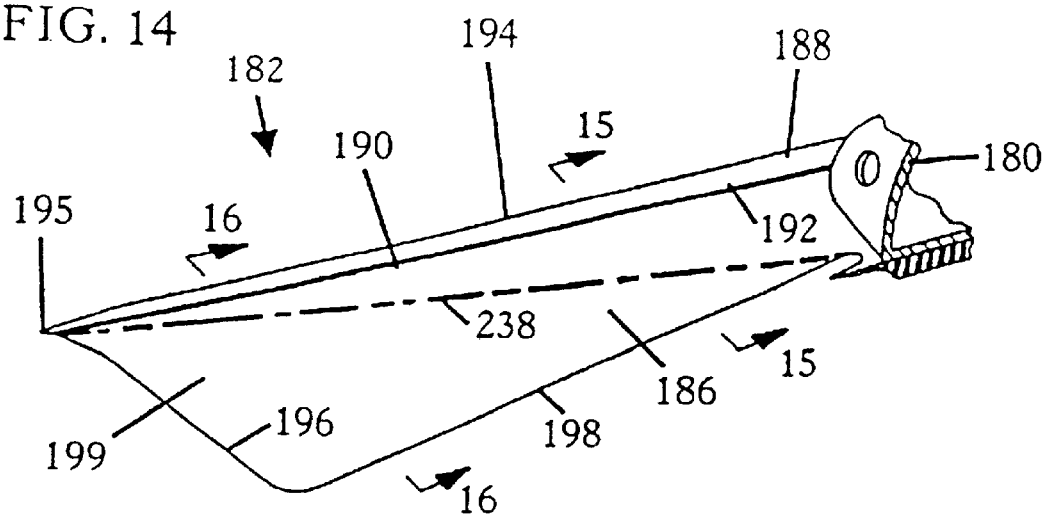
FIG. 14 shows a perspective cut-away view which displays the right half of the same swim fin shown in FIG. 9.

FIG. 14 shows a cut-away perspective view displaying the right half of the same swim fin shown in FIG. 9. Because both blade halves of this embodiment function in the same manner, FIG. 14 solely describes the right half. Also, the cut-away view in FIG. 14 allows one to see the significantly thick portion of flexible portion 186 that extends below foot pocket 180 to form the sole of foot pocket 180 (discussed previously in FIG. 9). Another reason why only the right blade half is shown is because this design may also be used with only one blade half and no other companion blades or blade halves. Such an embodiment is similar to that shown in FIGS. 1–4 except that a flexible blade is provided in the figures below to permit the angle of attack to be changed on each reciprocating stroke. Alternate embodiments may employ any desirable number of additional blades in any desirable arrangement or configuration. How ever, the preferred embodiment will employ two substantially symmetrical blade halves.

In FIG. 14, a broken line shows the presence of a bending zone 238 along flexible portion 186 which extends from the base of the center recess near foot pocket 180 to trailing edge 196 near trailing tip 195.

Figure 15:
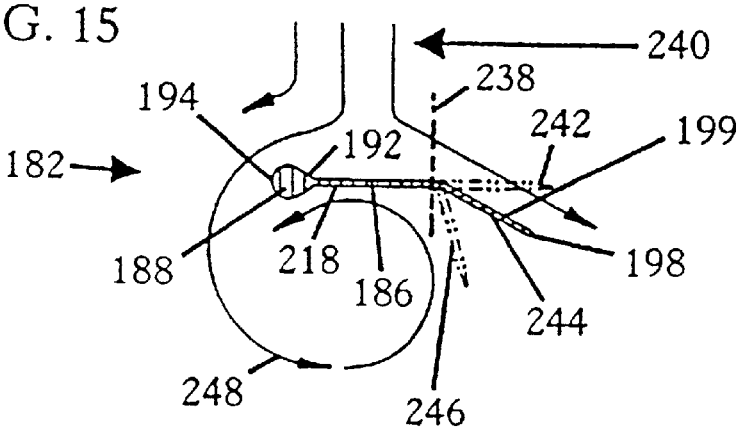
FIG. 15 shows a cross sectional view taken along the line 15—15 from FIG. 14.

FIG. 15 shows a cross sectional view taken along the line 15—15 from FIG. 14. In FIG. 15, bending zone 238 is displayed by a vertically oriented broken line extending above and below the plane of 186. Bending zone 238 is shown in this manner so that its position on flexible portion 186 may be seen from this cross sectional view. An oncoming flow 240 is displayed by a series of streamlines flowing toward and around right blade half 182. A neutral position 242 of flexible portion 186 is displayed by horizontally aligned broken lines. A semi-flexed position 244 of flexible portion 186 is displayed by downward angled solid lines. A highly flexed position 246 of flexible portion 186 is displayed by downward angled broken lines. The deformation of blade half 182 to flexed positions 242 and 246 occur as the swim fin is kicked upward through the water with upper surface 199 being the attacking surface. It can be seen that the deformation of flexible portion 186 from neutral position 242 to either semi-flexed position 244 or highly flexed position 246 occurs between bending zone 238 and inner edge 198. The portion of flexible portion 186 existing between bending zone 238 and stiffening member 188 remains substantially stationary relative to the orientation of stiffening member 188 under the exertion of oncoming flow 240. As the streamlines of oncoming flow 240 pass around the outside of stiffening member 188 when flexible portion 186 is deformed to position 244, a zone of separation 248 is formed along the low pressure surface of right blade half 182.

Figure 16:
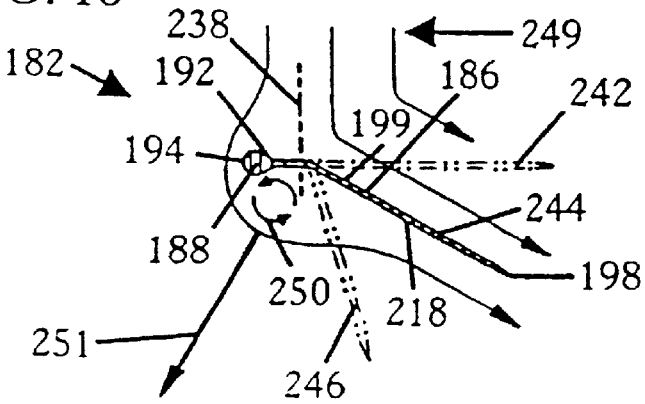
FIG. 16 shows a cross sectional view taken along the line 16—16 from FIG. 14.

FIG. 16 shows a cross sectional view taken along the line 16—16 from FIG. 14. This sectional view taken at line 16—16 from FIG. 14 occurs closer to trailing edge 196 than the sectional view taken along the line 15—15 from FIG. 14, and also occurs closer to foot pocket 180 than the sectional view taken along the line 10—10 from FIG. 9. In FIG. 16, an oncoming flow 249 is displayed by two streamlines flowing toward and around right blade half 182 as the swim fin is kicked through the water during the same upward stroke as that occurring in FIG. 15. Thus, oncoming flow 249 in FIG. 16 is produced by the same kicking motion used to form oncoming flow 240 shown in FIG. 15. In FIG. 16, positions 242, 244, and 246 of flexible portion 186 are the same as those shown in FIG. 15, except that in FIG. 16 these positions are taken along the line 16—16 from FIG. 14. In FIG. 16, position 242 of flexible portion 186 is displayed by horizontally broken lines. Position 244 of flexible portion 186 is displayed by downward angled solid lines. Position 246 of flexible portion 186 is displayed by downward angled broken lines. Again, bending zone 238 is displayed by a vertically aligned broken line so that the position of bending zone 238 on flexible portion 186 can be seen from this view. Because bending zone 238 is substantially close to stiffening member 188, an increased portion of flexible portion 186 is able to deform to either position 244 or position 246 during use.

As the streamlines of 249 flow around the outside of stiffening member 188, a separation zone 250 is formed along the low pressure surface of right blade half 182. Separation 250 is significantly smaller than separation 248 shown in FIG. 15. As a result, the streamline flowing around the outside of stiffening member 188 in FIG. 16 is able to flow substantially parallel to the alignment of semi-flexed position 244 of flexible portion 186. A lift vector 251 is exerted on right blade half 182.

Figure 17:
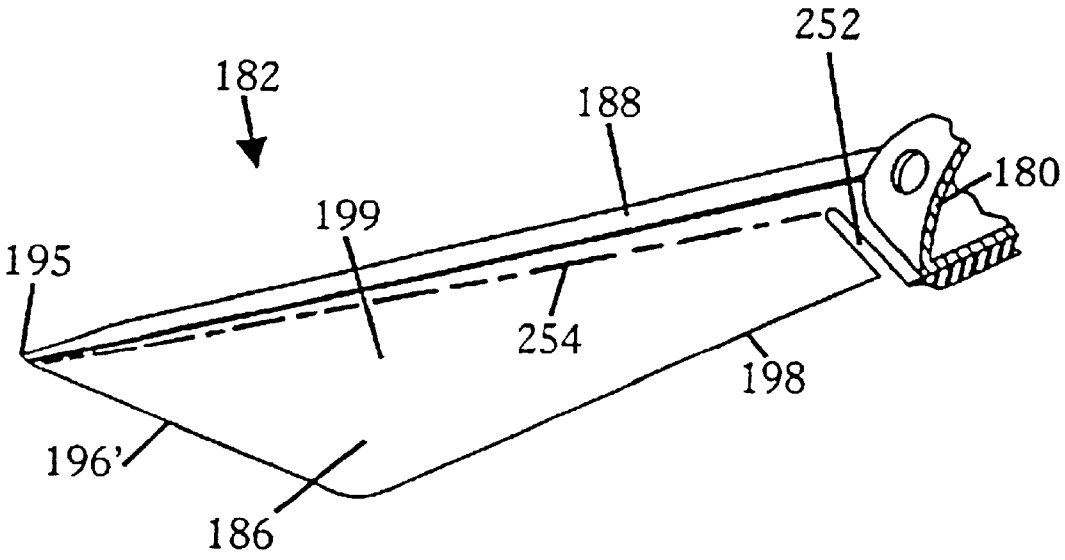
FIG. 17 shows a cut-away perspective view of the same swim fin shown in FIG. 14 except that in FIG. 17, a transverse recess is added to the right blade half near the foot pocket.

FIG. 17 shows a cut-away perspective view of the same swim fin shown in FIG. 14 except that in FIG. 17, a transverse recess 252 is cut out of flexible portion 186 near foot pocket 180, and also a trailing edge 196' is seen to be more swept than trailing edge 196 shown in FIG. 14. In FIG. 17, transverse recess 252 extends in a substantially chordwise direction from inner edge 198 toward stiffening member 188 and terminates before reaching stiffening member 188. A bending zone 254 is represented by a broken line along flexible portion 186 which extends from the outside end of recess 252 to trailing edge 196' near trailing tip 195.

Figure 18:
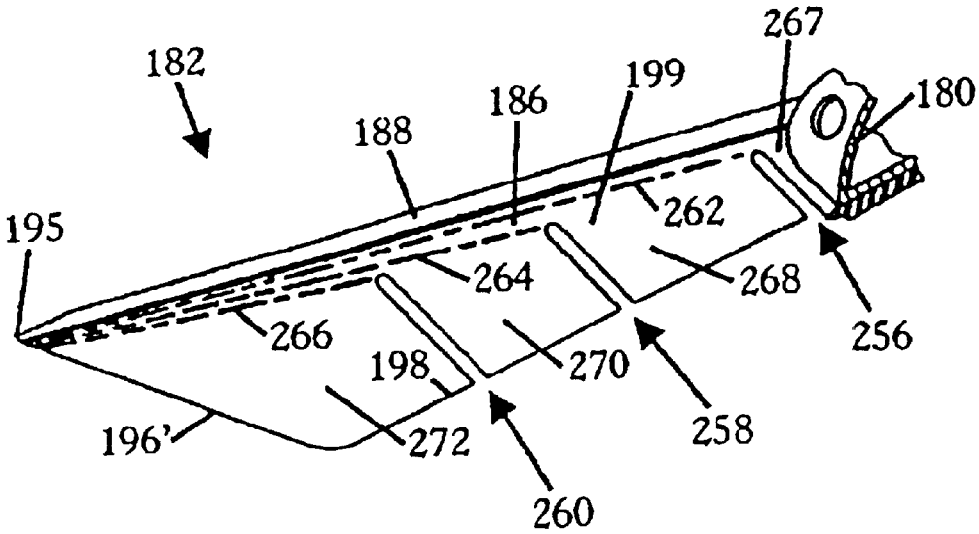
FIG. 18 shows the same view of the same swim fin shown in FIG. 14 except that in FIG. 18, a total of three transverse recesses are added which separate the right blade half into a leading panel, an intermediate panel, and a trailing panel.

FIG. 18 shows a cut-away perspective view of the same swim fin shown in FIG. 14, except that the embodiment shown in FIG. 18 has a forward transverse recess 256, an intermediate transverse recess 258, and a trailing transverse recess 260 cut out of flexible portion 186 at various intervals along inner edge 198. An outer bending zone 262 is displayed by a broken line along flexible portion 186 which extends from the outside end of recess 256 to trailing edge 196' near tip 195. An intermediate bending zone 264 is displayed by a broken line along portion 186 which extends from the outside end of recess 258 to trailing edge 196' near tip 195. An inner bending zone 266 is displayed by a broken line along portion 186 which extends from the outside end of recess 260 to trailing edge 196' near tip 195. Recess 256, recess 258, and recess 260 separate portion 186 into a root portion 267, a forward panel 268, an intermediate panel 270, and a trailing panel 272.

Figure 19:
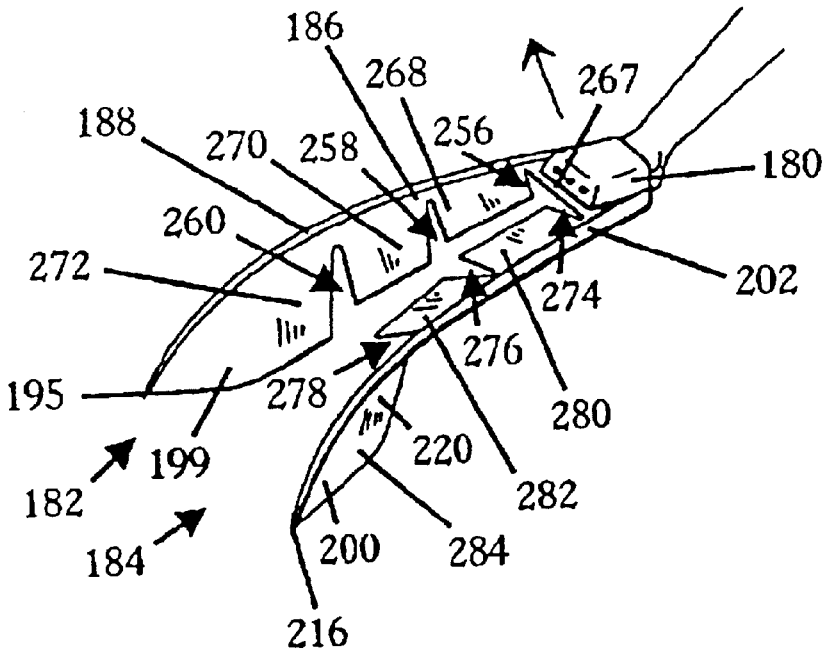
FIG. 19 shows a perspective view of the complete swim fin shown in FIG. 18 while it is being kicked through the water.

FIG. 19 shows a perspective view of the same swim fin shown in FIG. 18 except that in FIG. 19, both halves of the swim fin are shown deforming during use. Because left blade half 184 is now visible from this view, a forward transverse recess 274, an intermediate transverse recess 276, and a trailing transverse recess 278 are seen to exist along flexible portion 200. Recess 274, recess 276, and recess 278 are seen to separate flexible portion 200 into a root portion 267, a forward panel 280, an intermediate panel 282, and a trailing panel 284.

The upwardly inclined arrow located above foot pocket 180 shows that the swim fin is being kicked upward through the water so that the upper surface of each blade half is the attacking surface. During use, forward panels 268 and 280 are seen to deform to an anhedral orientation relative to each other. Intermediate panels 270 and 282 are deformed in an increased anhedral orientation. Trailing panels 272 and 284 are deformed in the most anhedral orientation. As this happens, it can be seen that each transverse recess widens in a divergent manner to form a substantially triangular shaped void. From this view, the highly anhedral orientation of trailing panel 284 causes lower surface 220 of portion 200 to be visible along left blade half 284. Stiffening members 188 and 202 are seen to flex backward under water pressure near tips 195 and 216, respectively.

FIG. 20 shows a perspective side view of the same swim fin shown in FIGS. 18 and 19 except that in FIG. 20, a forward transverse recess 286, an intermediate transverse recess 288, and a trailing transverse recess 290 are substituted for recesses 256, 258, and 260 showy in FIGS. 18 and 19. When comparing FIG. 20 to FIGS. 18 and 19, recesses 286, 288, and 290 in FIG. 20 are seen to extend closer to stiffening member 188 than recesses 256, 258, and 260 shown in FIGS. 18 and 19. In FIG. 20, recesses 286, 288, and 290 separate portion 186 into a root portion 291, a forward panel 292, an intermediate panel 294, and a trailing panel 296. Panels 292, 294, and 296 are seen to be significantly larger than panels 268, 270, and 272 shown in FIGS. 18 and 19.

Another difference existing between FIG. 20 and FIGS. 18 and 19 is that in FIG. 20, significantly flexible chordwise membranes are added to fill the chordwise voids in portion 186 created by recesses 286, 288, and 290. In FIG. 20, a forward transverse flexible membrane 298, an intermediate transverse flexible membrane 300, and a trailing transverse flexible membrane 302 are loosely suspended across recesses 286, 288, and 290, respectively. The outside edges of each flexible membrane is attached to the inside edges of its respective recess in any suitable manner. A mechanical and, or chemical bond may be used to secure these edges together. Examples of mechanical bonds may include a system of small mating protrusions and orifices existing within the joining edges. Such mating features can include holes, grooves, ridges, teeth, wedges, and other similar gripping shapes. Suitable adhesives and, or welds may be used to provide a chemical bond instead of, or in addition to a mechanical bond.

In this embodiment, it is preferred that membranes 298, 300, and 302 are significantly more flexible than portion 186. Membranes 298, 300, and 302 may be made of a highly resilient thermoplastic, however, any flexible material may be used as well. Examples of such flexible materials may include fabric, silicone rubber, silicone thermoplastics, neoprene, rubber or plastic impregnated fabric, fiber reinforced thermoplastics, and fabric reinforced thermoplastics.

The view shown in FIG. 20 shows the position of this embodiment at rest. Each flexible membrane is seen to have a loose fold from extra material. The transversely aligned dotted line extending from the outside end of each membrane to inner edge 198 displays that the amount of extra material used in each membrane increases toward inner edge 198. A bending zone 304 is represented by a broken line along portion 186 that extends from the outside end of recess 286 to trailing edge 196' near tip 195. In this embodiment, the outside ends of both recess 288 and recess 290 terminate at positions along portion 186 that are in alignment with bending zone 304.

FIG. 21 shows a perspective side view of the complete embodiment shown in FIG. 20 while it is kicked through the water during use. The arrow pointing downward beneath foot pocket 180 displays that the swim fin is being kicked downward. Left blade half 184 is closer to the viewer than right blade half 182.

On right blade half 182, lower surface 218 of portion 186 is most visible on panel 296 while being less visible on panel 294 and least visible on panel 292. Membrane 300 is seen to have stretched out to achieve a substantially triangular shape between panels 292 and 294. Membrane 302 has also stretched out to a triangular shape between panels 294 and 296.

Left blade half 184 deforms similarly to right blade half 182 under water pressure. Upper surface 214 of portion 200 is most visible along a trailing panel 310, less visible along an intermediate panel 308, and least visible along a forward panel 306. Between foot pocket 180 and panel 306 is a forward transverse flexible membrane 312 which is barely visible from this view. An intermediate transverse flexible membrane 314 is seen to be stretched to a triangular shape between panel 306 and panel 308. Similarly, a trailing transverse flexible membrane 316 is stretched to a triangular shape between panel 308 and panel 310.

FIG. 22 shows a cut-away perspective view of the same swim fin shown in FIGS. 20 and 21, except that in FIG. 22 a lengthwise flexible membrane 318 is added. FIG. 22 shows that Membrane 318 is a narrow strip of resilient material that separates stiffening member 188 from portion 186. Membrane 318 is seen to merge with membranes 298, 300, and 302. As a result, portion 186 is completely divided into a root portion 319, a leading panel 320, an intermediate panel 322, and a trailing panel 324. The outer edge of membrane 318 (closest to stiffening member 188) is preferably attached to inner edge 192 of stiffening member 188 with a mechanical and, or chemical bond. The inner side edge of membrane 318 (furthest from stiffening member 188) is attached to the outer side edges of panels 320, 322, and 324 in a similar manner.

This embodiment may be injection molded to minimize production time. For example: stiffening member 188, root portion 319, panel 320, panel 322, and panel 324 may be molded first out of one material and then arranged so that foot pocket 180, membrane 298, membrane 300, membrane 302, and membrane 318 can be molded out of a more resilient material into (or onto) their respective parts in a final step of assembly. Any suitable method of construction may be used.

In alternate embodiments, membrane 318 can be separate from one or more of the transverse membranes. In addition, any number of transversely aligned membranes can be used to create any number of segmented panels.

FIG. 23 shows a cross sectional view taken along the line 23—23 from FIG. 22. In FIG. 23, the horizontally aligned broken lines show the position of trailing panel 324 while the swim fin is at rest. An oncoming flow 326 is created as the swim fin shown in FIG. 22 is kicked upward. In FIG. 23, oncoming flow 326 is displayed by two streamlines flowing toward and around right blade half 182. The pressure exerted by oncoming flow 326 causes membrane 318 to deform so that panel 324 becomes inclined to a reduced angle of attack relative to oncoming flow 326. As the two streamlines flow around right blade half 182, a lift vector 328 is formed.

This cross sectional view displays that the outer edge of membrane 318 (closest to stiffening member 188) extends into inner edge 192 of stiffening member 188. Also, the inner edge of membrane 318 (farthest from stiffening member 188) is seen to extend into the outer side edge of 324. This only one example of how such edges may be joined. To strengthen the bond, any suitable arrangement of holes or perforations may be added to one or more of the joining edges of stiffening member 188 and panel 324 so that when membrane 318 is injection molded into them, the material used for membrane 318 fills into such holes or around such perforations to provide a secure grip. Chemical bonds may used as well.

Operation—FIGS. 14 to 23

FIG. 14 shows a cut-away perspective view of the right half of the same swim fin shown in FIG. 9. The cut-away view in FIG. 14 shows that portion 186 increases in thickness below foot pocket 180. As stated previously, it is preferred that this portion of portion 186 is rigidly attached to stiffening member 188. The thickened portion of portion 186 increases the rigidity of the swim fin beneath foot pocket 180 and provides structural support for stiffening member 188. As a result, the kicking motion applied to the swimmer's foot is transmitted to stiffening member 188 in an efficient manner. In alternate embodiments, foot pocket 180 can be made more rigid while portion 186 below foot pocket 180 is made more resilient. In still other embodiments, portion 186 below foot pocket 180 can be flexible while the user's foot inserted within foot pocket 180 stiffens foot pocket 180 in an amount effective to permit the kicking motion to be transferred to stiffening member 188 in an efficient manner. In this situation, the material within foot pocket 180 is made sufficiently strong enough to resist stretching out of shape, and therefore foot pocket 180 is able to stabilize the position of stiffening member 188 during use. It is still preferred, however, that portion 186 becomes substantially more rigid beneath foot pocket 180 as shown in FIG. 14 so that energy is transferred with increased efficiency from stiffening member 188 to the foot of the user.

Since stiffening member 188 makes the outer side edge of right blade half 182 significantly rigid while the thickened area of portion 186 below foot pocket 180 makes the base of right blade half significantly rigid, the more flexible areas of portion 186 existing between bending zone 238, stiffening member 188, and foot pocket 180 are significantly resistant to deforming during use. This is because this triangular shaped region of portion 186 is supported by two rigid structures that provide support in two different dimensions. Because the areas of portion 186 existing between bending zone 238, trailing edge 196, and inner edge 198 are less supported by the swim fin's more rigid structures, these regions of portion 186 are significantly more able to deform under water pressure. Bending zone 238 is therefore an imaginary line that marks a border which separates the more deformable areas of portion 186 from the less deformable areas of portion 186.

Because stiffening member 188 is sufficiently rigid enough to avoid substantial deformation during use, bending zone 238 on portion 186 extends all the way to trailing edge 196 near tip 195. This allows bending zone 238 to have a substantially lengthwise alignment across right blade half 182. Consequently, the rigidity of stiffening member 188 permits portion 186 to bend around a substantially lengthwise axis so that water along the attacking surface is directed away from stiffening member 188 and toward inner edge 198 during use.

Because the rigidity of stiffening member 188 enables bending zone 238 to extend to tip 195, blade half 182 has increased resistance to spanwise or sideways directed bending during use. This is because bending zone 238 marks a zone of tension created within portion 186. When an outward directed force is applied to blade half 182 as portion 186 twists to a reduced angle of attack during use, the outward force tries to stretch the area of portion 186 existing between bending zone 238, foot pocket 180, and stiffening member 188. Because this area contains a substantially large amount of material, resistance to such stretching is relatively high and outward spanwise bending is significantly reduced. Also, because the alignment of bending zone 238 is at an angle to the alignment of stiffening member 188, tension within portion 186 long bending zone 238 is applied at an angle to stiffening member 188. This provides a moment arm which further increases resistance to spanwise bending of stiffening member 188. Also, because bending zone 238 extends all the way to tip 195, the entire length of blade half 182 (including the tip region) has significant resistance to sideways bending. As a result, stiffening member 188 can be made to possess a significant level of flexibility along its length if desired while remaining sufficiently rigid enough to prevent excessive levels of sideways bending from occurring.

FIG. 15 shows a cross sectional view taken along the line 15—15 in FIG. 14. In FIG. 15, it can be seen that portion 186 is significantly more deformable between bending zone 238 and inner edge 198 than it is between bending zone 238 and stiffening member 188. Position 242 shows the orientation of portion 186 when the swim fin is at rest. Position 242 can also occur during use if the material used to make portion 186 is not sufficiently resilient enough to deform significantly under the water pressure generated during use. Position 244 shows the orientation of portion 186 during use when the material used to make portion 186 is significantly flexible. Position 246 shows the orientation of portion 186 during use if the material used to make portion 186 is too flexible.

In this embodiment, position 244 is a more preferable flexed orientation during use than either position 242 or position 246. This is because position 244 achieves a reduced angle of attack without creating an abrupt change in contour across portion 186. Position 246 is undesirable since an abrupt change in contour is created within portion 186 as it bends to an excessively low angle of attack. Consequently, portion 186 is preferably made of an appropriate material and thickness to provide sufficient flexibility so that it can deform to an orientation between the range of position 242 and position 246 when the swim fin is kicked through the water. Preferably, the angle of such orientation is substantially similar to position 244. However, the reduced angle of attack achieved during use can occur at any desirable angle which is capable of offering improvements in performance.

Position 246 is shown in this example to illustrate that the structural characteristics of the swim fin prevent portion 186 from flexing between bending zone 238 and stiffening member 188 even if portion 186 is made of a highly resilient material. It is important to visualize how the position of bending zone 238 influences the deforming characteristics of portion 186. This permits the further improvements described ahead in the specification to be more fully understood and appreciated.

FIG. 16 shows a cross sectional view taken along the line 16—16 from FIG. 14. In FIG. 16, the same positions 242, 244, and 246 shown in FIG. 15 are viewed from another region of portion 186, when comparing FIG. 16 to FIG. 15, it can be seen that in FIG. 16 bending zone 238 is significantly closer to stiffening member 188 than it is in FIG. 15. Consequently, separation 250 shown in FIG. 16 is substantially smaller than separation 248 shown in FIG. 15. This is because in FIG. 16, the region of portion 186 existing between bending zone 238 and stiffening member 188 is significantly smaller than it is in FIG. 15. As a result, the streamline of oncoming flow 249 that is flowing around the outside of stiffening member 188 in FIG. 16 is able to become re-attached to the low pressure surface (or lee surface) of portion 186. The rotational direction of separation 250 also assists in creating attached flow conditions along the low pressure surface of portion 186. This enables this region of right blade half 182 to generate lift vector 251 during use. Consequently, the trailing portions of right blade half 182 are highly efficient at generating lift. This efficiency increases with proximity to tip 195.

Alternate embodiments can create limited flow separation such as shown by separation 250 in FIG. 16 as a method for creating re-attached flow conditions along portions of a blade that are at significantly high angles of attack. This is similar to the intentional formation of leading edge vortices by leading edge vortex flaps on delta wing fighter jets. Vortex generators in the form of ridges can be used to form leading edge vortices in a manner that enables flow to become re-attached further downstream on the foil's low pressure surface. As long as substantially attached flow conditions occur downstream on the foil, lift can be generated efficiently enough to significantly increase propulsion. It is preferred that any separation created along the low pressure surface of blade half 182 is kept within levels that permit attached flow conditions to be created in an amount effective to significantly increase the propulsion created by the blade and to prevent the blades from stalling during use.

In other alternate embodiments, stiffening member 188 can originate near the toe region of foot pocket 180 near the base of the recess and extend forward from the toe in a swept direction that is substantially parallel to bending zone 238. This enables the alignment of stiffening member 188 to be closer to the alignment of bending zone 238 so that the surface area of portion 186 existing between stiffening member 188 and bending zone 238 is significantly reduced. This can significantly reduce the occurrence of flow separation along the low pressure surface of blade half 182 by reducing the surface area of portion 186 that remains at a high angle of attack during use. This decreases drag and increases lift. In this type of alternate embodiment, it is preferred that stiffening member 188 is made from a highly rigid material because such an orientation between stiffening member 188 and bending zone 238 causes tension the created within portion 186 during twisting to be significantly reduced.

FIG. 17 shows a cut-away perspective view of the same swim fin shown in FIG. 14 except that in FIG. 17 recess 252 is cut out of portion 186 near foot pocket 180. Because recess 252 extends a significant distance toward stiffening member 188, bending zone 254 is substantially close to stiffening member 188 along its entire length. Consequently, a greater area of portion 186 is allowed to bend to a reduced angle of attack during use. This allows a greater region of portion 186 to participate in generating lift. Because the size of the area of portion 186 existing between bending zone 254 and stiffening member 188 is reduced, separation along the low pressure surface of right blade half 182 is significantly reduced during use. The combination of these situations permit this embodiment to offer increased propulsion and reduced drag over the embodiment shown in FIG. 14. In FIG. 17, it is preferred that the material used for portion 186 is sufficiently flexible to deform during use to a reduced angle of attack that efficiently generates lift with low levels of drag.

Trailing edge 196' shown in FIG. 17 is significantly more swept than trailing edge 196 shown in FIG. 14 in order to further reduce drag. The more swept trailing edge 196' shown in FIG. 17 permits a smoother transition to occur between trailing edge 196' and inner edge 198. By making this corner more obtuse in form, less turbulence is created at this corner and efficiency is increased. In alternate embodiments, the radius of curvature in this convexly curved corner can be increased to provide a smoother transition between trailing edge 196' and inner edge 198. A significantly larger radius of curvature at this transition between trailing edge 196' and inner edge 198 may be used to further reduce drag and increase efficiency. In other embodiments, trailing edge 196' can be made concavely curved near trailing tip 195, and convexly curved near inner edge 198.

FIG. 18 shows a cut-away perspective view of the same swim fin shown if FIG. 17 except that the embodiment shown in FIG. 18 has recesses 256, 258, and 260 cut out of to 186 at various intervals along inner edge 198. Recess 256 in FIG. 18 is seen to extend slightly closer to stiffening member 188 than recess 252 shown in FIG. 17. This causes bending zone 262 in FIG. 18 to be closer to stiffening member 188 than bending zone 254 shown in FIG. 17. In FIG. 18, recess 258 creates bending zone 264 and recess 260 creates bending zone 266. Consequently, panels 268, 270, and 272 all bend around bending zone 262 during use. Similarly, panels 270 and 272 both bend around bending zone 264, and panel 272 bends around bending zone 266 during use. This permits panel 268 to deform to a reduced angle of attack while panel 270 to deforms to a further reduced angle of attack and panel 272 deforms to the most reduced angle of attack.

In alternate embodiments, one or more of the transverse recesses can have a substantially lengthwise recess located at its outer side end. Such a lengthwise recess can extend forward and, or backward from the base of the transverse recess. This can cause the transverse recess to be substantially L-shaped or substantially T-shaped. Using these shapes to form a transverse recess can further reduce an adjacent panel's resistance to bending around a substantially lengthwise axis. If the lengthwise recess at the base of the transverse recess extends backward (toward foot pocket 180) into a panel, that panel behind the transverse recess can pivot forward around a transverse axis to a reduced angle of attack as it simultaneously twists around the lengthwise bending zone created by that transverse recess. This can improve efficiency by improving attached flow conditions along the low pressure surface of that panel. In other embodiments, any transverse recesses can have a significantly swept alignment.

FIG. 19 shows a perspective view of the same swim fin shown in FIG. 18 except that in FIG. 19, both halves of the swim fin are shown deforming during use. Both right blade half 182 and left blade half 184 are seen to twist along their lengths to a reduced angle of attack. As water pressure applies a twisting force to right blade half 182 and left blade half 184, the voids created by the transverse recesses significantly reduce the formation of anti-twisting stress forces within portion 186 and portion 200. Because each transverse recess is able to widen during use, portions 186 and 200 are permitted to expand under water pressure and the total quantity of material within portion 186 and portion 200 that must succumb to the torsional stress forces of expansion and compression is significantly reduced. Consequently, recesses 256, 258, 260, 274, 276, and 278 provide expansion zones for portions 186 and 200. This enables portion 186 and portion 200 to exhibit significantly decreased levels of resistance to twisting around a substantially lengthwise axis.

Without such expansion zones, the material within portions 186 and 200 would have to stretch an amount similar to that displayed by the expanded transverse recesses shown in FIG. 19. However, a material which lacks such transverse recesses and is capable of stretching such a significantly large amount under a substantially light kicking stroke is structurally weak and highly vulnerable to collapsing to a zero, or near zero angle of attack around a bending zone such as bending Line 238 shown in FIG. 14. In FIG. 19, it can be seen that the use of transverse recesses 256, 258, 260, 274, 276, and 278 permit sufficiently large amounts of expansion to occur across portions 186 and 200 so that substantial twisting results even under relatively light kicking strokes. This permits portions 186 and 200 to be made from a less resilient material that has sufficient structural integrity to not collapse to excessively low angles of attack during such strokes. Thus the strategic placement of expansion zones within portions 186 and 200 permits significantly high levels of twisting to occur under conditions of relatively light pressure with more structurally rugged materials.

As blade halves 182 and 184 twist to reduced angles of attack, the rigidity of stiffening members 188 and 202 reduces the tendency for each blade half to bend backward around a transverse axis or spread apart from each other during use. Consequently, each blade half is able to efficiently twist around a substantially lengthwise axis during use without deforming excessively around a substantially transverse axis and without experiencing excessive levels of spanwise spreading.

In the embodiment shown in FIG. 19, stiffening members 188 and 202 are seen to increase in flexibility near tips 195 and 216, respectively. This is seen as stiffening members 188 and 202 arch backward in a controlled manner under water pressure exerted during use. This allows the direction of lift on panel 272 and panel 284 to become more aligned with the swimmer's direction of travel. Such increased flexibility also produces a whip-like snapping motion to occur near the tips of each blade half as the kicking direction is reversed between strokes. It is preferred that such an increase in flexibility is sufficiently limited to prevent the tip regions of each blade half from experiencing excessive levels of lost motion or sideways spreading. It is also preferred that stiffening members 188 and 202 remain sufficiently rigid enough across their entire length to create a significantly strong twisting moment during use within portions 186 and 200, respectively. It is also intended that stiffening members 188 and 202 are sufficiently rigid enough to permit blade halves 182 and 184 to substantially maintain orientations that are effective in generating significantly high levels of lift as such a lifting force is transferred from stiffening members 188 and 202 to foot pocket 180 during use.

Each blade half's resistance to twisting can be changed by either increasing or decreasing the transverse dimensions of each transverse recess. On right blade half 182 for instance, if the transverse dimensions of each recess is decreased, portion 186 becomes less able to attain a twisted shape during use. This is because the area of portion 186 existing between the outside end of each transverse recess and stiffening member 188 is unable to expand in a sufficient manner to permit this region of portion 186 to twist around a substantially lengthwise axis. However, if the outside end of each transverse recess is extended further toward stiffening member 188, portion 186 becomes less resistant to achieving a twisted shape during use. Because this decreases the amount of portion 186 that exists between the outer end of each recess and stiffening member 188, the total volume of material within portion 186 that must succumb to anti-twisting stress forces is also reduced. Consequently, the longer the transverse dimension of each transverse recess, the lower the resistance of portion 186 to attaining a twisted shape during use. Preferably, the orientation, location, and transverse dimension of each transverse recess on each blade half is selected to provide desirable levels of twist during use. Numerous transverse recesses of differing transverse lengths can be used to provide a wide variety of twisted shapes, forms, and contours in alternate embodiments.

As one or more transverse recesses on each blade half are extended closer to their corresponding stiffening member (member 188 or 202), the rigidity of stiffening members 188 and 202 must be increased. This is because each blade half becomes more vulnerable to spanwise spreading as the transverse dimensions of each recess is increased. This is because the bending zone created by that transverse recess is moved closer to its corresponding stiffening member. This decreases the moment arm of tension within portion 186 and decreases the amount of material existing between the outer end of each recess and the corresponding stiffening member on each blade half. This decreases spanwise tension within portion 186 on blade half 182, and within portion 200 on blade half 184. By decreasing such spanwise tension, each blade half becomes more vulnerable to spanwise spreading during use. This is also due to the increased spanwise direction of lift produced as each blade half is able to twist to a more reduced angle of attack. In such situations, the rigidity of stiffening members 188 and 202 must be increased in an amount effective to significantly reduce the occurrence of spanwise spreading during use. This reduces lost motion and increases the amount of lift transferred from each blade half to foot pocket 180. Stiffening members 188 and 202 can be made more rigid by increasing their thickness, changing their cross sectional shape, by substituting more rigid materials, or by adding reinforcement structures such as fibers, beads, beams, wires, rods, tubes, filaments, woven materials and meshes, or other similarly reinforcing members.

FIG. 20 shows the same swim fin shown in FIGS. 18 and 19 except that in FIG. 20, recesses 286, 288, and 290 are substituted for recesses 256, 258, and 260 shown in FIGS. 18 and 19. In FIG. 20, it can be seen that recesses 286, 288, and 290 all extend significantly close to stiffening member 188 and terminate on bending zone 304. In alternate embodiments, one or more of the transverse recesses can extend all the way to stiffening member 188 so that at least two adjacent panels of portion 186 are completely separated from one another. In FIG. 20, membranes 298, 300, and 302 are seen to bridge the gap formed by recesses 286, 288, and 290, respectively. Because membranes 298, 200, and 302 each have a loose fold within them while the swim fin is at rest, panels 292, 294, and 296 are able deform in a manner that creates a twisted shape across portion 186 during use. This can occur because the loose fold existing in membranes 298, 300, and 302 permits each transverse recess to widen when water pressure deforms each panel on portion 186. Membranes 298, 300, and 302 provide expansion zones within portion 186 that have a continuous material across such zones so that water does not flow through recesses 286, 288, and 290.

In alternate embodiments, a smooth continuous strip can be secured to inner edge 198. A groove can exist within inner edge 198 that has holes, recesses, orifices, or the like within the groove so that when the smooth strip is molded to inner edge 198, it fills into the groove and the corresponding recesses to form a strong mechanical bond. Membranes 298, 300, and 302 can be attached to this smooth strip so that membranes 298, 300, and 302 are molded integrally with this smooth strip. This strip can be used to provide a more secure bond as well as to control differences in shrinkage tendencies existing between membranes 298, 300, and 302 and portion 186. Such a smooth strip can also extend around the entire length of trailing edge 196' and inner edge 198 if desired.

FIG. 21 shows a perspective side view displaying both halves of the embodiment shown in FIG. 20 during use. In FIG. 21, the swim fin is being kicked in a downward direction indicated by the arrow existing below foot pocket 180. It can be seen that as the blade halves deform during use, each transverse recess is permitted to widen as its corresponding transverse flexible membrane expands into a substantially triangular shape. When each transverse membrane becomes fully expanded during use, tension is created within its material. This tension within a given transverse membrane causes its corresponding transverse recess to stop expanding. Thus, the degree of looseness designed into each transverse membrane while the swim fin is at rest substantially determines the amount of deformation that can occur along each blade half during use when a membrane is fully expanded it prevents the recess between adjacent panels from spreading further apart. This benefit can be used to enable portion 186 to twist only to a desired maximum level. Such a restraining system can prevent the blade halves from experiencing excessive levels of deformation during hard kicking strokes, or while the swim fins are used in highly turbulent waters such as large surf or strong currents.

Another benefit to the use of a transverse membrane across each transverse recess is that it creates a more continuous blade shape and reduces turbulence between each segmented panel. In addition, the effective surface area of each blade half is increased. In alternate embodiments, any number of transverse recesses can be used with transverse membranes disposed within them. The more of these systems that are used the smoother the resulting contour that is created as a twisted shape is formed. As more membranes are used, the amount of looseness designed into each transverse membrane may be reduced to make the twisted contour smoother and more gradual during use. If desired, each transverse membrane can be designed without any significant levels of looseness built into it while the swim fin is at rest. The level of looseness within each transverse membrane can also vary between adjacent panels to permit a wide variety of contours to be achieved within the deformed blade halves.

The general purpose of the flexible membrane is to create a strategically placed flexing zone that permits each blade half to twist with reduced levels of resistance during use. The directional alignment, shape, orientation, and placement of such flexing zones may be varied in any desirable manner that significantly reduces each blade halfs resistance to twisting during use.

FIG. 22 shows a cut-away perspective view of the same swim fin shown in FIGS. 20 and 21 except that in FIG. 22 lengthwise flexible membrane 318 is added. Membrane 318 separates the newly formed panels 320, 322, and 324 from stiffening member 188 with a highly flexible material. This significantly increases the ability of panels 320, 322, and 324 to pivot relative to stiffening member 188 when water pressure is applied during use. The material used to make membrane 318 is preferable more flexible than the material used to make panels 320, 322, 324. Consequently, membrane 318 offers less resistance to deformation and increases the efficient movement of panels 320, 322, and 324 to a reduced angle of attack during use. This combines with the high degree of looseness in membrane 298 to permit panel 320 to pivot a significant distance below root portion 319 during use. Because this allows panel 320 to pivot to a substantially decreased angle of attack, significantly high levels of attached flow conditions may be created along an increased region of the low pressure surfaces on blade half 182.

FIG. 23 shows a cross sectional view taken along the line 23—23 from FIG. 22. In FIG. 23, trailing panel 324 deforms during use to a significantly reduced angle of attack. Membrane 318 is seen to extend into inner edge 192 of stiffening member 188 as well as into panel 324. The highly resilient nature of membrane 318 permits it to curve around a significantly small bending radius. This increases the streamlined shape of right blade half 182.

The significantly reduced angle of attack shown by panel 324 in this embodiment significantly reduces separation and increases attached flow along the low pressure surface of right blade half 182. Because the streamline of oncoming flow 326 which passes around the outside of stiffening member 188 is able to flow in a well attached manner, lift vector 328 is efficiently produced. Although the angle of attack of panel 324 is shown to be significantly reduced in FIG. 23, panel 324 may be designed to deform to any desirable angle of attack and contour during use.

In alternate embodiments, each transverse recess and its corresponding transverse membrane does not have to be connected to lengthwise membrane 318. Instead one or more of the transverse recesses and their corresponding membranes can exist separately from membrane 318 so that the two panels adjacent to that transverse recess and membrane are connected near lengthwise membrane 318. Any combination of lengths of membranes and degrees of connectedness between transverse membranes and lengthwise membrane 318 may be used. Any number of such transverse membranes may be used. Also, any number of additional lengthwise membranes may be used as well. In still other embodiments, all or some membranes may be made of the same material as the panels and, or stiffening member 188. In such situations, these membranes are molded at the same time as the rest of the blade, however, they are made much thinner than the rest of the blade. In still other embodiments, panels 320, 322, and 324 can be made out of significantly rigid materials so that all deformation is created by membranes 318, 298, 300, and 302.

Experiments with flexible test model swim fins having the various design characteristics displayed in FIGS. 14 through 23 show dramatic improvements in performance over test model swim fins having the structural inadequacies of the prior art. When the improved swim fin designs of the present invention are designed to permit significant twisting to occur around a substantially streamwise axis while the stiffening members provide sufficient rigidity to maintain efficient lift generating orientations during use, swimming speeds are vastly increased while strain to the leg, ankle, and foot is dramatically reduced. While prior art fin designs (including some of the most popular fin designs currently available) offered cruising speeds (gentle to moderate strength kicking strokes) of approximately 0.75 miles an hour, properly designed swim fins of the present invention offered speeds substantially exceeding 2 miles an hour with the same or even gentler kicking strokes. Many of the swim fin designs of the present invention permit swimming speeds to be achieved that easily exceed 2 miles an hour even if only the swimmer's ankles are kick to and zero leg motion is used. A similar kicking stroke on prior art fins creates high levels of ankle strain and almost zero forward movement.

In addition to increasing propulsion, the swim fin designs of the present invention also offer a dramatic reduction in drag and kicking resistance over the prior art. While the prior art test models create significantly high levels of leg, ankle, and/or foot fatigue within a time period ranging from 1 to 20 minutes of gentle kicking strokes, the properly designed swim fins of the present invention permit hours of continuous use without incurring significant levels of fatigue to the legs or ankles of the swimmer. When significant twisting is allowed to occur around a substantially lengthwise axis during use, drag levels are so low that the swimmer feels that the swim fins moves through the water with about the same ease as a bare foot. This allows the muscles in the user's legs, ankles, and feet to relax completely during gentle kicking strokes so that the possibility of fatiguing and cramping is almost completely eliminated. After several hours of continuous use, the swimmer is more exerted by the general act of swimming than by any strain to legs, ankles, or feet. This is a significant improvement over prior art designs in which drag on the blades cause the swimmer's legs, ankles, or feet to fatigue prematurely.

These results contradict conventional swim fin design principles that are hold the belief that the more resistance a swim fin has to moving through the water, the more propulsion it offers. This belief is especially strong within the realm of SCUBA type swim fin designs in which stiff and unyielding fins are considered to be most efficient.

Description—FIGS. 24 to 27

FIG. 24 shows a front perspective view of an alternate embodiment swim fin which has a pre-formed channel within the blade portion. A foot pocket 348 receives the swimmer's foot and a foot platform 350 exists below foot pocket 348. Foot pocket 348 is preferably attached to platform 350 with a mechanical and, or chemical bond. On the right side of platform 350 is a right stiffening member 352 and on the left side of platform 350 is a left stiffening member 354. Both member 352 and member 354 are attached to platform 350 in any suitable manner. For instance, platform 350, member 352, and member 354 can be molded in one piece from a substantially rigid material. Examples of materials may include corrosion resistant metals, metallic fiber reinforced thermoplastics, and other fiber reinforced thermoplastics. A combination of materials can also be used to offer desired levels of rigidity.

Between platform 350, member 352, and member 354 is a channeled blade portion 356 which hangs loosely below the plane formed by platform 350, member 352, and member 354. In this embodiment, portion 356 has a right flexible membrane 358, a right blade member 360, an intermediate flexible membrane 362, a left flexible membrane 364, and a left blade member 366. Membrane 358 is stretched between stiffening member 352 and blade member 360. Membrane 358 is preferably made from a highly resilient material, while blade member 360 is preferably made from a material that is substantially more rigid that used to make membrane 358. Membrane 358 is connected to stiffening member 352 and blade member 360 in any suitable manner. Membrane 364 is connected in a similar manner to stiffening member 354 and blade member 366. Between blade member 366 and blade member 360 is a center recess 368. Membrane 362 is connected to platform 350, membrane 358, blade member 360, membrane 364, and blade member 366 in any suitable manner that permits relative movement thereof Membrane 362 is preferably made of a highly resilient material such as that used to make membranes 358 and 364.

This embodiment may be made in as little as two steps and two materials. First, platform 350, stiffening member 352, stiffening member 354, blade member 360, and blade member 366 may be molded from a substantially rigid thermoplastic. Second, foot pocket 348, membrane 362, membrane 358, membrane 364 are molded from a highly resilient thermoplastic so that it fills into appropriately placed orifices, grooves, or recesses in platform 350, stiffening member 352, stiffening member 354, blade member 360, and blade member 366. In alternate embodiments, membrane 362 can be made of a rigid or semi-rigid material that is pivotally connected in any suitable manner to platform 350, membrane 358, blade member 360, membrane 364, and blade member 366.

In this embodiment, it is preferred that members 358, blade member 360, membrane 362, membrane 364, and member 366 are connected and arranged in a manner that produces a pre-formed lengthwise channel when the swim fin is at rest. The depth, span, length, shape, alignment, and contour of this channel can be varied according to desire.

FIG. 25 shows a perspective side view of the same swim fin during use. The arrow above foot pocket 348 shows the direction that the swim fin is being kicked.

FIG. 26 shows a perspective side view of the same swim fin kicked in the opposite direction. The arrow below foot pocket 348 shows the direction of the kicking motion. The shape of portion 356 is seen to be inverted on this stroke.

FIG. 27 shows a front perspective view of the same swim fin except that a vented central membrane 370 is added to fill the gap created by center recess 368. Vented membrane 370 is connected to blade member 360, membrane 362, and blade member 366 in any suitable manner such as a mechanical and, or chemical bond. Vented membrane 370 is seen to have a venting system 372 arranged in a lengthwise orientation. In this embodiment, venting system 372 uses four substantially rectangular vents, however, the vents can be of any shape, size, number, and arrangement. For instance, venting system 372 can have larger vents or even one large vent so that vented membrane 370 is made out of only a substantially small amount of material. In this situation, vented membrane 370 can actually be as little as a narrow flexible strip, string, cable, or chord stretched transversely across center recess 368 to connect blade member 360 to blade member 366.

Preferably, vented membrane 370 is made out of a highly flexible material. If it is desired, vented membrane 370 may be made from the same material that is used to make membrane 358, membrane 362, and membrane 364. In alternate embodiments, vented membrane 370 can be made out of a more rigid material as long as it is pivotally mounted to blade member 360, membrane 362, and blade member 366 in any suitable manner that permits movement thereof.

Operation—FIGS. 24 to 27

In FIG. 24, portion 356 is seen to form a pre-formed lengthwise channel while the swim fin is at rest. It is preferred that membrane 358, membrane 362, and membrane 364 are sufficiently flexible enough to permit portion 358 to form this shape without the need for significant levels of water pressure to be applied. Such flexibility also permits portion 356 to quickly and efficiently invert its shape when the direction of kick is reversed.

It is preferred that portion 356 is pre-shaped in such a manner that membrane 358 and membrane 364 are automatically oriented at a more reduced angle of attack relative to the oncoming flow than blade member 360 and blade member 366, respectively. As a result, the greatest change in curvature within portion 356 occurs substantially near its outer side edges. Thus, a parabolic shape is avoided across the span of the channel. This offers an improved hydrofoil shape by forming a concave attacking surface and a convex low pressure surface between membrane 358 and blade member 360, as well as between membrane 364 and blade member 366.

Such a pre-formed hydrofoil shape is made possible by the use of membrane 362. The side edges of membrane 362 are seen from this view to have an angled orientation to create an improved hydrofoil shape on each blade half. In alternate embodiments, these same methods can be used to create more sophisticated hydrofoil shapes with greater degrees of curvature through the use of more blade segments, flexible membranes, and pivotal connections. In all situations, center recess 368 is used to reduce the level of back pressure created within the channel during use.

FIG. 25 shows a side perspective view of the same swim fin during use. Membrane 362 is seen to be sloped in a manner that promotes movement of water into the channel as well as toward the trailing portions of the swim fin.

FIG. 26 shows that the shape of portion 356 becomes inverted as the direction of kick is reversed. This is possible because the joining edges of membrane 358, blade member 360, membrane 362, membrane 364, and blade member 366 are attached to each other, as well as to the joining portions of platform 350, stiffening member 352, and stiffening member 354, in a manner that permits flexing, bending, or pivoting thereof. Only platform 350, stiffening member 352, and stiffening member 354 are rigidly attached to each other to in a manner that resists such movement. The rigidity of platform 350, stiffening member 352, and stiffening member 354 allow the shape of portion 356 to be controlled in a desirable manner.

Because the channel is pre-formed, resistance to deformation is reduced. This permits the swim fin to be at its optimum orientation over a greater portion of each stroke. This is because the minimum water pressure needed to create such an orientation is significantly reduced. This allows a greater portion of the energy and time normally expended to create optimum deformation to be efficiently converted into propulsion.

In FIG. 27, vented membrane 370 is added to fill the gap created by center recess 368. Because vented membrane 370 is made of a flexible material, it can easily fold in upon itself as blade members 360 and 366 swing toward each other at the inversion point of each stroke. This allows the channel to quickly invert its shape without jamming as it passes between stiffening members 352 and 354.

One of the benefits of vented membrane 370 is that it permits increased control to be achieved over the angled orientation of blade members 360 and 366. Vented membrane 370 can be used to prevent center recess 368 from widening to undesirable levels during use. This permits the reduction in angle of attack existing near the trailing portions of blade member 360 and blade member 366 to be limited so that they do not exceed a desired maximum level. This can prevent the trailing portions of blade members 360 and 366 from twisting to an excessively low angle of attack during hard kicking strokes.

Venting system 372 is used to reduce back pressure within the attacking side of the channel during use. Because the sides of the channel slope inward to direct water into the channel along the attacking side of portion 356, venting system 372 permits excess levels of back pressure created by inward moving water to be vented out the bottom of the channel. This permits inward moving flow to continue flowing toward the center of the channel in an unobstructed manner. Consequently, the channel is less vulnerable to "overflow conditions" which can cause water to reverse its flow direction and spill outward around the side edges of the swim fin. Because this problem is avoided, the formation of destructive induced drag type vortices are significantly reduced along these outside edges.

Since venting system 372 encourages water to continually flow in an inward direction from each side of portion 356, water pressure is increased along the attacking surfaces as this inward flowing water collides along the swim fin's center axis. Also, as some of the water which flows along the attacking surfaces of portion 356 passes through venting system 372, it is able to rejoin the water flowing around the low pressure surfaces (lee surfaces) of portion 356. This causes the water along the low pressure surfaces to flow at a faster rate and generate lift in accordance with Bernoulli's principle. These factors dramatically reduce drag and increase propulsion. These benefits offer a major improvement over prior art swim fins that attempt to gain propulsion by using a lengthwise channel.

In alternate embodiments, venting system 372 can appear in any desirable form. The size of the vents can be made larger to increase the volume of flow through them. The leading and trailing portions of vented membrane 370 which exist around each vent can be made more hydrofoil shaped to improve efficiency and further reduce drag. Venting system 372 can also have less total vents that are larger in size to improve efficiency. Venting system 372 can also have a series of longitudinal vents that are parallel to each other and spaced apart in a side by side manner instead of a series of rectangular vents as shown. Such longitudinal vents can spread across the entire span of the swim fin if desired. The blade portions existing between such vents can have a substantially spanwise tear drop hydrofoil shape to increase lift.

Other embodiments can have membrane 370 made from a rigid material that does not flex, but is connected to blade member 360, blade member 366 and membrane 362 in any suitable manner that permits pivotal movement thereof. Also, membrane 370 can be eliminated entirely. In this situation, blade members 360 and 366 can be molded as one piece to form a central blade portion, and a series of vents can be cut out of this central blade portion for reducing back pressure along the blade's attacking surface. For similar performance on opposing strokes the central blade portion can be made substantially planar in form. The concave channel can be produced solely by membranes 358 and 364, which can be made sufficiently loose enough to permit the central blade portion to deform into a concave channel on both reciprocating strokes. This still permits a significant improvement in performance to exist over the prior art because back pressure is reduced within the channel while the outer edge portions of the channel exhibit the greatest degree of anhedral deformation. The centrally located vents also help stabilize the movement of the fin through the water and significantly decreases its tendency to wobble side to side like a falling leaf as it is kicked vertically. The decrease in back pressure also decreases the drag created by the fin as it is kicked through the water and makes the fin less fatiguing to use. The reduced back pressure within the channel also makes the fin easier to use on at the water's surface since it reduces the fin's tendency to catch on the surface as it re-enters the water during a kicking stroke.

Description—FIGS. 28 to 30

FIG. 28 shows a cut-away perspective view of the right half of a substantially symmetrical swim fin. A foot pocket 374 receives a swimmer's foot and is attached to a foot platform 376 in any suitable manner such as a mechanical and, or chemical bond. The outside edge of foot platform 376 is attached to a right stiffening member 378 in any suitable manner. For instance, platform 376 and stiffening member 378 can be molded in one piece from the same material. It is preferred that platform 376 and stiffening member 378 are made of a significantly rigid material so that they do not deform excessively during use.

Suspended between the front of platform 376 (near the toe of foot pocket 378) and the inner edge of stiffening member 378 is a flexible blade portion 380, which is composed of a flexible membrane 382, a forward rib pair 384, and a trailing rib pair 386. Membrane 382 is preferably made of a highly resilient material which deforms easily under significantly low levels of water pressure. Membrane 382 may be attached to platform 376 and stiffening member 378 in any suitable manner such as a mechanical and, or chemical bond. Preferably, membrane 382 recedes into a groove along the inside edge of stiffening member 378 as well as along the front of platform 376. These groves can have a series of holes, recesses, or orifices into which membrane 382 fills during the molding process. From this view, membrane 378 is seen to recede into a groove along the front edge of foot platform 376.

In this embodiment, rib pair 384 is preferably made from two narrow strips of a significantly rigid material. One of these strips is attached to the upper surface of membrane 382 while the other strip is attached to the lower surface of membrane 382. These strips can be attached to membrane 382 in any suitable manner. For instance, the two strips of rib pair 384 can "sandwich" membrane 382 while being attached to each other with suitable mechanical protrusions passing through openings, recesses, or holes within membrane 382. Mechanical and, or chemical bonds may be used to secure the two strips of rib pair 384 to each other as well as to membrane 382. Similarly, trailing rib pair 386 is secured to membrane 382 in any suitable manner.

In alternate embodiments, a single rib can extend from one side of membrane 382 while the other side of membrane 382 remains smooth. Rib pair 384 can also be a thickened portion of membrane 382 created during the molding process that extends above and, or below the plane of membrane 382 so that fewer parts and steps of assembly are needed. A rigid member can also be used within the interior of membrane 382 so that both the upper and lower surface of membrane 382 remain substantially smooth. In this situation, membrane 382 is molded onto and around such a member.

An initial bending zone 388 is represented by a broken line along membrane 382 that originates from a position on membrane 382 near a trailing tip 390 and extends to the base of an inner edge 392 of membrane 382 near foot platform 376. A modified bending zone 394 is represented by a broken line along membrane 382 that is seen to first originate from a position on membrane 382 near trailing tip 390 and extends to the outer side end of rib pair 386, then extends to the outside end of rib pair 384, and finally extends to the base of inner edge 392 near foot platform 376. Because the outside ends of rib pair 384 and rib pair 386 are spaced a relatively small distance from the inside edge of stiffening member 378, modified bending zone 394 is also spaced this same relatively small distance from the inside edge of stiffening member 378. Bending zone 394 is seen to exist significantly closer to stiffening member 378 than initial bending zone 388.

FIG. 29 shows a cross sectional view taken along the line 29—29 from-FIG. 28 as membrane 382 deforms during use. In FIG. 29, an oncoming flow 396 is displayed by two streamlines flowing toward and around stiffening member 378, membrane 382, and rib pair 384. The horizontally broken lines show the position of rib pair 384 and membrane 382 at rest while the solid lines show the position of rib pair 384 and membrane 382 when membrane 382 deforms under the pressure of oncoming flow 396 during use. The streamlines of oncoming flow 396 flow smoothly and generate a lift vector 398.

FIG. 30 shows a cross sectional view taken along the line 30—30 from FIG. 28 as membrane 382 deforms during use.

In FIG. 30, the horizontally aligned broken lines display the position of rib pair 386 and membrane 382 while the swim fin is at rest. The solid lines show the position of rib pair 386 and membrane 382 during use when an oncoming flow 400 causes membrane 382 to deform. The cross sectional view having solid lines shows rib pair 386 extending from both sides of membrane 382. Oncoming flow 400 is displayed by two streamlines approaching and flowing smoothly around stiffening member 378, membrane 382, and rib pair 386. The smooth flow conditions efficiently generate a lift vector 402. Oncoming flow 400 is created during the same kicking stroke that creates oncoming flow 396 shown in FIG. 29.

Operation—FIGS. 28 to 30

Because membrane 382 in FIG. 28 is highly resilient, it deforms easily under significantly low levels of water pressure. Consequently, if rib pair 384 and rib pair 386 are not used to provide structural support in this design, the portions of membrane 382 existing between initial bending zone 388 and inner edge 392 are vulnerable to collapse and bend around bending zone 388 to a zero or near zero angle of attack. Such excessive levels of deformation can be seen when looking back to FIG. 15 or 16 and observing position 246. Thus, to prevent such an undesirable form of deformation from occurring in FIG. 28, rib pair 384 and rib pair 386 are used to prevent membrane 382 from bending abruptly around bending zone 388. Because rib pairs 384 and 386 are substantially rigid, membrane 382 cannot bend around bending zone 388 and modified bending zone 394 is created along membrane 382.

Although the portions of membrane 382 existing between bending zone 388 and stiffening member 378 exhibit significantly higher resistance to twisting around a substantially lengthwise axis than the portions of membrane 382 existing between bending zone 388 and inner edge 392, the presence of rib pair 384 and rib pair 386 permit a greater portion of membrane 382 to deform in a desired manner.

Because the portions of membrane 382 existing between bending zone 388 and inner edge 392 are able to deform easily under water pressure, a twisting moment is exerted on rib pair 384 and rib pair 386 with bending zone 388 behaving substantially as the axis of rotation. This causes the portions of rib pair 384 and rib pair 386 existing between bending zone 388 and inner edge 392 to pivot away from the applied water pressure. At the same time, the portions of rib pair 384 and rib pair 386 existing between bending zone 388 and stiffening member 378 try to pivot in the direction toward the oncoming water pressure. However, because the outside ends of rib pair 384 and rib pair 386 terminate on membrane 382 at a significantly close distance to stiffening member 378, tension is created within the material of membrane 382 between stiffening member 378 and the outer side ends of rib pairs 384 and 386. This tension prevents the outer ends of rib pairs 382 and 386 from rotating significantly above the horizontal plane occupied by stiffening member 378. The rigidity of stiffening member 378 prevents further maximizes this tension that restricts the movement of the outer side ends of rib pairs 384 and 386 during use. As a result, the twisting moments created on rib pairs 384 and 386 during use apply leverage onto the portions of membrane 382 existing between bending zone 388 and bending zone 394 and cause them to pivot to a reduced angle of attack. Because membrane 382 is made out of a highly resilient material, adequate levels of deformation can be achieved even under conditions of significantly low water pressure. Consequently, the portions of membrane 382 existing between bending zone 394 and inner edge 392 are able to quickly pivot around bending zone 394 to a reduced angle of attack in a substantially even and efficient manner even when the swimmer is using relatively light kicking strokes.

Because the portions of membrane 382 existing between bending zone 388 and bending zone 394 offer resistance to such deformation, the degree of pivoting is controlled by this resistance. This permits the majority of membrane 382 to deform to a desirable reduced angle of attack during use without collapsing to a zero, or near zero angle of attack. Thus, the resistance provided by these more resistant portions of membrane 382 now becomes an advantage by permitting a desired level of control to be achieved over the actual angles of attack exhibited during use. Some of the variables that affect the degree of deformation include the actual resiliency of membrane 382, the tension (or lack of tension) existing across membrane 382 between platform 376 and stiffening member 378 while the swim fin is at rest, the degree of rigidity/flexibility built into stiffening member 378, and the degree of rigidity/flexibility built into rib pair 384 and rib pair 386. One or more of these variables can be altered to create desired amounts of deformation during use.

Another advantage to this embodiment is that the total area of membrane 382 that Ad remains at a high angle of attack during use is substantially reduced. The only portions of membrane 382 that remain at a high angle of attack exist between bending zone 394 and stiffening member 378. This is a significantly smaller area than which exists between bending zone 388 and stiffening member 378. Because bending zone 394 is closer to stiffening member 378, smoother flow is achieved along the low pressure surface of membrane 382. Also, a greater volume of water is channeled away from stiffening member 378 and toward inner edge 392. This significantly increases efficiency and propulsion.

When comparing the cross sectional views shown in FIGS. 29 and 30, it can be seen that membrane 382 and rib pair 386 in FIG. 30 are inclined at a more reduced angle of attack than membrane 382 and rib pair 384 shown in FIG. 29. This shows that membrane 382 assumes a twisted orientation along its length during use.

Rib pair 386 in FIG. 30 is able to pivot to a more reduced angle of attack than rib pair 384 in FIG. 29 because rib pair 386 in FIG. 30 is less affected anti-twisting stress forces within 382. Looking back to FIG. 28, it can be seen that a majority of the length of rib pair 386 exists between bending zone 388 and inner edge 392, while only a substantially small portion of membrane 386 exists between bending zone 388 and bending zone 394. Consequently, only a substantially small portion of rib pair 386 exists on a portion of membrane 382 that resists twisting (between bending zone 388 and bending zone 394. When looking at rib pair 384 in FIG. 28, it can be seen that a substantially larger portion of its length exists between bending zone 388 and bending zone 394 (where tension within membrane 382 is significantly higher). This difference in resistive forces permits rib pair 386 to pivot to a significantly lower angle of attack than rib pair 348 since rib pair 386 encounters less resistance to twisting than rib pair 384. Because the angle of attack of membrane 382 decreases toward the trailing portions of the blade, water is encouraged to flow toward the these trailing portions at an accelerated rate. This significantly increases propulsion.

The cross sectional views shown in FIGS. 29 and 30, rib pair 384 and rib pair 386 demonstrate their ability to cause membrane 382 to deform substantially close to stiffening member 378. Efficient lift generating flow conditions are created while flow separation and drag are significantly reduced. It is intended that membrane 382 is able to deform in a similar manner when the direction of kicking is reversed on the opposite stroke.

Summary, Ramifications, and Scope

Accordingly, the reader will see that the swim fin designs, flow control methods, and stress controlling methods of the present invention can be used to efficiently generate improved levels of lift by increasing the difference in pressure occurring between the opposing surfaces of the blade. The reader will also see that the present invention can be used to significantly reduce the drag on the blade created during swimming strokes. Furthermore, the designs and methods of the present invention offer additional advantages in that they (a) provide a flexible hydrofoil design that significantly reduces flow separation around its low pressure surface during use;

(b) provide a swim fin which significantly reduces the occurrence of ankle and leg fatigue;

(c) provide a swim fin which offers increased safety and enjoyment by significantly reducing a swimmer's chances of becoming inconvenienced or immobilized by leg, ankle, or foot cramps during use;

(d) provide swim fin designs which are as easy to use for beginners as they are for advanced swimmers;

(e) provide swim fin designs which do not require significant strength or athletic ability to use;

(f provide swim fin designs which can be kicked across the water's surface without catching or stopping abruptly on the water's surface as they re-enter the water from above the surface on the down stroke;

(g) provide swim fin designs that offer high levels of propulsion and low levels of drag when used at the surface as wall as below the surface.

(h) provide swim fin designs that provide high levels of propulsion and low levels of drag even when significantly short and gentle kicking strokes are used;

(i) provide methods for substantially reducing the formation of induced drag type vortices along the side edges of a hydrofoil;

(j) provide hydrofoil designs which significantly reduce outward directed spanwise flow conditions along their attacking surfaces;

(k) provide hydrofoil designs which efficiently focus a fluid medium traveling along the attacking surface away from their outer side edges and toward their center axis so that fluid pressure is increased along their attacking surface;

(l) provide hydrofoil designs in which the outer side portions of the hydrofoils are sufficiently anhedral enough to encourage a significant portion of the aftward flow to have a large enough inward spanwise component to significantly reduce the formation of induced drag vortices along the outer side edges of the hydrofoils;

(m) provide fin designs which offer improved lift by significantly reducing stall conditions along their low pressure surfaces;

(n) provide methods for significantly reducing separation along the lee surface of reciprocating motion foils which are used at significantly high angles of attack;

(o) provide a highly swept leading edge portion and, or an outer side edge portion of a flexible hydrofoil with a stiffening member which is sufficiently rigid enough to permit the flexible hydrofoil to maintain orientations that are effective in generating a significantly strong lifting force during use while the hydrofoil is oriented at a substantially spanwise directed reduced angle of attack;

(p) provide a low aspect ratio hydrofoil design which offers significantly reduced levels of induced drag;

(q) provide a method for a rigid propulsion hydrofoil to efficiently generate lift on both opposing strokes of a reciprocating motion cycle;

(r) provide a method for enabling a reciprocating motion propulsion hydrofoil to generate high levels of lift and low levels of drag on at least one stroke of the reciprocating cycle;

(s) provide methods for controlling and reducing the build-up the torsional stress forces of tension and compression within the material of a flexible blade in an amount effective to permit the material within the flexible blade to exhibit significantly less resistance to twisting around its length to a reduced angle of attack than it does to bending along its length;

(t) provide methods for controlling and reducing the build-up the torsional stress forces of tension and compression within the material of a flexible blade in an amount effective to permit the material within the flexible blade to deform efficiently and easily to a predetermined reduced angle of attack that is capable of efficiently generating significantly high levels of lift, and such deformation is able to occur under the influence of water pressure created during a significantly gentle kicking stroke;

(u) provide methods for controlling and reducing the build-up the torsional stress forces of tension and compression within the leading edge portions and, or outer side edge portions of a flexible hydrofoil in an amount effective to permit such leading edge portions and, or outer side edge portions to deform efficiently and easily to a predetermined reduced angle of attack that is capable of efficiently generating significantly high levels of lift along the lee surfaces of such leading edge portions and, or outer side edge portions, and such deformation is able to occur under the influence of water pressure created during a significantly gentle kicking stroke; and (v) provide the highly swept leading edge portion of a flexible blade with a stiffening member that is arranged to create a sufficiently strong twisting moment around a substantially streamwise axis within the flexible material to permit the flexible material to deform to a significantly reduced angle of attack in reference to its spanwise alignment under water pressure exerted during use, while simultaneously providing methods for permitting such deformation to occur sufficiently close to the highly swept leading edge to reduce separation around the lee surface of the blade in an amount effective to significantly increase lift and reduce drag.

Although the description above contains many specificities, these should not be construed as limiting the scope of the invention but as merely providing illustrations of some of the presently preferred embodiments of this invention. For example, instead of having two blade halves that are symmetrical, the two blade halves can be asymmetrical in respect to the swim fin's center axis. In such embodiments each blade half can differ in length, width, thickness, degree of sweep, degree of flexibility, change in flexibility, degree of rigidity, degree of twist, overall shape, topographic shape, aspect ratio, contour, and cross sectional shape in comparison to the other blade half.

Other variations can include using only one of the flexible blade halves without its counterpart. In this situation, the size of this blade can be substantially increased to make up for the space previously occupied by the other blade half. This blade can twist back and forth with each reciprocating stroke in a similar manner as the elongated single blade tail of a nurse shark or thresher shark.

Also, any number of blades may be used rather than just one or two. When more that two blades are used, any orientation, arrangement, alignment, and configuration of blades may be used. For instance, blades can branch out from other blades in a wide variety of patterns. Also, a series of narrow highly swept blades may extend from the foot pocket in a substantially parallel manner or in a substantially radiating manner.

When two side by side highly swept and flexible blade halves are used, they do not necessarily have to twist to form an anhedral channel along the attacking side of the swim fin on each stroke. Instead, they can twist in the opposite direction to a dihedral orientation on each stroke. In this case, the stiffening members exist along the inside edge of each blade half. Between these two stiffening members is the recess between the blades. Consequently, water flowing along the attacking surface of the blade halves is focused away from the center recess and toward the outer side edges of each blade half. Because water is able to flow through the recess, attached flow is created along the low pressure surface of each blade half. It is intended that the stiffening members on each blade half are sufficiently rigid enough to prevent them from bending significantly toward each other during strokes. This enables the center recess to remain open and between the blades so that attached flow is maintained along the low pressure surface of each blade half. If desired, one or more transversely aligned beams can be secured between the two stiffening members to bridge the recess and prevent the stiffening members from bending toward each other during use.

Another alternate embodiment can include using a single twisting flexible foil which attaches to other parts of the user's body than the feet. The root portion of the foil can attach in any suitable manner to any desirable region of the swimmer's body and extend outward and away from the body in a manner that enables the user to create additional propulsion and, or directional stability. Such fins can have a suitable system for attaching to the user's lower legs, upper legs, hips, waist, back, torso, diving equipment, shoulders, arms, wrists, or hands. Multiple fins may be used simultaneously in any desirable combination or arrangement. Preferably, such foils are highly swept at least along their outer portions, and such outer portions are arranged to twist around a substantially streamwise axis. However, the methods used in the present invention which significantly increase the ease to which a flexible hydrofoil can achieve a twisted shape may also be used on hydrofoils which are only slightly swept back, not swept back at all, or even swept forward (either in part or entirely).

Alternate embodiments which have a blade member attached to a stiffening member may use any suitable method for providing a pivotal type of attachment thereof. For example the blade member may have a series of hoop-like structures attached to its outer side edge portions and, or leading edge portions, and the stiffening member is inserted through such hoop-like structures to provide a connection that permits pivotal motion of the blade member around the stiffening member. A looped piece of material may also be used in a similar manner.

Flexible foils equipped with systems for controlling anti-twisting stress forces may also be used for purposes other than swimming aids. Such improved flexible foils may be used as improved hydrofoils, hydroplanes, rudders, skegs, directional stabilizers, keels, flexible propeller blades, flexible impeller blades, nacelles, oars, paddles, propulsion foils, oscillating propulsion foils, and other similar foil-type devices. These may be used on power boats, sailboats, submersibles, semi-submersibles, recreational water craft, human powered water craft, sailboards, surfboards, water skis, aerodynamic and hydrodynamic toys, and personal propulsion devices.

In addition, any of the embodiments and individual variations discussed in the above description may be interchanged and combined with one another in any desirable order, amount, arrangement, and configuration.

Accordingly, the scope of the invention should not be determined not by the embodiments illustrated, but by the appended claims and their legal equivalents.

I claim:

1. A hydrofoil, comprising:

(a) a thermoplastic pivoting blade region hinged to a predetermined body with a flexible joint element, said thermoplastic pivoting blade region having an originating portion adjacent to said predetermined body and a forward portion spaced from said originating portion and said predetermined body, said flexible joint element being a region of increased flexibility disposed within said hydrofoil at a location that is adjacent to said originating portion of said pivoting blade region, said region of increased flexibility permitting said pivoting blade region to pivot around a transverse axis that is located adjacent to said originating portion;

(b) a movable thermoplastic element connected to a load bearing structure and to said thermoplastic pivoting blade region, said load bearing structure being connected to said predetermined body; and (c) said movable thermoplastic element being connected to said thermoplastic pivoting blade region with a chemical bond created during injection molding.

2. The hydrofoil of claim 1 wherein said flexible joint element has a significantly transverse alignment.

3. The hydrofoil of claim 1 wherein said flexible joint element is a cutout region within said hydrofoil that is located adjacent to said originating portion.

4. The hydrofoil of claim 3 wherein a flexible thermoplastic material is disposed within said cutout region and connected to said hydrofoil with a chemical bond.

5. The hydrofoil of claim 1 wherein said flexible joint element is a region of reduced thickness.

6. The hydrofoil of claim 1 wherein a resilient thermoplastic material is connected to said flexible joint element with a chemical bond.

7. The hydrofoil of claim 1 wherein said flexible joint element is a region of reduced material.

8. The hydrofoil of claim 1 wherein said flexible joint element is more flexible than said forward portion.

9. The hydrofoil of claim 1 wherein said flexible joint element is a transversely aligned hinge element.

10. The hydrofoil of claim 1 wherein said pivoting blade region is able to create a propulsive force and said pivoting blade region is able to pivot to a reduced lengthwise angle of attack sufficient to tilt said propulsive force significantly in the direction of intended travel.

11. The hydrofoil of claim 1 wherein said pivoting blade region is able to pivot to a reduced lengthwise angle of attack that is capable of pushing an increased amount of water in the opposite direction of intended travel.

12. The hydrofoil of claim 1 wherein said hydrofoil is a swim fin and said pivoting blade region is able to pivot around said transverse axis located adjacent said originating portion to a reduced lengthwise angle of attack sufficient to significantly reduce the kicking resistance of said swim fin.

13. The hydrofoil of claim 1 wherein said hydrofoil is a swim fin having a foot attachment member, said foot attachment member having a toe region, and said predetermined body is said toe region of said foot attachment member.

14. The hydrofoil of claim 1 wherein said movable thermoplastic element is a deflection limiting element.

15. The hydrofoil of claim 14 wherein said deflection limiting element is an extensible member.

16. The hydrofoil of claim 14 wherein said deflection limiting element has at least one extensible fold formed during injection molding.

17. The hydrofoil of claim 1 wherein said hydrofoil is a swim fin having a foot attachment member, said foot attachment member having a toe region, and said predetermined body is said toe region of said foot attachment member, said foot attachment member having a flexible portion made with a flexible thermoplastic material, said movable thermoplastic element being obtained from injection of said flexible thermoplastic material of said foot attachment member.

18. The hydrofoil of claim 1 wherein at least one diagonally oriented stiffening member is connected to said pivoting blade region with a chemical bond.

19. The hydrofoil of claim 1 wherein said hydrofoil has a free end portion, said free end portion having a recess sufficient to form two tip portions.

20. The hydrofoil of claim 1 wherein said hydrofoil has at least one enclosed vent.

21. The hydrofoil of claim 1 wherein said hydrofoil has opposing surfaces and at least one of said opposing surfaces has a channel shaped depression.

22. The hydrofoil of claim 21 wherein said channel shaped depression is made with a flexible thermoplastic element molded to said blade member with a chemical bond.

23. The hydrofoil of claim 1 wherein at least one substantially longitudinal flexible thermoplastic member is molded to said hydrofoil with a chemical bond.

24. A method for connecting a pivoting blade region to a propulsion hydrofoil, comprising connecting said pivoting blade region to a load bearing structure with a flexible thermoplastic hinge element, said flexible thermoplastic hinge element being made with a relatively flexible thermoplastic material, said pivoting blade region being made with a relatively stiffer thermoplastic material, and said relatively flexible thermoplastic material being connected to said relatively stiff thermoplastic material with a thermal-chemical bond created during a phase of injection molding.

25. The method of claim 24 wherein said propulsion hydrofoil is arranged to pivot around a transverse axis to a reduced angle of attack.

26. The method of claim 24 wherein said pivoting blade region is able to flex around a transverse axis to a lengthwise reduced angle of attack.

27. The method of claim 24 wherein said pivoting blade region is able to flex around a lengthwise axis to a transverse reduced angle of attack.

28. The method of claim 24 wherein said pivoting blade region is able to flex around both a transverse axis and a lengthwise axis to a reduced angle of attack.

29. The method of claim 24 wherein said propulsion hydrofoil is a swim fin.

30. The method of claim 29 wherein said swim fin has a foot attachment member, said foot attachment member having a soft portion made with said relatively flexible thermoplastic material during said phase of injection molding.

31. The method of claim 29 wherein said flexible thermoplastic hinge element is a region of reduced blade thickness located within said pivoting blade region.

32. The method of claim 24 wherein said hydrofoil is a swim fin having a foot attachment member, said blade region having a root portion adjacent said foot attachment member and a free end portion spaced from said root portion and said foot attachment member, said flexible thermoplastic hinge element being located adjacent said root portion, said flexible thermoplastic hinge element having sufficient flexibility to permit said blade region to flex to a reduced lengthwise angle of attack around a transverse axis located adjacent said root portion.

33. The method of claim 32 wherein said foot attachment member has a toe region and said flexible thermoplastic hinge element located in front of said toe region.

34. The method of claim 32 wherein said reduced lengthwise angle of attack is sufficient to reduce the kicking effort said swim fin.

35. The method of claim 32 wherein said reduced lengthwise angle of attack is sufficient to significantly increase the efficiency of said swim fin.

36. The method of claim 32 wherein said reduced lengthwise angle of attack is sufficient to significantly increase the amount of water pushed in the opposite direction of intended swimming.

37. The method of claim 32 wherein said pivoting blade region is made with a highly resilient thermoplastic material.

38. The method of claim 32 wherein at least one elongated stiffening member is connected to said pivoting blade region, said pivoting blade region and said stiffening members being made with two different materials connected with a chemical bond.

39. The method of claim 32 wherein at lease one elongated stiffening member is connected to said pivoting blade region, said stiffening member having a region of reduced thickness adjacent said foot attachment member.

40. The method of claim 32 wherein said pivoting blade region has at least one vent.

41. The method of claim 32 wherein said foot attachment member has a soft portion made with said relatively flexible thermoplastic material used in said flexible thermoplastic hinge element, both said soft portion and said flexible thermoplastic hinge element being formed during said phase of injection molding.

42. The method of claim 32 wherein said foot attachment member has a soft portion made with a relatively soft thermoplastic material, both said soft portion and said flexible thermoplastic hinge element being formed at the same time during said phase of injection molding.

43. The method of claim 32 wherein two elongated stiffening members are connected to said pivoting blade region, said elongated stiffening members being spaced apart in a sideways manner, at least one flexible thermoplastic element being connected to said pivoting blade region in an area between said elongated stiffening members, said at least one flexible thermoplastic element having sufficient flexibility to flex between said elongated stiffening members to form a longitudinal channel shaped contour during use.

44. The method of claim 43 wherein at least one vent is disposed within said longitudinal channel shaped contour.

45. The method of claim 43 wherein said free end has a recess sufficient to form to tip portions.

46. The method of claim 43 wherein said at least one flexible thermoplastic element is made with a relatively soft thermoplastic material connected to said blade member with a chemical bond.

47. The method of claim 43 wherein said at least one flexible thermoplastic element has at least one fold.

48. The method of claim 47 wherein said blade region has a longitudinal alignment and said at least one fold is formed around an axis that is oriented at an angle to said longitudinal alignment.

49. A method for providing a swim fin, comprising:

(a) providing a foot attachment portion;

(b) providing a blade member having opposing surfaces, outer side edges, a root portion adjacent to said foot attachment portion and a free end portion spaced from said root portion and said foot attachment member, said blade member having two elongated stiffening members connected to said blade member adjacent to said outer side edges, said blade member having sufficient flexibility between said stiffening members to be capable of bowing to form a longitudinal channel shaped contour during use;

(c) providing said swim fin with a region of increased flexibility disposed in said swim fin at a location adjacent to said root portion, said region of increased flexibility being sufficiently flexible to permit said blade member and said stiffening members to pivot around a transverse axis located adjacent said root portion and experience a deflection adjacent to said root portion to a lengthwise reduced angle of attack during use; and (d) providing a stopping device capable of limiting said deflection.

50. The method of claim 49 wherein said longitudinal channel is significantly deep during use.

51. The method of claim 49 wherein said transverse axis is located adjacent to said foot attachment portion.

52. The method of claim 49 wherein said deflection to said lengthwise reduced angle of attack is sufficient to significantly increase the amount of water pushed in the opposite direction of intended swimming.

53. The method of claim 41 wherein said stopping device is arranged to significantly prevent said lengthwise reduced angle of attack from reaching excessive angles that are ineffective at producing propulsion.

54. The method of claim 49 wherein said free end portion has a split sufficient to divide said free end portion into two tip portions.

55. The method of claim 49 wherein said swim fin has a lengthwise alignment and said blade member has an elongated flexible element oriented at an angle to said lengthwise alignment.

56. The method of claim 55 wherein said angle is transverse to said lengthwise alignment.

57. The method of claim 54 wherein said elongated flexible element is a flexing zone having a directional alignment, and said directional alignment may be selected from group consisting of transverse alignments and angled alignments.

58. The method of claim 55 wherein said elongated flexible element is a region of reduced blade material.

59. The method of claim 55 wherein said elongated flexible element is made with a relatively flexible thermoplastic connected to said blade member with a chemical bond created during a phase of injection molding.

60. The method of claim 59 wherein said foot attachment portion has a flexible portion made with said relatively flexible thermoplastic material of said elongated flexible element during said phase of injection molding.

61. The method of claim 49 wherein at least one flexible element is disposed within said blade member, said flexible element being arranged to encourage said blade member to form said longitudinal channel shaped contour during use.

62. The method of claim 61 wherein said at least one flexible element is arranged to achieve a folded condition during an inversion portion of a kicking stroke cycle and a relatively expanded condition during at least one kicking stroke direction.

63. The method of claim 49 wherein said foot attachment portion has a toe region, said transverse axis being located near said toe region.

64. The swim fin of claim 49 wherein at least one vent is disposed within said blade member.

65. The swim fin of claim 64 wherein said at least one vent is located adjacent said foot attachment portion.

66. The swim fin of claim 64 wherein said blade member has a root portion adjacent said foot attachment portion and a free end spaced from said root portion and said foot attachment portion, said blade member having a longitudinal midpoint between said root portion and said free end portion, at least one portion of said at least one vent being located forward of said longitudinal midpoint.

67. The method of claim 49 wherein said elongated stiffening members have sufficient strength to permit said swim fin to achieve significantly high swimming speeds.

68. The method of claim 67 wherein at least one opening is disposed within said longitudinal channel shaped contour.

69. The method of claim 68 wherein said at least one opening is arranged to reduce back pressure within said longitudinal channel shaped opening.

70. The method of claim 49 wherein said elongated stiffening members have a region of reduced material located adjacent to said root portion.

71. The method of claim 49 wherein said elongated stiffening members are pivotally connected to said swim fin adjacent to said foot attachment member.

72. The method of claim 49 wherein said stopping device has sufficient strength to permit said blade member to maintain orientations effective in generating propulsion while efficiently transferring such propulsion from said blade member to said foot attachment portion.

73. The method of claim 72 wherein said elongated stiffening members are provided with sufficient spring-like tension to permit said stiffening members to snap back from said lengthwise reduced angle of attack toward a neutral position at the end of a kicking stroke.

74. The method of claim 73 wherein said stopping device is able to sufficiently limit said deflection to substantially prevent said swim fin from experiencing excessive levels of lost motion during an inversion portion of a kicking stroke.

75. The method of claim 49 wherein said stopping device is arranged to permit said deflection around said transverse axis to said lengthwise reduced angle of attack to occur within a predetermined range of motion.

76. The method of claim 75 wherein said predetermined range of motion can be significantly small to substantially prevent excessive levels of lost motion from occurring during an inversion portion of a kicking stroke.

77. The method of claim 75 wherein said elongated stiffening members are made with a highly resilient material.

78. The method of claim 49 wherein said longitudinal channel shaped contour is sufficiently deep to encourage water to flow in an inward direction from said outer side edges.

79. The method of claim 78 wherein at least one opening is disposed within said longitudinal channel shaped contour.

80. The method of claim 49 wherein said deflection is sufficient to provide significantly low kicking resistance.

81. The method of claim 49 wherein at least one flexible element is disposed within said blade member, said at least one flexible element having sufficient flexibility to permit said blade member to form said longitudinal channel shaped contour during use.

82. The method of claim 81 wherein said at least one flexible element is made with a relatively flexible thermoplastic material, said blade member being made with a relatively stiffer thermoplastic material, and said relatively flexible thermoplastic material being connected to said relatively stiffer thermoplastic material with a chemical bond created during a phase of an injection molding process.

83. The method of claim 81 wherein said at least one flexible element has at least one fold.

84. The method of claim 81 wherein said at least one flexible element has at least one fold that may expand during use.

85. The method of claim 49 wherein a zone of decreased thickness may be created within said swim fin near said foot attachment portion to permit said stiffening members to achieve backward bending capability around said transverse axis near said foot attachment portion.

86. The method of claim 49 wherein said elongated stiffening members and said blade member are made with two different materials joined together with a chemical bond.

87. A method for providing a swim fin, comprising:

(a) providing a foot attachment member;

(b) providing a blade member connected to said foot attachment member and forming a forward extension of said foot attachment member, said blade member having opposing surfaces, outer side edges, a root blade portion adjacent said foot attachment member and a blade free end spaced from said root blade portion and said foot attachment member, said blade member having a longitudinal midpoint between said root blade portion and said blade free end, said blade member having sufficient flexibility to flex around a transverse axis from a neutral blade position to a reduced angle of attack during use;

(c) providing said blade member with at least one enclosed vent disposed within at least one of said opposing surfaces, at least one portion of said at least one enclosed vent being located forward of said longitudinal midpoint.

88. The method of claim 82 wherein said reduced angle of attack is sufficient to significantly increase the amount of water pushed in the opposite direction of intended swimming.

89. The method of claim 87 wherein said reduced angle of attack is sufficient to reduce kicking effort.

90. The method of claim 87 wherein said at least one enclosed vent is a plurality of enclosed vents having sufficient flow capacity to reduce kicking resistance.

91. The method of claim 87 wherein said blade member has a longitudinal center axis, said at least one enclosed vent is located adjacent said longitudinal center axis.

92. The method of claim 87 wherein said blade member has a first half portion between said root blade portion and said longitudinal midpoint, a second half portion between said longitudinal midpoint said blade free end, and said at least one enclosed vent being disposed within said second half of said blade member.

93. The method of claim 87 wherein said transverse axis is adjacent to said first half of said blade member.

94. The method of claim 87 wherein said foot attachment member has a toe portion and said transverse axis is adjacent said toe portion.

95. The method of claim 87 wherein said transverse axis is adjacent said second half portion of said blade member.

96. The method of claim 87 wherein at least one elongated stiffening member is connected to said blade member, said elongated stiffening member being sufficiently flexible to permit said blade member to flex around said transverse axis to said significantly reduced angle of attack, said at least one elongated stiffening member having sufficient memory to permit said at least one elongated stiffening member and said blade member to snap back from said reduced angle of attack to said neutral blade position at the end of a kicking stroke.

97. A method for connecting a pivoting blade region to a propulsion hydrofoil, comprising connecting said pivoting blade region to a load bearing structure with a transverse flexible thermoplastic hinge element, said transverse flexible thermoplastic hinge element being an elongated region of reduced blade thickness that is molded within said pivoting blade region during injection molding, and providing said transverse flexible thermoplastic hinge element with sufficient flexibility to permit said pivoting blade region to experience pivotal motion around said transverse flexible element during use.

98. The method of claim 97 wherein said pivoting blade region is made with a relatively stiff thermoplastic material.

99. The method of claim 97 wherein said pivoting blade region is made with a resilient thermoplastic material.

100. The method of claim 97 wherein propulsion hydrofoil has a longitudinal alignment oriented in the direction of intended travel and said elongated region of reduced blade thickness has a hinge alignment that is at an angle to said longitudinal alignment.

101. The method of claim 100 wherein said hydrofoil is able to flex around a transverse axis to a longitudinally reduced angle of attack during use.

102. The method of claim 101 wherein said hydrofoil is a swim fin.

103. The method of claim 100 wherein said elongated region of reduced blade thickness includes a relatively soft thermoplastic material connected to said load bearing structure and to said pivoting blade region with a chemical bond created during a phase of injection molding.

104. The method of claim 97 wherein said hydrofoil is a swim fin.

105. The method of claim 97 wherein propulsion hydrofoil has a longitudinal alignment oriented in the direction of intended travel and said elongated region of reduced blade thickness has a hinge alignment that is transverse to said longitudinal alignment.

106. The method of claim 105 wherein said hydrofoil is able to flex around a transverse axis to a longitudinally reduced angle of attack during use.

107. The method of claim 106 wherein said pivoting blade region is able to flex around a transverse axis to a longitudinally reduced angle of attack during use.

108. The method of claim 106 wherein said hydrofoil is a swim fin.

109. The method of claim 94 wherein said pivoting blade region is able to flex around a transverse axis to a longitudinally reduced angle of attack during use.

110. The method of claim 97 wherein said elongated region of reduced blade thickness is connected to a flexible member, said flexible member having a substantially longitudinal alignment.

111. The method of claim 97 wherein said transverse flexible thermoplastic hinge element has a fold formed around a transverse axis.

112. The method of claim 97 wherein said transverse flexible thermoplastic hinge element has a soft portion made with a relatively softer thermoplastic material, said blade region having a stiffer portion made with a relatively stiffer thermoplastic material, said relatively softer thermoplastic material being connected to said relatively stiffer thermoplastic material with a chemical bond created during a phase of an injection molding process.

113. The method of claim 112 wherein said hydrofoil has a foot attachment member, said foot attachment member having a flexible portion made with said relatively softer thermoplastic material used in said soft portion of said transverse flexible thermoplastic hinge element, and both said flexible portion of said foot attachment member and said soft portion of said transverse flexible thermoplastic hinge element being formed at the same time during said phase of said injection molding process.

114. The method of claim 97 wherein said hydrofoil has opposing propulsion surfaces and at least one pro-formed channel shaped depression is disposed within at least one of said opposing propulsion surfaces.

115. The method of claim 97 wherein at least one thermoplastic element made with a relatively flexible thermoplastic material is connected to said pivoting blade region with a chemical bond.

116. The method of claim 97 wherein said hydrofoil has at least one enclosed vent.

117. The method of claim 116 wherein said hydrofoil has a longitudinal channel shaped contour during use and said at least one enclosed vent is disposed within said longitudinal channel shaped contour.

118. The method of claim 117 wherein said hydrofoil is a swim fin having a free end portion, said free end portion having recess sufficient to form two tip portions.

119. The method of claim 118 wherein said recess forms inner edges that may twist.

120. A swim fin comprising:

(a) a foot attachment member;

(b) a blade member molded to said foot attachment member with a chemical bond, said blade member having a root portion adjacent said foot attachment member and a free end portion spaced from said root portion and said foot attachment member, a recess disposed within said free end portion of said blade member, said a recess sufficient to divide said free end portion into two tip portions, said recess defining inner edges of said blade member, at least one of said inner edges having a first inner edge portion having a first inner edge alignment, said first inner edge alignment being more longitudinally oriented than transversely oriented, said at least one of said inner edges also having a second inner edge portion having a second inner edge alignment, said second inner edge having a different alignment than said first longitudinal alignment.

121. The swim fin of claim 120 wherein said first inner edge portion and said second inner edge portion are connected by at least one corner.

122. The swim fin of claim 120 wherein at least one elongated rib member is connected to said blade member.

123. The swim fin of claim 122 wherein said at least one elongated rib member and said blade member are molded with the same material, said at least one elongated rib member having a significantly larger vertical dimension than said blade member.

124. The swim fin of claim 122 wherein at least one blade portion of said blade member is made with a predetermined thermoplastic material and at least one rib portion of said at least one elongated rib member is made with a different predetermined thermoplastic material, said predetermined thermoplastic material and said different predetermined thermoplastic material being connected with a chemical bond created during a phase of injection molding.

125. The swim fin of claim 122 wherein said swim fin has an active portion that includes both said blade member and said at least one elongated rib member, said active portion being made with two different thermoplastic materials molded together with a chemical bond.

126. The swim fin of claim 122 wherein said swim fin has an active portion that includes both said blade member and said at least one elongated rib member, said active portion having at least one flexible portion being made with a relatively flexible thermoplastic material and at least one stiffer portion being made with a relatively stiffer thermoplastic material, said relatively flexible thermoplastic material being connected to said relatively stiffer thermoplastic material with a chemical bond created during a phase of injection molding.

127. The swim fin of claim 126 wherein said foot attachment member has a relatively soft portion made with said relatively flexible thermoplastic material used in flexible portion of said active portion during said phase of injection molding.

128. The swim fin of claim 127 wherein said foot attachment member has a stiffer portion that is made with said relatively stiffer thermoplastic material used in said active portion.

129. The swim fin of claim 126 wherein said at least one flexible portion of said active portion is a flexible membrane-like element disposed within said blade member.

130. The swim fin of claim 122 wherein said blade member has at least one side edge that is capable of twisting relative to said at least one elongated rib member.

131. The swim fin of claim 122 wherein said at least one elongated rib member has a relatively large transverse dimension.

132. The swim fin of claim 122 wherein at least one portion of said at least one elongated rib member has a substantially round cross section.

133. The swim fin of claim 122 wherein at least one portion of said at least one elongated rib member has a substantially tapered cross section.

134. The swim fin of claim 122 wherein said foot attachment member, said blade member and said at least one elongated rib member are made with a thermoplastic material in one injection molding step.

135. The swim fin of claim 122 wherein said foot attachment member, said blade member and said at least one elongated rib member are molded in one step with a resilient material.

136. The swim fin of claim 122 wherein said elongated rib member is made with a relatively high memory thermoplastic material.

137. The swim fin of claim 136 wherein said elongated rib member has sufficient flexibility to flex around a transverse axis to a lengthwise reduced angle of attack during use.

138. The swim fin of claim 137 wherein said transverse axis is located adjacent to said root portion.

139. The swim fin of claim 138 wherein said lengthwise reduced angle of attack is sufficient to create a significant reduction in kicking effort.

140. The swim fin of claim 138 wherein said lengthwise reduced angle of attack is sufficient to significantly increase the amount of water pushed in the opposite direction of intended swimming.

141. The swim fin of claim 137 wherein said transverse axis is located adjacent to said free end portion.

142. The swim fin of claim 120 wherein said recess has a longitudinal dimension that his selected from the group consisting of significantly long, significantly short, and any distance.

143. The swim fin of claim 142 wherein said recess is V-shaped.

144. The swim fin of claim 120 wherein said first inner edge portion and said second inner edge portion are separated by at least one curve.

145. The swim fin of claim 144 wherein said at least one curve is a convex curve.

146. The swim fin of claim 144 wherein said at least one curve is a concave curve.

147. The swim fin of claim 120 wherein said recess has at least one concave curve and at least one convex curve.

148. The swim fin of claim 120 wherein recess has at least one curve.

149. The swim fin of claim 120 wherein free end portion has a free end transverse dimension and at least one portion of said recess has a recess transverse dimension that spans across a majority of said free end transverse dimension.

150. The swim fin of claim 120 wherein said recess is V-shaped.

151. The swim fin of claim 120 wherein said different alignment of said second inner edge portion is oriented in more of a transverse direction than in a longitudinal direction.

152. The swim fin of claim 151 wherein said recess terminates at a base of said recess located a predetermined distance from said foot attachment member, said predetermined distance is selected from the group consisting a short distance, a long distance, and any distance.

153. The swim fin of claim 120 wherein said blade member is made with a relatively stiff thermoplastic material.

154. The swim fin of claim 120 wherein said blade member has outer side edges and two elongated stiffening members are connected to said blade member adjacent said outer side edges.

155. The swim fin of claim 120 wherein a flexible membrane is disposed within said recess to fill the gap created by said recess.

156. The swim fin of claim 155 wherein at least one enclosed vent is disposed within said flexible membrane.

157. The swim fin of claim 120 wherein an expandable member is disposed within said recess and connected to said inner edges.

158. The swim fin of claim 120 wherein said inner edges may twist.

159. The swim fin of claim 120 wherein said swim fin has a longitudinal alignment, and at least one elongated flexible element is disposed within said blade member, and said at least one elongated flexible element having a element alignment that is at an angle to said longitudinal alignment.

160. The swim fin of claim 159 wherein said element alignment is significantly transverse to said longitudinal alignment.

161. The swim fin of claim 159 wherein said at least one elongated flexible element is a region of reduced blade thickness.

162. The swim fin of claim 159 wherein said foot attachment member has a flexible portion made with a relatively flexible thermoplastic material, said at least one elongated flexible element being obtained from injection of said relatively flexible thermoplastic material of said foot attachment member, said at least one elongated flexible element being connected to said blade member with a chemical bond.

163. The swim fin of claim 120 wherein said recess originates adjacent said free end portion and extends toward said foot attachment member and terminates at base of said recess located within said blade member at a predetermined distance from said foot attachment member, said predetermined distance being a significantly long distance.

164. The swim fin of claim 120 wherein said recess originates adjacent said free end portion and extends toward said foot attachment member and terminates at base of said recess located within said blade member at a predetermined distance away from said foot attachment member, said predetermined distance being a significantly short distance.

* * * * *